US009318124B2

(12) United States Patent
Hiroe

(10) Patent No.: US 9,318,124 B2
(45) Date of Patent: Apr. 19, 2016

(54) SOUND SIGNAL PROCESSING DEVICE, METHOD, AND PROGRAM

(75) Inventor: Atsuo Hiroe, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 944 days.

(21) Appl. No.: 13/446,491

(22) Filed: Apr. 13, 2012

(65) Prior Publication Data

US 2012/0263315 A1 Oct. 18, 2012

(30) Foreign Application Priority Data

Apr. 18, 2011 (JP) ..... 2011-092028
Mar. 9, 2012 (JP) ..... 2012-052548

(51) Int. Cl.
*H04R 3/00* (2006.01)
*G10L 21/0216* (2013.01)

(52) U.S. Cl.
CPC ... *G10L 21/0216* (2013.01); *G10L 2021/02166* (2013.01)

(58) Field of Classification Search
USPC ..... 381/71.1–71.13, 94.1, 92, 93, 95, 96; 704/226–228, 233, 222–223
See application file for complete search history.

(56) References Cited

U.S. PATENT DOCUMENTS 6,185,309 B1 * 2/2001 Attias ..... 381/94.1
7,647,209 B2 * 1/2010 Sawada et al. ..... 702/190
7,917,336 B2 * 3/2011 Parra et al. ..... 702/190
8,488,806 B2 * 7/2013 Saruwatari et al. ..... 381/94.1
2006/0206315 A1 * 9/2006 Hiroe et al. ..... 704/203
2009/0012779 A1 * 1/2009 Ikeda et al. ..... 704/205
2009/0086998 A1 * 4/2009 Jeong et al. ..... 381/119
2009/0310444 A1 * 12/2009 Hiroe ..... 367/125
2011/0058685 A1 * 3/2011 Sagayama et al. ..... 381/98
2011/0182437 A1 * 7/2011 Kim et al. ..... 381/73.1
2012/0148069 A1 * 6/2012 Bai et al. ..... 381/94.1

FOREIGN PATENT DOCUMENTS

JP 10-51889 2/1998
JP 2006-72163 3/2006

(Continued)

OTHER PUBLICATIONS

Murata et al, An approach to blind source separation based on temporal structure of speech signals,2001.*

(Continued)

*Primary Examiner* — Davetta W Goins
*Assistant Examiner* — Kuassi Ganmavo
(74) *Attorney, Agent, or Firm* — Hazuki International, LLC

(57) ABSTRACT

There is provided a sound signal processing device, in which an observation signal analysis unit receives multi-channels of sound-signals acquired by a sound-signal input unit and estimates a sound direction and a sound segment of a target sound to be extracted and a sound source extraction unit receives the sound direction and the sound segment of the target sound and extracts a sound-signal of the target sound. By applying short-time Fourier transform to the incoming multi-channel sound-signals this device generates an observation signal in the time-frequency domain and detects the sound direction and the sound segment of the target sound. Further, based on the sound direction and the sound segment of the target sound, this device generates a reference signal corresponding to a time envelope indicating changes of the target's sound volume in the time direction, and extracts the signal of the target sound, utilizing the reference signal.

21 Claims, 25 Drawing Sheets

(56) References Cited

FOREIGN PATENT DOCUMENTS

| | | |
|---|---|---|
| JP | 2008-147920 | 6/2008 |
| JP | 2008-175733 | 7/2008 |
| JP | 2010-20294 | 1/2010 |
| JP | 2010-121975 | 6/2010 |

OTHER PUBLICATIONS

Sawada et al, Measuring dependence of bin wise separated signals for permutation alignment in frequency domain BSSS IEEE 2007.*

Takahashi et al, Blind spatial substraction array with independent component analysis for hands free speech recognition, IWAENC 2006.*

Madhu et al, Temporal smoothing of spectral masks in the cepstral domain for speech separation,2008.*

Reju et al, Underdetermined Convolutive Blind Source Separation via Time-Frequency Masking, 2010.*

* cited by examiner

FIG. 24

| METHOD | ONE MASKING SOUND | | | TWO MASKING SOUNDS | | |
|---|---|---|---|---|---|---|
| | SPEECH | MUSIC | STREET | SPEECH+ MUSIC | SPEECH+ STREET | MUSIC+ STREET |
| (OBSERVED SIGNAL SIR) | 3.65 | 2.87 | 0.93 | 0.07 | -0.97 | -1.36 |
| (1)METHOD 1 OF THE PRESENT DISCLOSURE | 4.10 | 12.68 | 15.77 | 6.17 | 11.57 | 12.46 |
| (2)METHOD 2 OF THE PRESENT DISCLOSURE | 18.24 | 20.48 | 25.19 | 12.55 | 16.95 | 17.24 |
| (3)CONVENTIONAL METHOD (DELAY-AND-SUM ARRAY) | 1.19 | 0.97 | 2.01 | 1.93 | 3.27 | 3.09 |
| (4)CONVENTIONAL METHOD (INDEPENDENT COMPONENT ANALYSIS) | 12.81 | 11.31 | 16.12 | 5.26 | 7.08 | 8.36 |

FIG. 25

| | METHOD OF THE PRESENT DISCLOSURE | CONVENTIONAL METHOD (DELAY-AND-SUM ARRAY) | CONVENTIONAL METHOD (INDEPENDENT COMPONENT ANALYSIS) |
|---|---|---|---|
| CPU TIME [SEC.] | 0.38 | 0.02 | 20.24 |

SOUND SIGNAL PROCESSING DEVICE, METHOD, AND PROGRAM

BACKGROUND

The present disclosure relates to a sound signal processing device, method, and program. More specifically, it relates to a sound signal processing device, method, and program for performing sound source extraction processing.

The sound source extraction processing is used to extract one target source signal from signals (hereinafter referred to as "observation signals" or "mixed signals") in which a plurality of source signals are mixed to be observed with one or more microphones. Hereinafter, the target source signal (that is, the signal desired to be extracted) is referred to as a "target sound" and the other source signals are referred to as "interference sounds".

One of problems to be solved by the sound signal processing device is to accurately extract a target sound if its sound source direction and segment are known to some extent in an environment in which there are a plurality of sound sources.

In other words, it is to leave only a target sound by removing interference sounds from observation signals in which the target sound and the interference sounds are mixed, by using information of a sound source direction and a segment.

The sound source direction as referred to here means a direction of arrival (DOA) as viewed from the microphone and the segment means a couple of a sound starting time (start to be active) and a sound ending time (end being active) and a signal included in the lapse of time.

For example, the following conventional technologies are available which discloses processing to estimate the direction and detect the segment of a plurality of sound sources.

(Conventional Approach 1) Approach Using an Image, in Particular, a Position of the Face and Movement of the Lips This approach is disclosed in, for example, Patent Document 1 (Japanese Patent Application Laid-Open No. 10-51889). Specifically, by this approach, a direction in which the face exists is judged as the sound source direction and the segment during which the lips are moving is regarded as an utterance segment.

(Conventional Approach 2) Detection of Speech Segment Based on Estimated Sound Source Direction Accommodating a Plurality of Sound Sources This approach is disclosed in, for example, Patent Document 2 (Japanese Patent Application Laid-Open No. 2010-121975). Specifically, by this approach, an observation signal is subdivided into blocks each of which has a predetermined length to estimate the directions of a plurality of sound sources for each of the blocks. Next, directions of the sound sources are tracked to interconnect them in the nearer directions in each block.

The following will describe the above problems, that is, to "accurately extract a target sound if its sound source direction and segment are known to some extent in an environment in which there are a plurality of sound sources".

The problem will be described in order of the following items:

A. Details of the problem

B. Specific example of problem solving processing to which the conventional technologies are applied C. Problems of the conventional technologies

[A. Details of the Problem]

A description will be given in detail of the problem of the technology of the present disclosure with reference to FIG. 1.

It is assumed that there are a plurality of sound sources (signal generation sources) in an environment. One of the sound sources is a "sound source of a target sound 11" which generates the target sound and the others are "sound sources of interference sounds 14" which generate the interference sounds.

It is assumed that the number of the target sound sources 11 is one and that of the interference sounds is at least one. Although FIG. 1 shows one "sound source of the interference sound 14", any other interference sounds may exist.

The direction of arrival of the target sound is assumed to be known and expressed by variable θ. In FIG. 1, the sound source direction θ is denoted by numeral 12. The reference direction (line denoting direction=0) may be set arbitrarily. In FIG. 1 it is set as a reference direction 13.

If a sound source direction of the sound source of a target sound 11 is a value estimated by utilizing, for example, the above approaches, that is, any one of the:

(conventional approach 1) using an image, in particular, a position of the face and movement of the lips, and (conventional approach 2) detection of speech segment based on estimated sound source direction accommodating a plurality of sound sources, there is a possibility that θ may contain an error. For example, even if θ=π/6 radian (=30°), there is a possibility that a true sound source direction may be a different value (for example, 35°).

Although the direction of the interference sound is yet to be known, it is assumed that it contains an error even if it is known. This holds true also with the segment. For example, even in an environment in which the interference sound is active, there is a possibility that only its partial segment may be detected or segment of it may be detected.

As shown in FIG. 1, n number of microphones are prepared. They are the microphones 1 to n denoted by numerals 15 to 17 respectively. Further, the relative positions among the microphones are known.

Next, a description will be given of variables which are used in the sound source extraction processing with reference to the following equations (1.1 to 1.3).

In the specification, A_b denotes an expression in which subscript suffix b is set to A, and A^b denotes an expression in which superscript suffix b is set to A.

$$X(\omega, t) = \begin{bmatrix} X_1(\omega, t) \\ \vdots \\ X_n(\omega, t) \end{bmatrix} \quad [1.1]$$

$$Y(\omega, t) = W(\omega)X(\omega, t) \quad [1.2]$$

$$W(\omega) = [W_1(\omega), \ldots, W_n(\omega)] \quad [1.3]$$

Let x_k(τ) be a signal observed with the k-th microphone, where τ is time.

By performing short-time Fourier transform (STFT) on the signal (which is detailed later), an observation signal Xk(ω, t) in the time-frequency domain is obtained, where ω is a frequency bin number, and t is a frame number.

Let X(ω, t) be a column vector of X_1(ω, t) to X_n(ω, t), which is an observation signal with each microphone (Equation [1.1]).

By extraction of sound sources according to the present disclosure, basically, an extraction result Y(ω, t) is obtained by multiplying the observation signal X(ω, t) by an extracting filter W (ω) (Equation [1.2]), where the extracting filter W(ω) is a row vector including n number of elements and denoted as Equation [1.3].

The various approaches for extracting sound sources can be classified on the basis of a difference in method for calculating the extracting filter W(ω) basically.

[B. Specific Example of Problem Solving Processing to which Conventional Technologies are Applied]

The approaches for realizing processing to extract a target sound from mixed signals from a plurality of sound sources are roughly classified into the following two approaches:

B1. sound source extraction approach and

B2. sound source separation approach.

The following will describe conventional technologies to which those approaches are applied.

(B1. Sound Source Extraction Approach)

As the sound source extraction approach for extracting sound sources by using known sound source direction and segment, the following are known, for example:

B1-1: Delay-and-sum array;

B1-2: Minimum variance beamformer;

B1-3: Maximum SNR beamformer;

B1-4: Approach based on target sound removal and subtraction; and

B1-5: Time-frequency masking based on phase difference.

Those approaches all use a microphone array (in which a plurality of microphones are disposed to the different positions). For their details, see Patent Document 3 (Japanese Patent Application Laid-Open No. 2006-72163).

The following will outline those approaches.

(B1-1. Delay-and-sum Array)

If the different time delays are given to signals observed with the different microphones and those observation signals are summed in condition where phases of the signals in a direction of a target sound are aligned, the target sound is emphasized because of aligned phase and sound from in other directions are attenuated because they are shifted in phase respectively.

Specifically, letting S(ω,θ) be a steering vector corresponding to a direction θ (which is a vector giving a difference in phase between the microphones on a sound coming in a direction and will be detailed later), an extraction result is obtained by using the following equation [2.1].

$$Y(\omega, t) = S(\omega, \theta)^H X(\omega, t) \quad [2.1]$$

$$Y(\omega, t) = M(\omega, t) X_k(\omega, t) \quad [2.2]$$

$$\text{angle}\left(\frac{X_2(\omega, t)}{X_1(\omega, t)}\right) \quad [2.3]$$

$$N(\omega) = [S(\omega, \theta_1) \ \ldots \ S(\omega, \theta_m)] \quad [2.4]$$

$$Z(\omega, t) = N(\omega)^{\#} X(\omega, t) \quad [2.5]$$

In this equation, superscript "H" denotes Hermitian transpose, by which a vector or matrix is transposed and its elements are transformed into conjugate complex numbers.

(B1-2. Minimum Variance Beamformer)

By this approach, only a target sound is extracted by forming a filter which has a gain 1 (which means no emphasis nor attenuation) in the direction of a target sound and a null beam (which means a direction having a lower sensitivity and is referred to a null beam also) in the direction of an interference sound.

(B1-3. Maximum SNR Beamformer)

By this approach, a filter W(ω) is obtained which maximizes V_s(ω)/V_n(ω), which is a ratio between the following a) and b):

a) V_s(ω): Variance of a result obtained by applying an extracting filter W(ω) to a segment where only the target sound is active b) V_n(ω): Variance of a result obtained by applying the extracting filter W(ω) to a segment where only the interference sound is active By this approach, the direction of the target sound is unnecessary if the respective segments can be detected.

(B1-4. Approach Based on Removal and Subtraction of Target Sound)

A signal (target sound-removed signal) obtained by removing the target sound from the observation signals is formed once and then this target sound-removed signal is subtracted from the observation signal (or a signal in which the target sound is emphasized by a delay-and-sum array etc.), thereby giving only the target sound.

By the Griffith-Jim beamformer, which is one of the approaches, ordinary subtraction is used as a subtraction method. There is another approach such as a spectral subtraction etc., by which nonlinear subtraction is used.

(B1-5. Time-frequency Masking Based on Phase Difference)

By the frequency masking approach, the different frequencies are multiplied by the different coefficients to mask (suppress) the frequency components dominant in the interference sound while leaving the frequency components dominant in the target sound, thereby extracting the target sound.

By the time-frequency masking approach, the masking coefficient is not fixed but changed as time passes by, so that letting M(ω, t) be the masking coefficient, extraction can be denoted by Equation [2.2]. As the second term in the right-hand side, an extraction result by means of any other approach other than X_k(ω, t) may be used. For example, the extraction result by use of the delay-and-sum array (Equation [2.1]) may be multiplied by the mask M(ω, t).

Generally, the sound signal is sparse both in the frequency direction and in the time direction, so that even if the target sound and the interference sound become active simultaneously, there are many cases where the target sound is dominant time-wise and frequency-wise. Some methods for finding such times and frequencies would use a different in phase of the microphones.

For time-frequency masking by use of phase difference, see, for example, "Variant 1. Frequency Masking" described in Patent Document 4 (Japanese Patent Application Laid-Open No. 2010-20294). Although this example would calculate the masking coefficient from a sound source direction and a phase different which are obtained by independent component analysis (ICA), the phase difference obtained by any other approach can be applied. The following will describe the frequency masking from a viewpoint of sound source extraction.

For simplification, it is assumed that two microphones are used. That is, in FIG. 2, the number of the microphones (n) is two (n=2).

If there are no interference sounds, an inter-microphone phase difference plot and a frequency plot follow almost the same straight line. For example, if there is only one sound source of the target sound 11 in FIG. 1, a sound from the sound source arrives at the microphone 1 (denoted by numeral 15) first and, after a constant lapse of time, arrives at the microphone 2 (denoted by numeral 16).

By comparing signals observed by those two microphones:

signal observed by the microphone 1 (denoted by 15): X_1(ω, t), and signal observed by the microphone 2 (denoted by 16): X_2(ω, t), it is found that X_2(ω, t) is delayed in phase.

Therefore, by calculating the phase difference between the two by using Equation [2.4] and plotting a relationship between the phase difference and the frequency bin number ω, a correspondence relationship shown in FIG. 2 can be obtained.

Phase difference dots 22 are on a straight line 21. A difference in arrival time depends on the sound source direction θ, so that the gradient of the straight line 21 also depends on the sound source direction θ. Angle (x) is a function to obtain the angle of deviation of a complex number x as follows:

$$\mathrm{angle}(A\exp(j\alpha))=\alpha$$

If there are interference sounds, the phase of the observation signal is affected by the interference sounds, so that the phase difference plot deviates from the straight line. The magnitude of the deviation is largely dependent on the influence of the interference sounds. In other words, if the dot of the phase difference at a frequency and at a time exists near the straight line, the interference sounds have small components at this frequency and at this time. Therefore, by generating and applying a mask that leaves the components at such a frequency and at such a time while suppressing the others, it is possible to leave only the components of a target sound.

FIG. 3 is an example where almost the same plot as FIG. 2 is provided in an environment where there are interference sounds. A straight line 31 is similar to the straight line 21 shown in FIG. 2 but has phase-difference dots deviated from the straight line owing to an influence of the interference sounds. For example, a dot 33 is one of them. A frequency bin having a dot largely deviated from the straight line 31 means that the interference sounds have a large component, so that such a frequency bin component is attenuated. For example, a shift between the phase difference dot and the straight line, that is, a shift 32 shown in FIG. 3 is calculated, so that the larger this value is, the nearer the M(ω, t) in Equation [2.2] is set to 0, inversely, the nearer the phase difference dot is to the straight line, the nearer the M(ω, t) is set to 1.

Time-and-frequency masking has an advantage in that it involves a smaller computational cost than the minimum variance beamformer and the ICA and can also remove non-directional interference sounds (environmental noise etc., sounds whose sound source directions are unclear). On the other hand, it has a problem in that it involves occurrence of discontinuous portions in the spectrum and, therefore, is prone to occurrence of musical noise at the time of recovery to waveforms.

(B2. Sound Source Separation Approach)

Although the conventional sound source extraction approaches have been described above, a variety of sound source separation approaches can be applied in some cases. That is, after generating a plurality of sound sources becoming active simultaneously by the sound source separation approach, one target signal is selected by using information such as a sound source direction.

The following may be enumerated as the sound source separation approach.

B2-1. Independent component analysis (ICA)

B2-2. Null beamformer

B2-3. Geometric constrained source separation (GSS)

The following will outline those approaches.

(B2-1. Independent Component Analysis: ICA)

A separation matrix W(ω) is obtained so that each of the components of Y(ω), which is a result of applying W(ω), may be independent statistically. For details, see Japanese Patent Application Laid-Open No. 2006-238409. Further, for a method for obtaining a sound source direction from results of separation by use of ICA, see the above Patent Document 4 (Japanese Patent Application Laid-Open No. 2010-20294).

Besides the ordinary ICA approach for generation results of separation as many as the number of the microphones, a method referred to as a deflation method is available for extracting source signals one by one and used in analysis of signals as, for example, a magneto-encephalography (MEG). However, if the deflation method is applied simply to a signal in the time frequency domain, a phenomenon occurs that which one of the source signals is extracted first varies with the frequency bin. Therefore, the deflation method is not used in extraction of the time frequency signal.

(B2-2. Null Beamformer)

A matrix is generated in which steering vectors (whose generation method is described later) corresponding to sound source directions respectively are arranged horizontally, to obtain its (pseudo) inverse matrix, thereby separating an observation signal into the respective sound sources.

Specifically, letting θ_1 be the sound source direction of a target sound and θ_2 to θ_m be the sound source directions of interference sounds, a matrix N(ω) is generated in which steering vectors corresponding to the sound source directions respectively are arranged horizontally (Equation [2.4]). By multiplying the pseudo inverse matrix of N(ω) and the observation signal vector X(ω, t), a vector Z(ω, t) is obtained which has the separation results as its elements (Equation [2.5]). (In the equation, the superscript # denotes the pseudo inverse matrix.)

Since the direction of the target sound is θ_1, the target sound is the top element in the Z(ω, t).

Further, the first row of N(ω)^# provides a filter in which a null beam is formed in the directions of all of the sound sources other than the target sound.

(B2-3. Geometric Constrained Source Separation (GSS))

By obtaining a matrix W(ω) that satisfies the following two conditions, a separation filter can be obtained which is more accurate than the null beamformer.

a) W(ω) is a (pseudo) inverse matrix of N(ω).

b) W(ω) is statistically non-correlated with the application result Z(ω, t).

[C. Problems of Conventional Technologies]

Next, a description will be given of problems of the conventional technologies described above.

Although the above example has set the target sound's direction and segment to be known, they may not typically be obtained accurately. That is, there are the following problems.

1) The target sound's direction may be inaccurate (contain an error) in some cases.

2) The interference sound's segment may not typically be detected.

For example, by the method using an image, there is a possibility that a misalignment between the camera and the microphone array may give a disagreement between a sound source direction calculated from the face position and a sound source direction with respect to the microphone array. Further, the segment may not be detected for the sound source not related to the face position or the sound source out of the camera angle of field.

By the approach based on sound source direction estimation, there is trade-off between the accuracy of directions and its computational const. For example, if the MUSIC method is used for sound source direction estimation, by decreasing the angle steps in which the null beam is scanned, the accuracy is improved but the computational cost increases.

MUSIC stands for MUltiple SIgnal Classification. From the viewpoint of spatial filtering by which a sound in a specific direction is permitted to pass or suppressed, the MUSIC method may be described as processing including the following two steps (S1 and S2). For details of the MUSIC method, see Patent Document 5 (Japanese Patent Application Laid-Open No. 2008-175733) etc.

(S1) Generating a spatial filter that a null beam is directed to all of sound sources which are active in a certain segment (block), and (S2) Scanning the directivity pattern (relationship between the direction and the gain) of the filter, to obtain a direction in which the null beam appears.

The sound source direction optimal to extraction varies with the frequency bin. Therefore, if only one sound source direction is obtained from all of the frequencies, a mismatch occurs between the optimal value and some of the frequency bins.

If the target sound direction is inaccurate or the interference sound may not be detected in such a manner, some of the conventional methods may be deteriorated in accuracy in extraction (or separation).

In the case of using sound source extraction as previous processing of any other processing (speech recognition or recording), the following requirements should preferably be satisfied:

low-delay (a small lapse of time elapses from the end of a segment to the generation of extraction results (or separation results); and followability (high extraction accuracy is kept from the start of the segment)

However, none of the conventional methods has satisfied all of those requirements. The following will describe problems of the above approaches.

(C1. Problems of Delay-and-sum Array (B1-1))

Even with inaccurate directions, the influence is restrictive to some extent.

However, if a small number of (for example, three to five) microphones are used, the interference sounds are not attenuated so much. That is, this approach has only an effect of emphasizing the target sound to a small extent.

(C2. Problems of Minimum Variance Beamformer (B1-2))

If there is an error in the direction of a target sound, extraction accuracy decreases rapidly. This is because if a direction in which the gain is fixed to 1 disagrees with a true direction of the target sound, a null beam is formed also in the direction of the target sound to deteriorate the target sound also. That is, a ratio between the target sound and the interference sound (SNR) will not increase.

To address this problem, a method is available for learning an extracting filter by using an observation signal in a segment where the target sound is not active. However, in this case, all of the sound sources other than the target sound need to be active in this segment. In other words, the interference sound, if present only in the segment in which the target sound is active, may not be removed.

(C3. Problems of Maximum SNR Beamformer (B1-3))

It does not use a sound source direction and, therefore, is not affected even by inaccurate direction of the target sound.

However, it needs to give both of:

a) a segment in which only the target sound is active, and b) segment in which all of the sound sources other than the target sound are active, and, therefore, may not be applied if any one of them may not be obtained. For example, if any one of the interference sounds is active almost at all times, a) may not be obtained. Further, if there is an interference sound active only in a segment in which the target sound is active, b) may not be obtained.

(C4. Problems of Approach Based on Removal and Subtraction of Target Sound (B1-4))

If there is an error in the direction of a target sound, extraction accuracy decreases rapidly. This is because if the direction of the target sound is inaccurate, the target sound is not completely removed, so that if the signal is subtracted from an observation signal, the target sound is also removed to some extent.

That is, the ratio between the target sound and the interference sound does not increase.

(C5. Problems of Time-frequency Masking Based on Phase Difference (B1-5))

This approached suffers from inaccurate directions but is not so much affected to some extent.

However, originally, there are not so large differences in phase between the microphones at low frequencies, so that accurate extraction is difficult.

Further, a discontinuous portion is liable to occur in a spectrum, so that there is a case where musical noise may occur at the time of recovery to waveforms.

There is another problem in that the spectrum of results of processing of time-frequency masking is different from a spectrum of a natural speech, so that if speech synthesis etc. is utilized at the latter stage, extraction is possible (interference sounds can be removed) but, in some cases, the accuracy of speech recognition may not be improved in some cases.

Moreover, there is a possibility that if the degree of overlapping between the target sound and the interference sound increases, masked portions increase, so that there is a possibility that a sound volume as a result of extraction may decrease of the degree of musical noise may increase.

(C6. Problems of Independent Component Analysis (ICA) (B2-1))

This approach does not use a sound source direction, so that no influence is given on separation even with inaccurate directions.

However, this approach involves larger computational cost than the other approaches and suffers from a large delay in batch processing (which uses observation signals all over the segments). Moreover, in the case of a single target sound, even though only one of n number of (n: number of microphones) separated signals is employed, the same computational cost and the same memory usage are necessary as those in a case where n number of them are used. Besides, this approach needs processing to select the signal and, therefore, involves the correspondingly increased computational cost and develops a possibility that a signal different from the target sound may be selected, which is referred to as selection error.

By providing real-time processing through applying shift or on-line algorithms described in Patent Document 6 (Japanese Patent Application Laid-Open No. 2008-147920), the latency can be reduced but tracking lag occurs. That is, a phenomenon occurs that a sound source which becomes active first has low extraction accuracy near the start of a segment and, as it gets nearer the end of the segment, the extraction accuracy increases.

(C7. Problems of Null Beamformer (B2-2))

If the direction of an interference sound is inaccurate, the separation accuracy decreases rapidly. This is because a null beam is formed in a direction different from the true direction of the interference sound and, therefore, the interference sound is not removed.

Further, the directions of all the sound sources in the segment including the interference sounds need to be known. The undetected sound sources are not removed.

(C8. Problems of Geometric Constrained Source Separation (GSS) (B2-3))

This approach suffers from inaccurate directions but is not so much affected to some extent.

In this approach also, the directions of all the sound sources in the segment including the interference sounds need to be known.

The above discussion may be summarized as follows: there has been no approach satisfying all of the following requirements.

Even with the inaccurate direction of a target sound, its influence is small.

Even if the segment and the direction of an interference sound are unknown, the target sound can be extracted.

Small latency and high tracking capability.

For those technologies, see, for example, Japanese Patent Application Laid-Open No. 10-51889 (Document 1), Japanese Patent Application Laid-Open No. 2010-121975 (Document 2), Japanese Patent Application Laid-Open No. 2006-72163 (Document 3), Japanese Patent Application Laid-Open No. 2010-20294 (Document 4), Japanese Patent Application Laid-Open No. 2008-175733 (Document 5), and Japanese Patent Application Laid-Open No. 2008-147920 (Document 6).

SUMMARY

In view of the above, the present disclosure has been developed, and it is an object of the present disclosure to provide a sound signal processing device, method, and program that can extract a sound source with small delay and high followability and that is less affected even if, for example, the direction of a target sound is inaccurate and can extract the target sound even if the segment and the direction of an interference sound are unknown.

For example, in one embodiment of the present disclosure, a sound source is extracted by using a time envelope of a target sound as a reference signal (reference).

Further, in the one embodiment of the present disclosure, the time envelope of the target sound is generated by using time-frequency masking in the direction of the target sound.

According to the first aspect of the present disclosure, there is provided a sound signal processing device including an observation signal analysis unit for receiving a plurality of channels of sound signals acquired by a sound signal input unit composed of a plurality of microphones mounted to different positions and estimating a sound direction and a sound segment of a target sound to be extracted, and a sound source extraction unit for receiving the sound direction and the sound segment of the target sound analyzed by the observation signal analysis unit and extracting a sound signal of the target sound. The observation signal analysis unit has a short-time Fourier transform unit for applying short-time Fourier transform to the incoming multi-channel sound signals to thereby generate an observation signal in the time-frequency domain, and a direction-and-segment estimation unit for receiving the observation signal generated by the short-time Fourier transform unit to thereby detect the sound direction and the sound segment of the target sound, and the sound source extraction unit generates a reference signal which corresponds to a time envelope denoting changes of the target's sound volume in the time direction based on the sound direction and the sound segment of the target sound incoming from the direction-and-segment estimation unit and extracts the sound signal of the target sound by utilizing this reference signal.

Further, according to one embodiment of the sound signal processing of the present disclosure, the sound source extraction unit generates a steering vector containing phase difference information between the plurality of microphones for obtaining the target sound based on information of a sound source direction of the target sound and has a time-frequency mask generation unit for generating a time-frequency mask which represents similarities between the steering vector and the information of the phase difference calculated from the observation signal including an interference sound, which is a signal other than a signal of the target sound, and a reference signal generation unit for generating the reference signal based on the time-frequency mask.

Further, according to one embodiment of the sound signal processing of the present disclosure, the reference signal generation unit may generate a masking result of applying the time-frequency mask to the observation signal and averaging time envelopes of frequency bins obtained from this masking result, thereby calculating the reference signal common to all of the frequency bins.

Further, according to one embodiment of the sound signal processing of the present disclosure, the reference signal generation unit may directly average the time-frequency masks between the frequency bins, thereby calculating the reference signal common to all of the frequency bins.

Further, according to one embodiment of the sound signal processing of the present disclosure, the reference signal generation unit may generate the reference signal in each the frequency bin from the masking result of applying the time-frequency mask to the observation signal or the time-frequency mask.

Further, according to one embodiment of the sound signal processing of the present disclosure, the reference signal generation unit may give different time delays to the different observation signals at microphones in the sound signal input unit to align the phases of the signals arriving in the direction of the target sound and generate the masking result of applying the time-frequency mask to a result of a delay-and-sum array of summing up the observation signals, and obtain the reference signal from this masking result.

Further, according to one embodiment of the sound signal processing of the present disclosure, the sound source extraction unit may have a reference signal generation unit that generates the steering vector including the phase difference information between the plurality of microphones obtaining the target sound, based on the sound source direction information of the target sound, and generates the reference signal from the processing result of the delay-and-sum array obtained as a computational processing result of applying the steering vector to the observation signal.

Further, according to one embodiment of the sound signal processing of the present disclosure, the sound source extraction unit may utilize the target sound obtained as the processing result of the sound source extraction processing as the reference signal.

Further, according to one embodiment of the sound signal processing of the present disclosure, the sound source extraction unit may perform loop processing to generate an extraction result by performing the sound source extraction processing, generate the reference signal from this extraction result, and perform the sound source extraction processing again by utilizing this reference signal an arbitrary number of times.

Further, according to one embodiment of the sound signal processing of the present disclosure, the sound source extraction unit may have an extracting filter generation unit that generates an extracting filter to extract the target sound from the observation signal based on the reference signal.

Further, according to one embodiment of the sound signal processing of the present disclosure, the extracting filter generation unit may perform eigenvector selection processing to calculate a weighted co-variance matrix from the reference signal and the de-correlated observation signal and select an eigenvector which provides the extracting filter from among a plurality of the eigenvectors obtained by applying eigenvector decomposition to the weighted co-variance matrix.

Further, according to one embodiment of the sound signal processing of the present disclosure, the extracting filter generation unit may use a reciprocal of the N-th power (N: positive real number) of the reference signal as a weight of the weighted co-variance matrix, and perform, as the eigenvector selection processing, processing to select the eigenvector corresponding to the minimum eigenvalue and provide it as the extracting filter.

Further, according to one embodiment of the sound signal processing of the present disclosure, the extracting filter generation unit may uses the N-th power (N: positive real number) of the reference signal as a weight of the weighted co-variance matrix, and perform, as the eigenvector selection processing, processing to select the eigenvector corresponding to the maximum eigenvalue and provide it as the extracting filter.

Further, according to one embodiment of the sound signal processing of the present disclosure, the extracting filter generation unit may perform processing to select the eigenvector that minimizes a weighted variance of an extraction result Y which is a variance of a signal obtained by multiplying the extraction result by, as a weight, a reciprocal of the N-th power (N: positive real number) of the reference signal and provide it as the extracting filter.

Further, according to one embodiment of the sound signal processing of the present disclosure, the extracting filter generation unit may perform processing to select the eigenvector that maximizes a weighted variance of an extraction result Y which is a variance of a signal obtained by multiplying the extraction result by, as a weight, the N-th power (N: positive real number) of the reference signal and provide it as the extracting filter.

Further, according to one embodiment of the sound signal processing of the present disclosure, the extracting filter generation unit may perform, as the eigenvector selection processing, processing to select the eigenvector that corresponds to the steering vector most extremely and provide it as the extracting filter.

Further, according to one embodiment of the sound signal processing of the present disclosure, the extracting filter generation unit may perform eigenvector selection processing to calculate a weighted observation signal matrix having a reciprocal of the N-th power (N: positive integer) of the reference signal as its weight from the reference signal and the de-correlated observation signal and select an eigenvector as the extracting filter from among the plurality of eigenvectors obtained by applying singular value decomposition to the weighted observation signal matrix.

Further, according to another embodiment of the present disclosure, there is provided a sound signal processing device including a sound source extraction unit that receives sound signals of a plurality of channels acquired by a sound signal input unit including a plurality of microphones mounted to different positions and extracts the sound signal of a target sound to be extracted, wherein the sound source extraction unit generates a reference signal which corresponds to a time envelope denoting changes of the target's sound volume in the time direction, based on a preset sound direction of the target sound and a sound segment having a predetermined length, and utilizes this reference signal to thereby extract the sound signal of the target sound in each of the predetermined sound segment.

Further, according to another embodiment of the present disclosure, there is provided a sound signal processing method performed in the sound signal processing device, the method including an observation signal analysis step by the observation signal analysis unit of receiving a plurality of channels of sound signals acquired by the sound signal input unit composed of a plurality of microphones mounted to different positions and estimating a sound direction and a sound segment of a target sound to be extracted, and a sound source extraction step by the sound source extraction unit of receiving the sound direction and the sound segment of the target sound analyzed by the observation signal analysis unit and extracting a sound signal of the target sound. The observation signal analysis step may perform short-time Fourier transform processing to apply short-time Fourier transform to the incoming multi-channel sound signals to thereby generate an observation signal in the time-frequency domain, and direction-and-segment estimation processing to receive the observation signal generated by the short-time Fourier transform processing to thereby detect the sound direction and the sound segment of the target sound, and in the sound source extraction step, a reference signal which corresponds to a time envelope denoting changes of the target's sound volume in the time direction is generated on the basis of the sound direction and the sound segment of the target sound incoming from the direction-and-segment estimation step, to extract the sound signal of the target sound by utilizing this reference signal.

Further, according to another embodiment of the present disclosure, there is provided a program having instructions to cause the sound signal processing device to perform sound signal processing, the processing including an observation signal analysis step by the observation signal analysis unit of receiving a plurality of channels of sound signals acquired by the sound signal input unit composed of a plurality of microphones mounted to different positions and estimating a sound direction and a sound segment of a target sound to be extracted, and a sound source extraction step by the sound source extraction unit of receiving the sound direction and the sound segment of the target sound analyzed by the observation signal analysis unit and extracting a sound signal of the target sound. The observation signal analysis step may perform short-time Fourier transform processing to apply short-time Fourier transform to the incoming multi-channel sound signals to thereby generate an observation signal in the time-frequency domain, and direction-and-segment estimation processing to receive the observation signal generated by the short-time Fourier transform processing to thereby detect the sound direction and the sound segment of the target sound, and in the sound source extraction step, a reference signal which corresponds to a time envelope denoting changes of the target's sound volume in the time direction is generated on the basis of the sound direction and the sound segment of the target sound incoming from the direction-and-segment estimation step, to extract the sound signal of the target sound by utilizing this reference signal.

The program of the present disclosure can be provided, for example, in a computer-connectable recording medium or communication medium to an image processing device or a computer system which can execute a variety of program codes. By providing such a program in a format that can be connected to the computer, processing corresponding to the program is realized in the image processing device or the computer system.

The other objects, features, and advantages of the present disclosure will become apparent from the following detailed description of the embodiments and the accompanying drawings of the present disclosure. A term "system" in the present specification means a logical composite configuration of a plurality of devices and is not limited to the same frame including the configurations of the devices.

According to the configuration of one embodiment of the present disclosure, a device and method are realized of extracting a target sound from a sound signal in which a plurality of sounds are mixed.

Specifically, the observation signal analysis unit estimates a sound direction and a sound segment of the target sound to be extracted by receiving the multi-channel sound signal from the sound signal input unit which includes a plurality of microphones mounted to different positions, and the sound source extraction unit receives the sound direction and the sound segment of the target sound analyzed by the observation signal analysis unit and extracts the sound signal of the target sound.

For example, short-time Fourier transform is performed on the incoming multi-channel sound signal to thereby obtain an observation signal in the time frequency domain, and based on the observation signal, a sound direction and a sound segment of the target sound are detected. Further, based on the sound direction and the sound segment of the target sound, a reference signal which corresponds to a time envelope denoting changes of the target's sound volume in the time direction is generated and utilized to extract the sound signal of the target sound.

BRIEF DESCRIPTION OF THE DRAWINGS

FIG. 24 is an explanatory table of SIR-improved data by the sound source extraction processing according to the present disclosure and each of conventional methods; and FIG. 25 is a table of data to compare calculation amounts of the sound source extraction processing according to the present disclosure and each of the conventional methods, the table showing the average CPU processing time of each method.

DETAILED DESCRIPTION OF THE EMBODIMENTS

Figure 1:
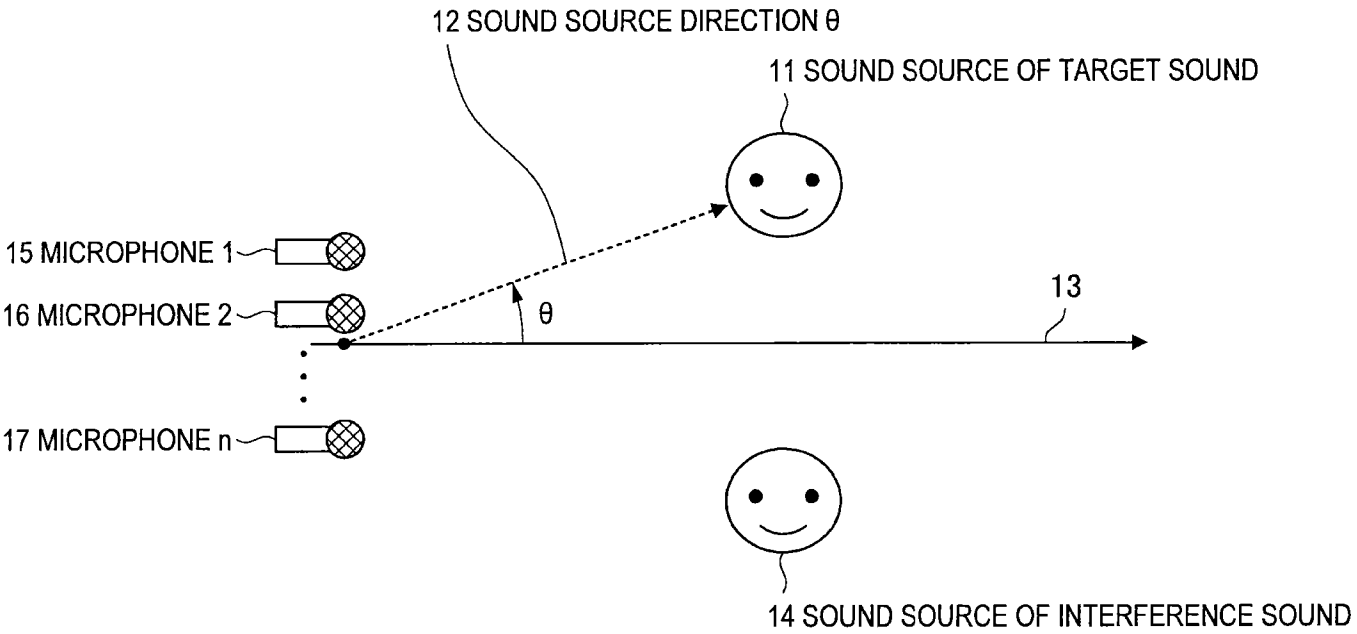
FIG. 1 is an explanatory view of one example of a specific environment in the case of performing sound source extraction processing.
Figure 2:
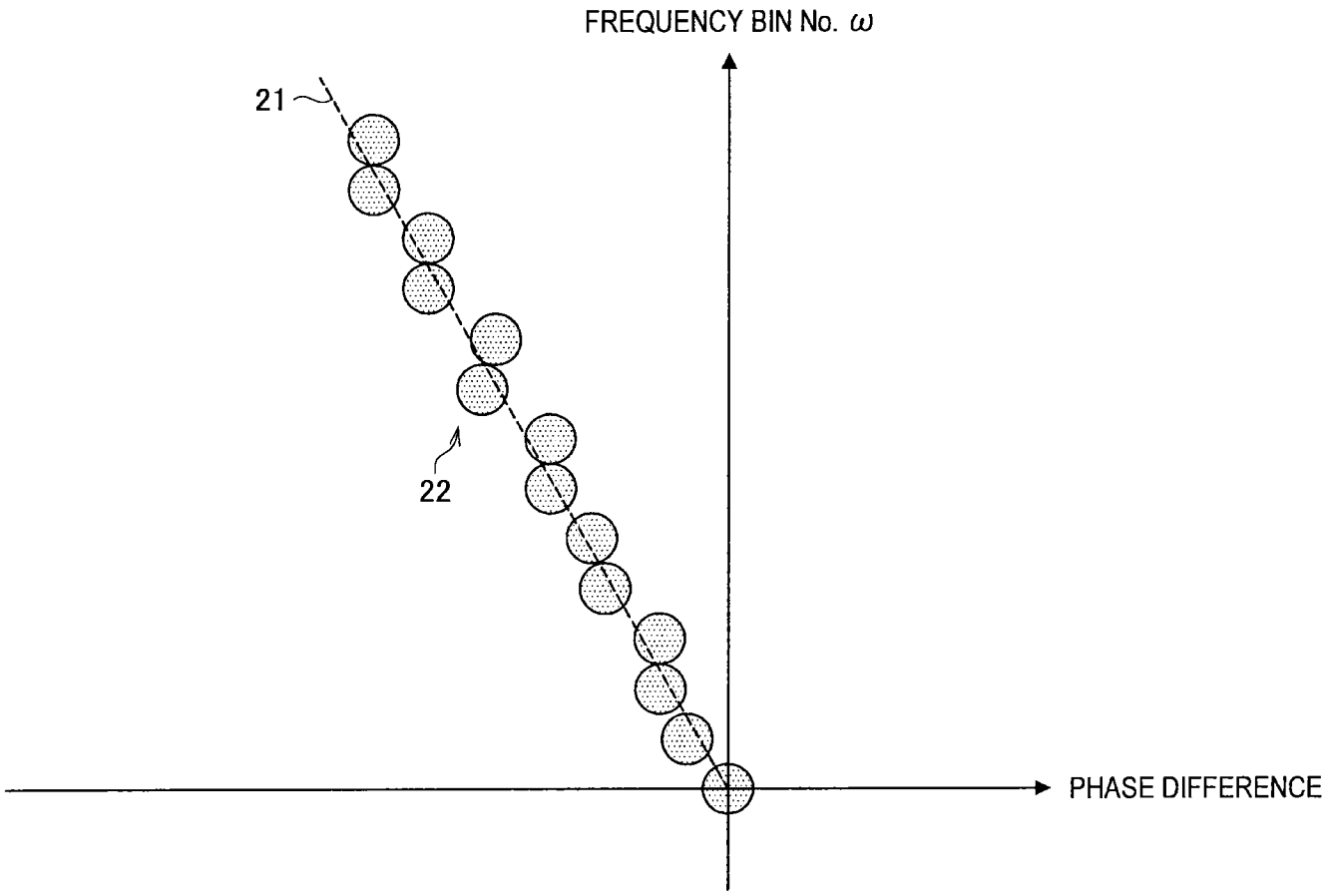
FIG. 2 is a view showing a relational graph between a phase difference of sounds input to a plurality of microphones and frequency bin numbers ω.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

Figure 17A:
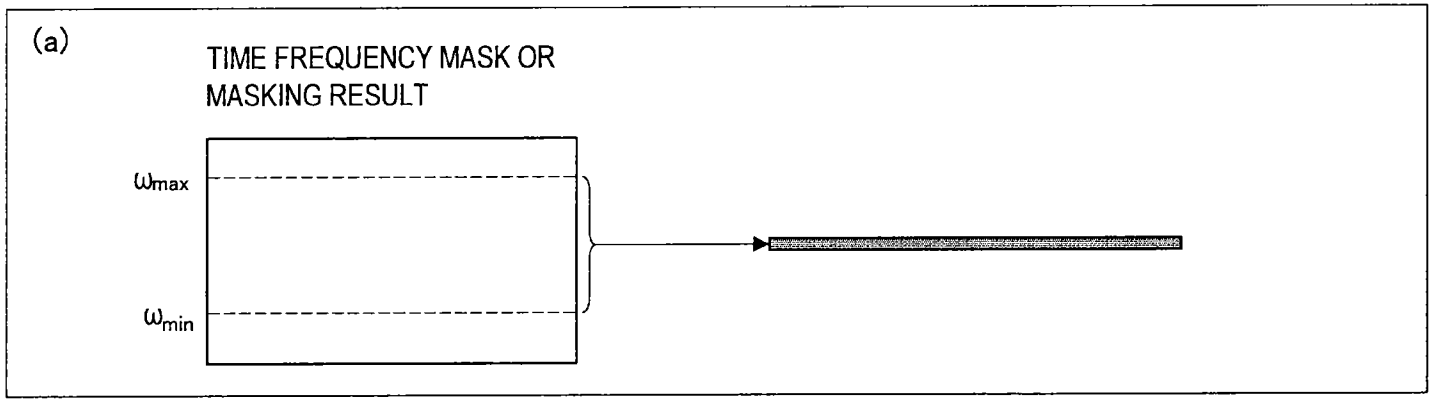
FIG. 17A is an explanatory view of an example of generating the reference signal common to all frequency bins and an example of generating the reference signal for each frequency bin.

The following will describe in detail a sound signal processing device, method, and program with reference to the drawings. In the present specification, there may be cases where FIG. 17A, FIG. 17B, etc. are expressed as FIG. 17*a*, FIG. 17*b*, etc. respectively.

A description will be given in detail of processing along the following items:

1. Outline of configuration and processing of sound signal processing device 1-1. Configuration and overall processing of sound signal processing device 1-2. Sound source extraction processing using time envelope of target sound as reference signal (reference)

1-3. Processing of generating time envelope of target sound by using time-frequency masking from direction of target sound 2. Detailed configuration and specific processing of sound signal processing device of the present disclosure 3. Variants 4. Summary of effects of processing of the present disclosure 5. Summary of configuration of the present disclosure The following will describe those in this order.

As described above, the following notations are assumed:

A_b means that subscript suffix b is set to A; and

A^b means that superscript suffix b is set to A.

Further, conj(X) denotes a conjugate complex number of complex number X. In equations, the conjugate complex number of X is denoted as X plus superscript bar.

hat(x) means x plus superscript "^".

Substitution of a value is expressed as "=" or "←". In particular, a case where the equality sign does not hold true between the two sides of an equation (for example, "x←x+1") is expressed by "←".

[1. Outline of Configuration and Processing of Sound Signal Processing Device]

A description will be given of the outline of a configuration of processing of a sound signal processing device of the present disclosure.

(1-1. Configuration and Overall Processing of Sound Signal Processing Device)

Figure 4:
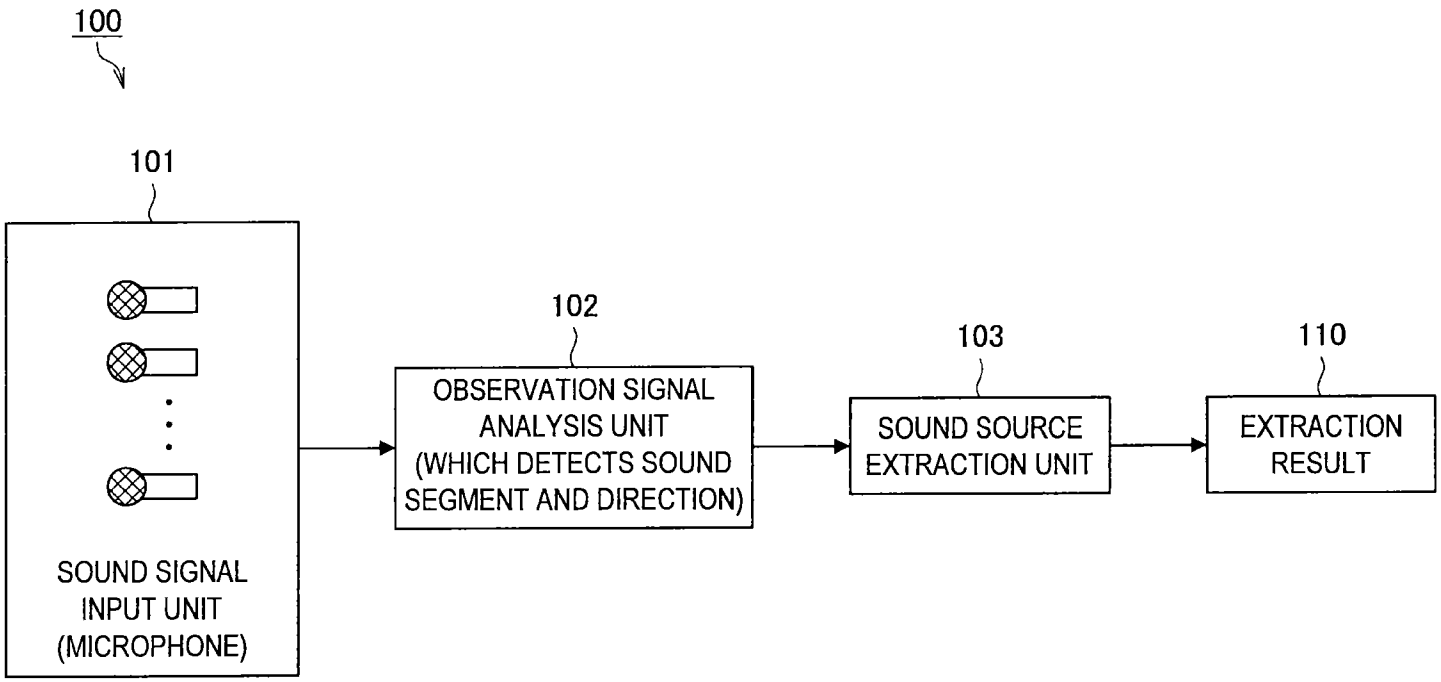
FIG. 4 is a diagram showing one configuration example of a sound signal processing device.

FIG. 4 shows a configuration example of a sound signal processing device of the present disclosure.

As shown in FIG. 4, a sound signal processing device 100 has a sound signal input unit 101 composed of a plurality of microphones, an observation signal analysis unit 102 for receiving an input signal (observation signal) from the sound signal input unit 101 and performing analysis processing on the input signal, specifically, for example, detecting a sound segment and a direction of a target sound source to be extracted, and a sound source extraction unit 103 for detecting a sound of the target sound source from the observation signal (signal in which a plurality of sounds are mixed) in each sound segment of a target sound detected by the observation signal analysis unit 102. A result 110 of extracting the target sound generated by the sound source extraction unit 103 is output to, for example, a latter-stage processing unit for performing processing such as speech recognition, for example.

A description will be given of a specific processing example of each of the processing units shown in FIG. 4 with reference to FIG. 5.

Figure 5:
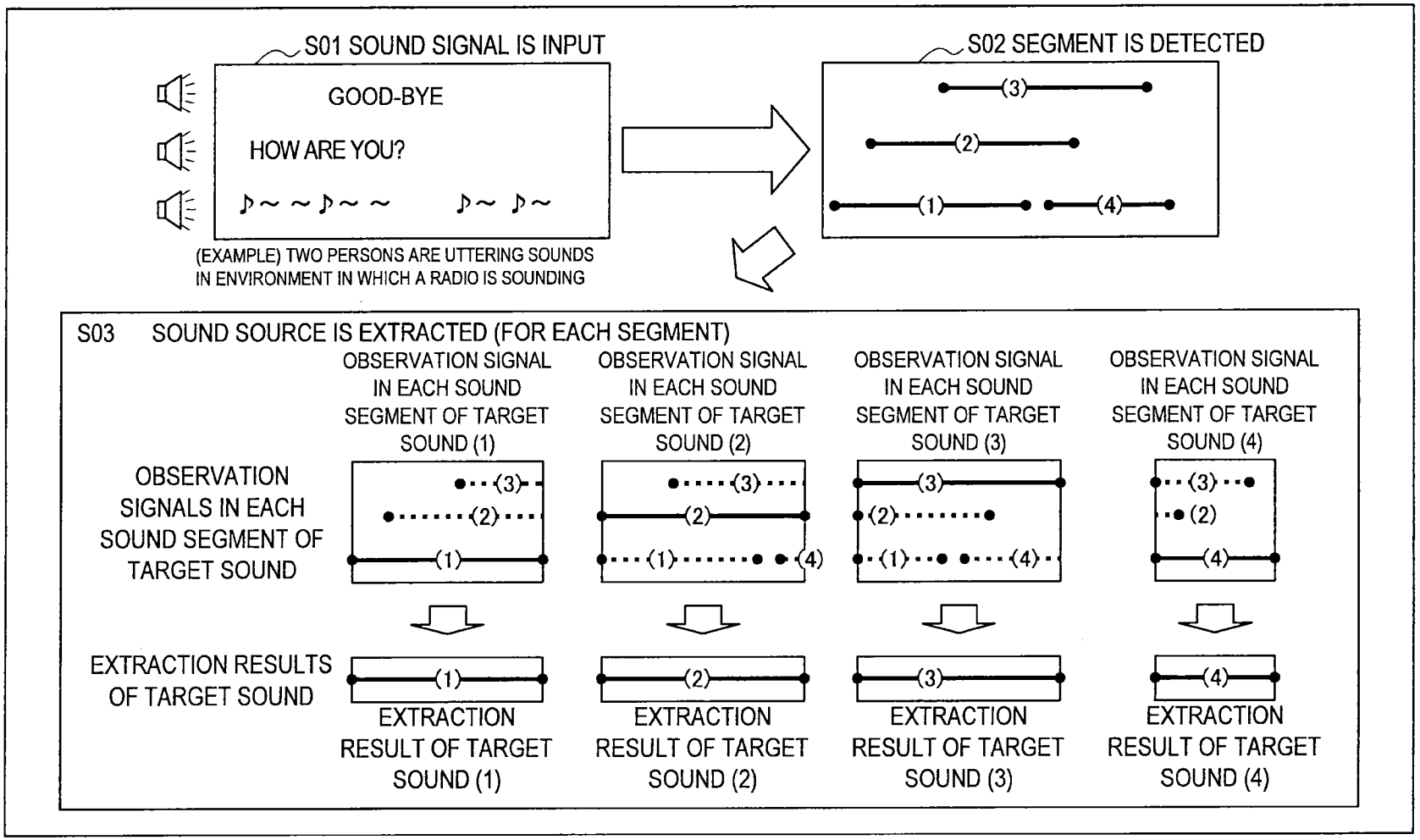
FIG. 5 is an explanatory diagram of processing which is performed by the sound signal processing device.

FIG. 5 individually shows each processing as follows:

Step S01: sound signal input

Step S02: segment detection

Step S03: sound source extraction

Those three processing pieces correspond to those by the sound signal input unit 101, the sound segment detection unit 102, and the sound source extraction unit 103 shown in FIG. 4 respectively.

The sound signal input processing in step S01 corresponds to a situation in which the sound signal input unit 101 shown in FIG. 4 is receiving sound signals from a plurality of sound sources through a plurality of microphones.

An example shown in the figure shows a state where the following:

"SAYOUNARA" (good-bye),

"KONNICHIWA" (how are you?), and music piece from the respective three sound sources are being observed.

Segment detection processing in step S02 is performed by the observation signal analysis unit 102 shown in FIG. 4. The observation signal analysis unit 102 receives the input signal (observation signal) from the sound signal input unit 101, to detect the sound segment of a target sound source to be extracted.

In the example shown in the figure, the segments (sound segments) of:

"SAYOUNARA" (good-bye)'s speech segment=(3),

"KONNICHIWA" (how are you?)'s speech segment=(2), and music piece's speech segment=(1) and (4)

are detected.

Sound source extraction processing in step S03 is performed by the sound source extraction unit 103 shown in FIG. 4. The sound source extraction unit 103 extracts a sound of the target sound source from the observation signal (in which a plurality of sounds are mixed) in each of the sound segment of the target sound detected by the observation signal analysis unit 102.

In the example shown in the figure, the sound sources of the sound segments of:

"SAYOUNARA" (good-bye)'s speech segment=(3),

"KONNICHIWA" (how are you?)'s speech segment=(2), and music piece's speech segment=(1) and (4)

are extracted.

A description will be given of one example of a specific processing sequence of the sound source extraction processing performed by the sound source extraction unit 103 in step S03 with reference to FIG. 6.

Figure 6:
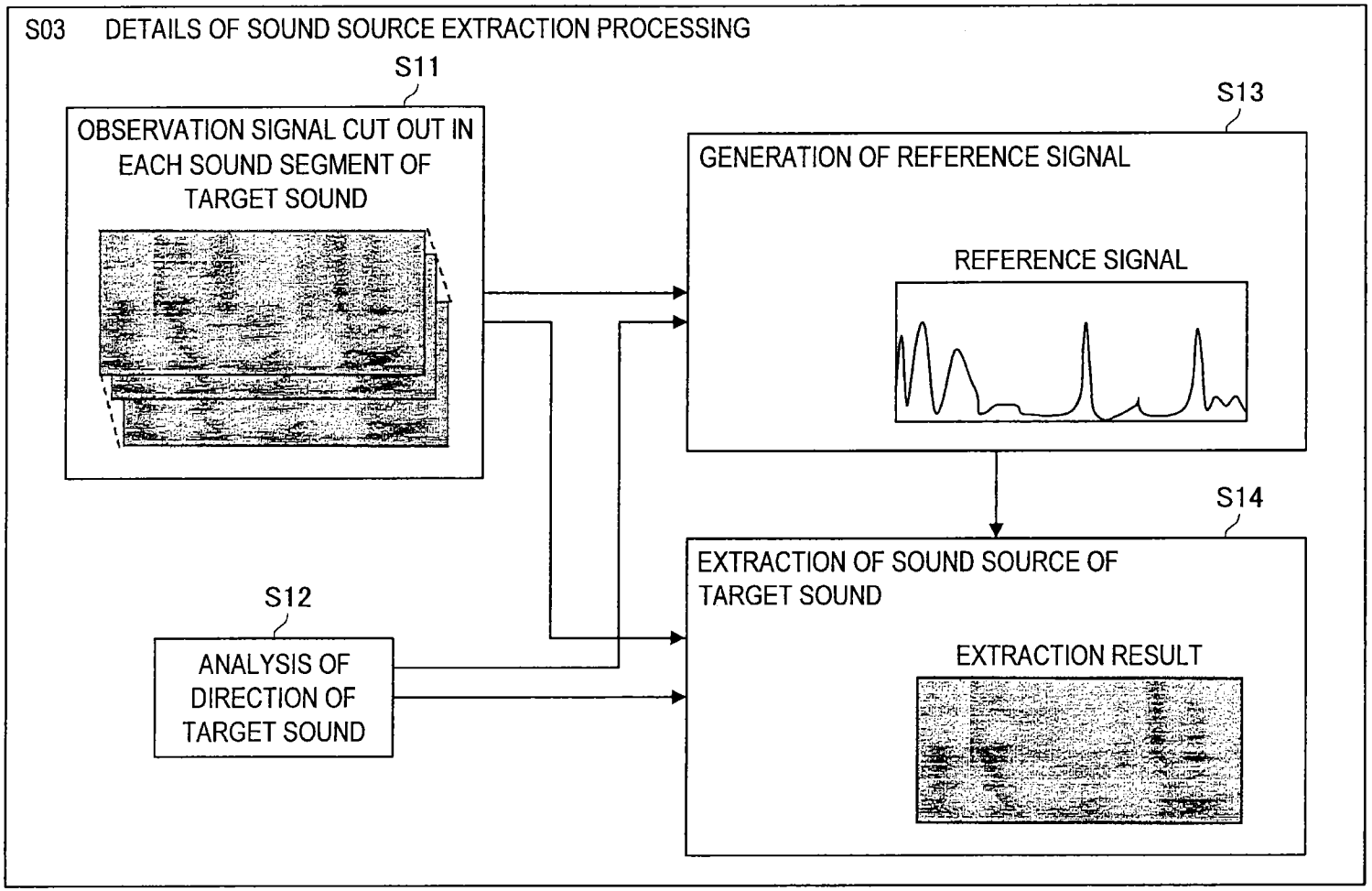
FIG. 6 is an explanatory view of one example of a specific processing sequence of sound source extraction processing which is performed by a sound source extraction unit.

FIG. 6 shows a sequence of the sound source extraction processing which is performed by the sound source extraction unit 103 as four processing pieces of steps S11 to S14.

Step S11 denotes a result of processing of cutting out a sound segment-unitary observation signal of the target sound to be extracted.

Step S12 denotes a result of processing of analyzing a direction of the target sound to be extracted.

Step S13 denotes processing of generating a reference signal (reference) based on the sound segment-unitary observation signal of the target sound acquired in step S11 and the direction information of the target sound acquired in step S12.

Step S14 is processing of obtaining an extraction result of the target sound by using the sound segment-unitary observation signal of the target sound acquired in step S11, the direction information of the target sound acquired in step S12, and the reference signal (reference) generated in step S13.

The sound source extraction unit 103 performs the processing pieces in steps S11 to S14 shown in, for example, FIG. 6 to extract the target sound source, that is, generate a sound signal composed of the target sound from which undesirable interference sounds are removed as much as possible.

Next, a description will be given in detail of the following two of the processing pieces to be performed in the sound signal processing device of the present disclosure sequentially.

(1) sound source extraction processing using a time envelope of target sound as reference signal (reference); and (2) target sound time envelope generation processing using timer frequency masking from target sound's direction.

(1-2. Sound Source Extraction Processing Using Target Sound Time Envelope as Reference Signal (Reference))

First, a description will be given of sound source extraction processing using a target sound's time envelope as a reference signal (reference).

It is assumed that a time envelope of a target sound is known and the time envelope takes on value r(t) in frame t. The time envelope is the outlined shape of a change in sound volume in the time direction. From the nature of the envelope, r(t) is a real number and not less than 0 typically. Generally, any signals originating from the same sound source have similar time envelopes even at the different frequency bins. That is, there is a tendency that at a moment when the sound source is active loudly, all the frequencies have a large component, and at a moment when it is active low, all the frequencies have a small component.

Extraction result Y(ω, t) is calculated using the following equation [3.1] (which is the same as Equation [1.2]) on the assumption that the variance of the extraction result is fixed to 1 (Equation [3.2]).

$$Y(\omega, t) = W(\omega)X(\omega, t) \quad [3.1]$$

$$\langle |Y(\omega, t)^2| \rangle_t = 1 \quad [3.2]$$

$$W(\omega) = \underset{W(\omega)}{\operatorname{argmin}} \left\langle \frac{|Y(\omega, t)|^2}{r(t)^N} \right\rangle_t \quad [3.3]$$

$$W(\omega) = \underset{W(\omega)}{\operatorname{argmin}} W(\omega) \left\langle \frac{X(\omega, t)X(\omega, t)^H}{r(t)^N} \right\rangle_t W(\omega)^H \quad [3.4]$$

$$Z(\omega, t) = \frac{1}{r(t)^{N/2}} Y(\omega, t) \quad [3.5]$$

$$|Y(\omega, t)| = \frac{r(t)^{N/2}}{R} \quad [3.6]$$

$$\langle r(t)^N \rangle_t = R^2 \quad [3.7]$$

$$W(\omega) = \underset{W(\omega)}{\operatorname{argmin}} \langle |Y(\omega, t) - r(t)|^2 \rangle_t \quad [3.8]$$

$$W(\omega) = \underset{W(\omega)}{\operatorname{argmax}} \langle \operatorname{real}(Y(\omega, t)r(t)) \rangle_t \quad [3.9]$$

However, in Equation [3.2], <●>_t denotes calculating an average of the inside of the parentheses in a predetermined range of frame (for example, segment in which the target sound is active).

For the time envelope r(t), its scale may be arbitrary.

The constraints of Equation [3.2] are different from those of the scale of the target sound, so that after an extracting filter is obtained once, processing is performed to control a scale of the extraction result to an appropriate value. This processing is referred to as "rescaling". Details of the rescaling will be described later.

Under the constraints of Equation [3.2], it is desired to get the outlined shape of |Y(ω, t)|, the absolute value of the extraction result, in the time direction close to r(t) as much as possible. Further, different from r(t), |Y(ω, t)| is the signal of a complex number, so that its phase should desirably be obtained appropriately. To obtain an extracting filter to generate such an extraction result, W(ω) which minimizes the right-hand side of Equation [3.3] is obtained. (Through Equation [3.1], Equation [3.3] is equivalent to Equation [3.4].)

In those, N is a positive real number (for example, N=2).

The thus obtained W(ω) provides a filter to extract the target sound. The reason will be described as follows.

Equation [3.3] can be interpreted as a variance of a signal (Equation [3.5]) obtained by multiplying Y(ω, t) by a weight of 1/r(t)^(N/2). This is referred to as weighted variance minimization (or weighted least-square method), by which if Y(ω, t) has no constraints other than Equation [3.2] (if there is no relationship of Equation [3.1]), Equation [3.3] takes on a minimum value of 1/R^2 as long as Y(ω, t) satisfies Equation [3.6] at all values of t. In this case, R^2 is an average of r(t)^N (Equation [3.7]).

Hereinafter:

term of <●>_t in Equation [3.3] is referred to as "weighted variance of extraction result" and term of <●>_t in Equation [3.4] is referred to as "weighted co-variance matrix of observation signal".

That is, if a difference in scale is ignored, the right-hand side of Equation [3.3] is minimized when the outline of the extraction result |Y(ω, t)| agrees with the reference signal r(t).

The following relationships hold true:

observation signal: X(ω, t), target sound extracting filter: W(ω), and extraction result: Y(ω, t).

Those relationships are of Equation [3.1], so that the extraction result does not completely agree with Equation [3.6], thereby minimizing Equation [3.3] in a range in which Equations [3.1] and [3.2] are satisfied. As a result, the phase of the extraction result of Y(ω, t) is obtained appropriately.

As the method for bringing the reference signal and a target signal close to each other, generally the least-square error method can be applied. That is, this method minimizes a square error between the reference signal and the target signal. However, in problem establishment of the present disclosure, time envelope r(t) in frame t is a real number but extraction result Y(ω, t) is a complex number, so that even if a target sound extracting filter of W(ω) is introduced as a problem of minimizing the square error between the two (Equation [3.8] or [3.9] is also equivalent), W(ω) only maximizes the real part of Y(ω, t), failing to obtain the target sound. That is, by the conventional method, even if a sound source is extracted using the reference signal, it is different from that by the present disclosure as long as Equation [3.8] or [3.9] is used.

Next, a description will be given of a procedure for obtaining a target sound extracting filter W(ω) with reference to the following equation [4.1] and the subsequent.

$$X'(\omega, t) = P(\omega)X(\omega, t) \quad [4.1]$$

$$\langle X'(\omega, t)X'(\omega, t)^H \rangle_t = I \quad [4.2]$$

$$R(\omega) = \langle X(\omega, t)X(\omega, t)^H \rangle_t \quad [4.3]$$

$$R(\omega) = V(\omega)D(\omega)V(\omega)^H \quad [4.4]$$

$$V(\omega) = [V_1(\omega), \ldots, V_n(\omega)] \quad [4.5]$$

$$D(\omega) = \begin{bmatrix} d_1(\omega) & & 0 \\ & \ddots & \\ 0 & & d_n(\omega) \end{bmatrix} \quad [4.6]$$

-continued $$P(\omega) = V(\omega)D(\omega)^{-1/2}V(\omega)^H \quad [4.7]$$

$$Y(\omega, t) = W'(\omega)X'(\omega, t) \quad [4.8]$$

$$W'(\omega)W'(\omega)^H = 1 \quad [4.9]$$

$$W'(\omega) = \underset{W(\omega)}{\operatorname{argmin}} W'(\omega)\left\{\frac{X'(\omega, t)X'(\omega, t)^H}{r(t)^N}\right\}_t W'(\omega)^H \quad [4.10]$$

$$\left\{\frac{X'(\omega, t)X'(\omega, t)^H}{r(t)^N}\right\}_t = A(\omega)B(\omega)A(\omega)^H \quad [4.11]$$

$$A(\omega) = [A_1(\omega), \ldots, A_n(\omega)] \quad [4.12]$$

$$A_i(\omega)^H A_k(\omega) = \begin{cases} 0 & (i \neq k) \\ 1 & (i = k) \end{cases} \quad [4.13]$$

$$B(\omega) = \begin{bmatrix} b_1(\omega) & & 0 \\ & \ddots & \\ 0 & & b_n(\omega) \end{bmatrix} \quad [4.14]$$

$$W'(\omega) = A_l(\omega)^H \quad [4.14]$$

The target sound extracting filter W(ω) can be calculated with a closed form (equation with no iterations) in accordance with the following procedure.

First, as denoted by Equation [4.1], de-correlation is performed on the observation signal X(ω, t).

Let P(ω) be the de-correlating matrix, and X' (ω, t) be an observation signal to which de-correlation is applied (Equation [4.1]). X' (ω, t) satisfies Equation [4.2].

To obtain the de-correlating matrix P(ω), the covariance matrix R(ω) of the observation signal is calculated once (Equation [4.3]), and then eigenvalue decomposition is applied to R(ω) (Equation [4.4]).

In Equation [4.4],

V(ω) is a matrix (Equation [4.5]) including eigenvectors V_1(ω) through V_n(ω), and D(ω) is a diagonal matrix including elements of eigenvalues d_1(ω) through d_n(ω) (Equation [4.6]).

The de-correlating matrix P(ω) is calculated as given in Equation [4.7] by using those V(ω) and D(ω). V(ω) is an orthonormal matrix and satisfies V(ω)ˆH V(ω)=1. (The elements of V(ω) are each a complex number, so that it is a unitary matrix strictly.)

After performing de-correlation given in Equation [4.1], a matrix W' (ω) that satisfies Equation [4.8] is obtained. The left-hand side of Equation [4.8] is the same extraction result as the left-hand side of Equation [3.1]. That is, instead of directly obtaining the filter W(ω) which extracts the target sound from the observation signal, the filter W' (ω) is obtained which extracts the target sound from the de-correlated observation signal X' (ω, t).

To do so, a vector W' (ω) that minimizes the right-hand side of Equation [4.10] can be obtained under the constraints of Equation [4.9]. The constraints of Equation [4.9] can be derived from Equations [3.2], [4.2], and [4.8]. Further, Equation [4.10] can be obtained from Equations [3.4] and [4.8].

W' (ω) that minimizes the right-hand side of Equation [4.10] can be obtained by performing eigenvalue decomposition on the term (part of <●>_t) of the weighted co-variance matrix in this equation again. That is, by decomposing the weighted co-variance matrix into such products as given in Equation [4.11] and providing a matrix including eigenvectors A_1(ω) through A_n(ω) as A(ω) (Equation [4.12]) and a diagonal matrix including eigenvalues b_1(ω) through b_n (ω) as B(ω) (Equation [4.14]), the W' (ω)) is obtained by performing Hermitian transpose on one of the eigenvectors (Equation [4.14]). A method for selecting the appropriate one from among the eigenvectors A_1(ω) through A_n(ω).

The eigenvectors A_1(ω) through A_n(ω) are mutually orthogonal and satisfy Equation [4.13]. Therefore, W' (ω) obtained with Equation [4.14] satisfies the constraints of Equation [4.9].

W' (ω), if obtained, is combined with the de-correlating matrix P(ω) to obtain an extracting filter as well. (The specific equation will be described later.)

Next, a method for selecting an appropriate one as an extracting filter from among the eigenvectors A_1(ω) through A_n(ω) given in Equation [4.12] will be described with reference to the following Equation [5.1] and the subsequent.

$$l = \underset{k}{\operatorname{argmin}}[b_k(\omega)] \quad [5.1]$$

$$F_k(\omega) = P^{-1}(\omega)A_k(\omega) \quad [5.2]$$

$$F_k(\omega) = \begin{bmatrix} f_{1k}(\omega) \\ \vdots \\ f_{nk}(\omega) \end{bmatrix} \quad [5.3]$$

$$F'_k(\omega) = \begin{bmatrix} f_{1k}(\omega)/|f_{1k}(\omega)| \\ \vdots \\ f_{nk}(\omega)/|f_{nk}(\omega)| \end{bmatrix} \quad [5.4]$$

$$l = \underset{k}{\operatorname{argmax}}[|F'_k(\omega)^H S(\omega, \theta)|] \quad [5.5]$$

$$F_k(\omega) = R(\omega)A_k(\omega) \quad [5.6]$$

The following two methods may be possible to select an appropriate one as the extracting filter from among the eigenvectors A_1(ω) through A_n(ω):

selection method 1: selecting eigenvector corresponding to the minimum eigenvalue selection method 2: selecting eigenvector corresponding to the sound source direction θ

The following will describe the selection methods respectively.

(Selection Method 1: Selecting Eigenvector Corresponding to the Minimum Eigenvalue)

A_i(ω)ˆH is employed as W' (ω) in accordance with Equation [4.14] and substituted in the right-hand side of Equation [4.10], to leave only b_1(ω), which is an eigenvalue corresponding to A_1(ω), in a part following "arg min" in the right-hand side, where "1" is a small letter of "L".

In other words, letting b_1(ω) be the minimum in n eigenvalues, W' (ω) that minimizes the right-hand sides of Equations [5.1] and [4.10] is A_1(ω)ˆH, whose minimum value is b_1(ω).

(Selection Method 2: Selecting Eigenvector Corresponding to the Sound Source Direction θ)

Although in the description of the null beamformer, it has been explained that the separation matrix could be calculated from a steering vector corresponding to the sound source direction, conversely, a vector comparable to a steering vector can also be calculated from the separation matrix or the extracting filter.

Therefore, it is possible to select an optimal eigenvector as an extracting filter of the target sound by converting each of the eigenvectors into vectors comparable to the steering vector and comparing similarities between those vectors and the starring vector corresponding to the direction of the target sound.

The eigenvector A_k(ω) is multiplied by the inverse vector of the de-correlating matrix P(ω) given in Equation [4.7] from the left to provide F_k(ω) (Equation [5.2]). Then, the elements of F_k(ω) are given by Equation [5.3]. This equation corresponds to inverse operations of N(ω)^# in Equation [2.5] described with the dead angel beamformer, and F_k(ω) is a vector corresponding to the steering vector.

Accordingly, the similarity of the respective vectors F_1(ω) through F_n(ω) comparable to the steering vectors corresponding to the eigenvectors A_1(ω) through A_n(ω) may well be obtained with the steering vector S(ω, θ) corresponding to the target sound so that selection can be performed on the basis of those similarities. For example, if F1(ω) has the highest similarity, A_1(ω)^H is employed as W' (ω), where "1" is the small letter "L".

Therefore, A vector F'_k(ω) calculated by dividing the elements of F_k(ω) by the absolute values of themselves respectively is prepared (Equation [5.5]), to calculate the similarity by using an inner product of F'_k(ω) and S(ω, θ) (Equation[5.5]). Then, an extracting filter may well be selected from F'_k(ω) that maximizes the absolute value of the inner product. F'_k(ω) is used in place of F_k(ω) in order to exclude the influences of fluctuations in sensitivity of the microphones.

The same value can be obtained even if Equation [5.5] is used in place of Equation [5.2]. (R(ω) is a covariance matrix of the observation signal and calculated using Equation [4.3].)

An advantage of this method is small side effects of the sound source extraction as compared to selection method 1. For example, in a case where the reference signal shifts significantly from a time envelope of the target sound owing to an error in generation of the reference signal, an eigenvector selected by selection method 1 may possibly be an undesired one (for example, filter which emphasizes the interference sound).

By selection method 2, the direction of the target sound is reflected in selection, so that there is a high possibility that an extracting filter may be selected which would emphasize the target sound even in the worst case.

(1-3. Method for Generating Time Envelope of Target Sound by Using Time-frequency Masking from Direction of Target Sound)

Next, a description will be given of time-frequency masking and time envelope generation as one method for generating a reference signal from the direction of a target sound. Sound source extraction by means of time-frequency masking has a problem in that musical noise occurs and separation accuracy at low frequencies is insufficient (in the case of mask generation based on phase differences); however, this problem can be avoided by restricting the utilization purposes to the generation of time envelopes.

Although the conventional methods have been described with the case where the number of the microphones have been limited to two, the following will describe an example where a method is used which depends on the similarity between a steering vector and an observation signal vector on the assumption that the number of channels is at least two.

The following two methods will be described in this order:

(1) Method for generation steering vectors (2) Method for generating a mask and a reference signal (1) Method for Generation Steering Vectors The steering vector generation method will be described with reference to FIG. 7 and the following Equations [6.1] through [6.3].

$$q(\theta) = \begin{bmatrix} \cos\theta \\ \sin\theta \\ 0 \end{bmatrix} \quad [6.1]$$

$$S_k(\omega, \theta) = \exp\left(j\pi \frac{(\omega - 1)F}{(M-1)C} q(\theta)^T (m_k - m)\right) \quad [6.2]$$

$$S(\omega, \theta) = \frac{1}{\sqrt{n}} \begin{bmatrix} S_1(\omega, \theta) \\ \vdots \\ S_n(\omega, \theta) \end{bmatrix} \quad [6.3]$$

$$U(\omega, t) = \frac{1}{X_i(\omega, t)} X(\omega, t) \quad [6.4]$$

$$U(\omega, t) = \begin{bmatrix} U_1(\omega, t) \\ \vdots \\ U_n(\omega, t) \end{bmatrix} \quad [6.5]$$

$$U'(\omega, t) = \frac{1}{\sqrt{n}} \begin{bmatrix} U_1(\omega, t)/|U_1(\omega, t)| \\ \vdots \\ U_n(\omega, t)/|U_n(\omega, t)| \end{bmatrix} \quad [6.6]$$

$$M(\omega, t) = |S(\omega, \theta)^H U'(\omega, t)| \quad [6.7]$$

$$Q(\omega, t) = M(\omega, t)^J X_k(\omega, t) \quad [6.8]$$

$$Q(\omega, t) = M(\omega, t)^J S(\omega, \theta)^H X(\omega, t) \quad [6.9]$$

$$Q'(\omega, t) = \frac{Q(\omega, t)}{\{\langle |Q(\omega, t)|^2 \rangle_t\}^{1/2}} \quad [6.10]$$

$$r(t) = \{\langle |Q'(\omega, t)|^L \rangle_{\omega \in \Omega}\}^{1/L} \quad [6.11]$$

$$\Omega = \{\omega_{min}, \omega_{min} + 1, \ldots, \omega_{max}\} \quad [6.12]$$

$$r(t) = \{\langle M(\omega, t)^L \rangle_{\omega \in \Omega}\}^{1/L} \quad [6.13]$$

$$q(\theta, \psi) = \begin{bmatrix} \cos\psi \cdot \cos\theta \\ \cos\psi \cdot \sin\theta \\ \sin\psi \end{bmatrix} \quad [6.14]$$

Figure 7:
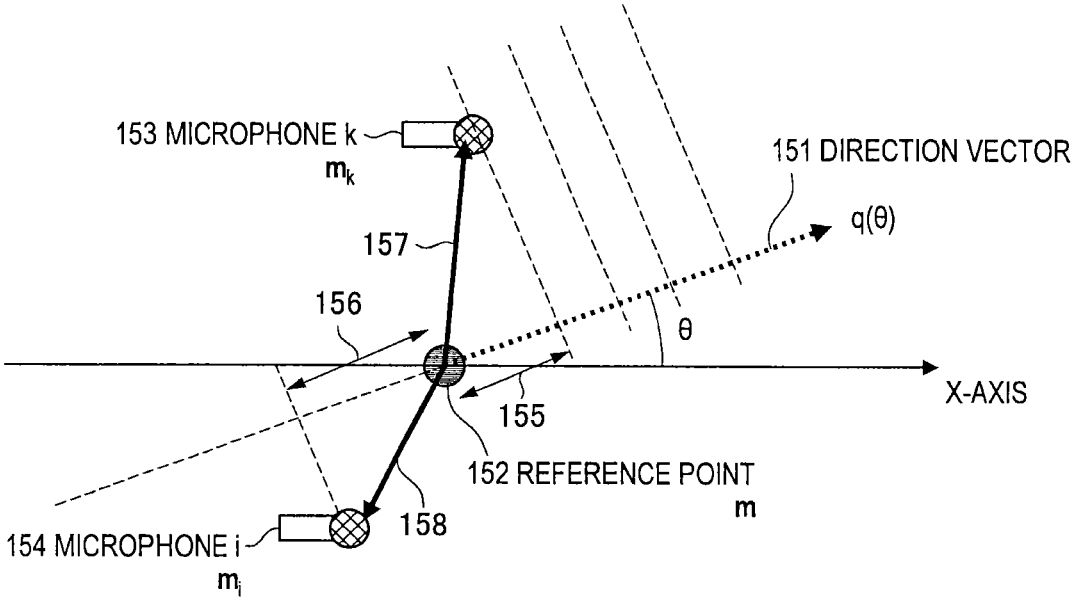
FIG. 7 is an explanatory graph of a method for generating a steering vector.

A reference point 152 shown in FIG. 7 is assumed to be a reference point to measure a direction. The reference point 152 may be an arbitrary spot near the microphone, for example, agree with the gravity center of the microphones or with any one of the microphones. The position vector (that is, coordinates) of the reference point is assumed to be m.

To denote the arrival direction of a sound, a vector having the reference point 152 as its origin point and 1 as its length is prepared and assumed to be a vector q(θ) 151. If the sound source is positioned roughly at the same height as the microphone, the vector q(θ) 151 may be considered to be a vector in the X-Y plane (having the Z-axis as its vertical direction), whose components can be given by Equation [6.1]. However, the direction θ is an angle with respect to the X-axis.

If the microphones and the sound source are not positioned in the same plane, q(θ, ϕ) that an elevation ϕ is also reflected in a sound source direction vector can be calculated using Equation [6.14] and used in place of q(ϕ) in Equation [6.2].

In FIG. 7, a sound arriving in the direction of the vector q(θ) arrives at the microphone k153 first and then at the reference point 152 and the microphone i154 in this order. The phase difference of the microphone k153 arriving at the reference point 152 can be given using Equation [6.2].

In this equation, j: imaginary unit,

M: number of frequency bins,

F: sampling frequency,

C: sound velocity, m_k: position vector of microphone k, and superscript "T" denotes ordinary transpose.

That is, if a plane wave is assumed to be present, the microphone k153 is closer to the sound source than the reference point 152 by a distance 155 shown in FIG. 7 and, conversely, the microphone i154 is more distant from it by the distance 156. This difference in distance can be expressed by using an inner product of the vectors as follows:

q(θ)^T (m_k−m) and q(θ)^T (m_i−m), to convert the distance difference into a phase difference, thereby obtaining Equation [6.2]

The vector composed of the phase differences of the respective microphones is given by Equation [6.3] and referred to as a steering vector. It is divided by the square root of the number of the microphones n in order to normalize the norm of the vectors to 1.

In the following description, the reference point m is the same as the position m_i of the microphone i.

Next, a description will be given of the mask generation method.

Figure 3:
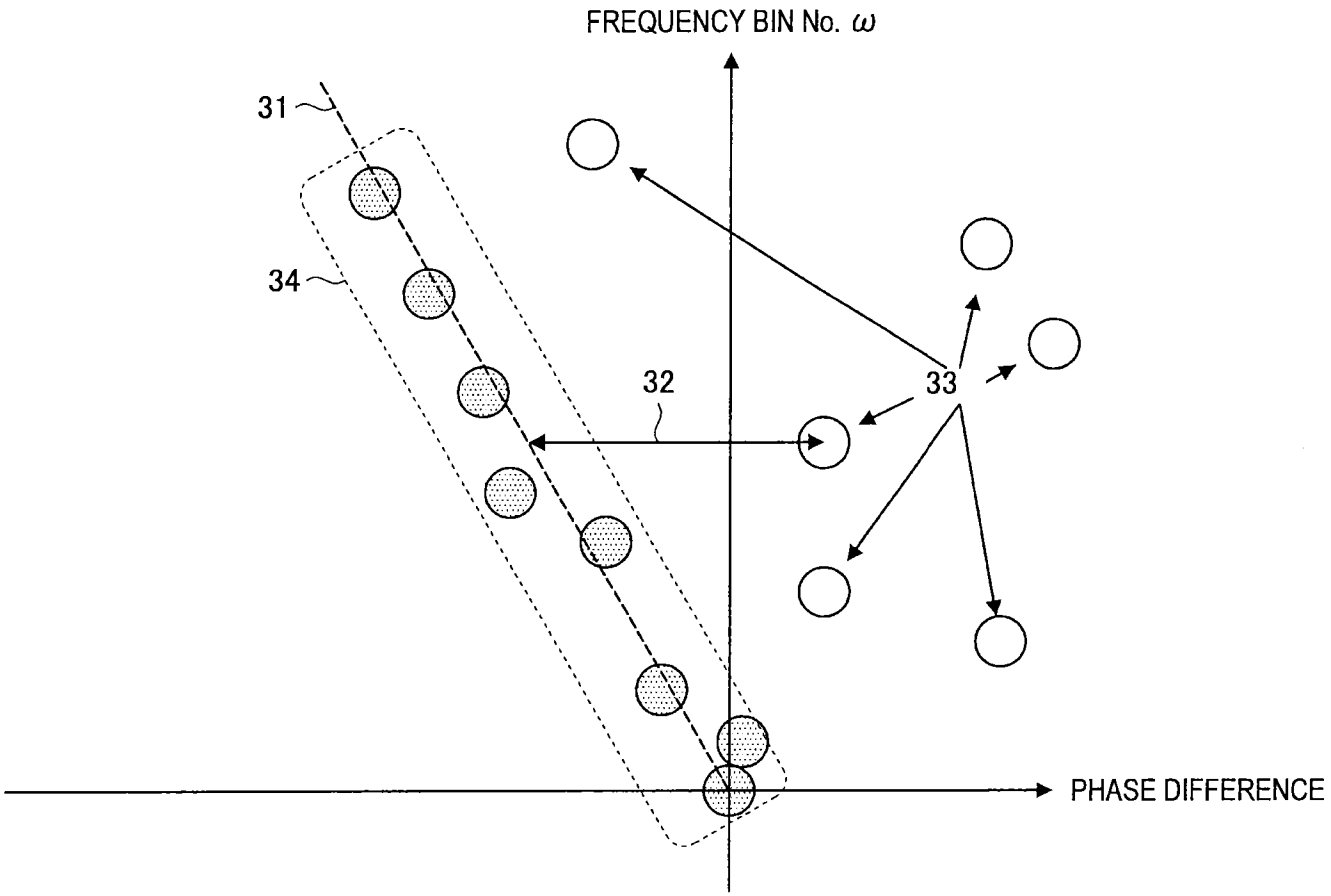
FIG. 3 is a view showing a relational graph between a phase difference of sounds input to the plurality of microphones similar to those in FIG. 2 and frequency bin numbers ω in an environment including an interference sound.

A steering vector S(ω, t) given by Equation [6.3] can be considered to express an ideal phase difference in a case where only the target sound is active. That is, it corresponds to a straight line 31 shown in FIG. 3. Accordingly, phase difference vectors (corresponding to phase difference dots 33 and 34) are calculated also from the observation signal, to calculate their similarities with respect to the steering vector. The similarity corresponds to a distance 32 shown in FIG. 3. Based on the similarity, the degree of mixing of the interference sounds can be calculated, so that based on the values of the similarity, a time-frequency mask can be generated. That is, the higher the similarity, the smaller the degree of mixing of the interference sounds becomes, so that the mask values are increased.

The mask values are calculated using specific Equations [6.4] through [6.7]. U(ω, t) in Equation [6.4] is a difference in phase of the observation signal between the microphone i, which is the reference point, and the other microphones, whose elements are assumed to be U_1(ω, t) through U_n(ω, t) (Equation [6.5]). To exclude influences of the irregularities in sensitivity of the microphones, the elements of U(ω, t) are divided by their respective absolute values to provide U' (ω, t). Equation [6.6] is divided by the square root of the number of the microphones n in order to normalize the norm of the vectors to 1.

As the similarity between the steering vector S(ω, t) and the vector U' (ω, t) of the phase difference of the observation signal, an inner product S(ω, t)^H●U' (ω, t) is calculated. Both of the vectors have size 1 and the absolute value of their inner product is normalized to 0 through 1, so that the value can be directly used as the ask value (Equation [6.7]).

Next, a description will be given of the method for generating a time envelope, which is a reference signal, from the mask values with reference to FIG. 8.

The basic processing is the following processing sequence.

Figure 8:
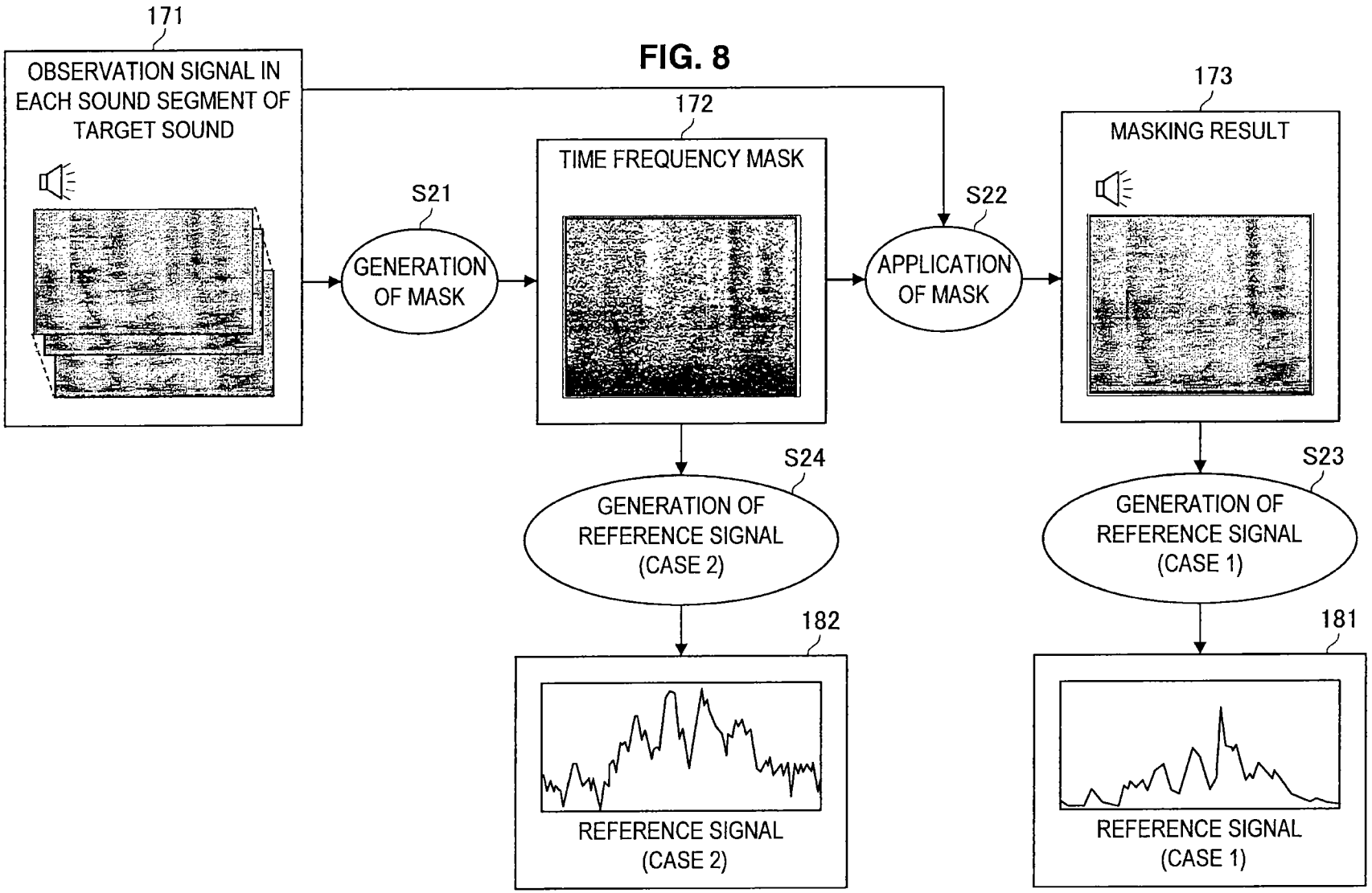
FIG. 8 is an explanatory view of a method for generating a time envelope, which is a reference signal, from a value of a mask.

Based on an observation signal 171 shown in FIG. 8, that is, the observation signal 171 in sound segment units of the target sound, mask generation processing in step S21 is performed to generate a time-frequency mask 172.

Next, in step S22, by applying the generated time-frequency mask 172 to the observation signal 171, a masking result 173 is generated as a result of applying the time-frequency mask.

Further, in step S23, a time envelope is calculated for each frequency bin to average the time envelopes between a plurality of the frequency bins where extraction is performed comparatively well, thereby obtaining a time envelop close to the target sound's time envelope as a reference signal (reference) (case 1) 181.

The time-frequency masking result Q(ω, t) can be obtained with Equation [6.8] or Equation [6.9]. Equation [6.8] applies masks to the observation signal of the microphone k, while Equation [6.9] applies them to results of a delay-and-sum array.

The delay-and-sum array is data obtained by providing the observation signals of the microphones with different time delays, aligning phases of the signals coming in the direction of the target sound, and summing the observation signals. In the results of the delay-and-sum array, the target sound is emphasized because of the aligned phase and the sounds coming in the other directions are attenuated because they are different in phase.

"J" given in Equations [6.8] and [6.9] is a positive real number to control the mask effects and has larger effects the larger its value is. In other words, this mask has a large effect as the sound source is more distant from the direction ϕ, and the degree of attenuation can be made larger the larger the value of J is.

Prior to averaging Q(ω, t) between the frequency bins, magnitudes are normalized in the time direction to provide the result Q'(ω, t) (Equation [6.10]). By the normalization, it is possible to suppress the excessive influences of the time envelopes of the low frequency bins.

Generally, the lower its frequency components are, the larger power the sound has, so that if the time envelopes are simply averaged between the frequency bins, the time envelope at the low frequency becomes dominant. However, by the time-frequency masking based on phase differences, the lower the frequency is, the more dominant the time envelops becomes, so that the time envelope obtained by simple averaging may highly possibly be different from that of the target sound.

The reference signal r(t) is obtained by averaging the time envelopes of the frequency bins (Equation [6.11]). Equation [6.11] means averaging the L-th powers of the time envelopes, that is, raising the elements to the L-th powers of the time envelope for the frequency bins belonging to a set Ω and, finally, calculating its root of L-th power, in which L is a positive real number. The set Ω is a subset of all of the frequency bins and given by, for example, Equation [6.12]. ω_min and ω_max in this equation respectively denote an upper limit and a lower limit of the frequency bins where extraction by use of time-frequency masking is liable to be successful. (For example, a fixed value obtained experimentally is used.)

The thus calculated r(t) is used as the reference signal.

As for the reference signal r(t), an easier generation method may be available.

This processing is used to generate a reference signal (case 2) 182 shown in FIG. 8.

By this processing, processing to directly average the time-frequency mask 172 refined on the basis of the observation signal in step S21=time-frequency mask M(ω, t) between the frequency bins is performed as reference signal generation processing in step S24 to generate the reference signal (reference) 182 (case 2).

This processing is given by Equation [6.13]. In this equation, L and Ω are the same as Equation [6.11]. If Equation [6.13] is used, it is unnecessary to generate Q(ω, t) or Q' (ω, t), so that the calculation amount (computational cost) and the memory to be used can be reduced as compared to Equation [6.11].

The following will describe that Equation [6.13] has almost the same properties as Equation [6.11] as the generated reference signal (reference).

In calculation of a weighted co-variance matrix in Equations [3.4] and [4.10] (term of <●>_t), at first sight, it seems that the smaller the reference signal r(t) is or the larger the observation signal X(ω, t) is at frame number t, the larger influence the value of the frame has on the weighted co-variance matrix.

However, X(ω, t) is used also in calculation of r(t) (Equation [6.8] or [6.9]), so that if X(ω, t) is large, r(t) also increases, so that a small influence is imposed on the covariance matrix. Therefore, a frame where r(t) has a small value is influenced greatly and depends on the mask value M(ω, t) in accordance with the relationship by Equation [6.8] or [6.9].

Further, the mask value M(ω, t) is limited between 0 and 1 by Equation [6.7] and, therefore, has the same tendency as a normalized signal (for example, Q' (ω, t)). That is, even if M(ω, t) is simply averaged between the frequency bins, the components of the low frequency bins do not become dominant.

After all, no matter from which one of Q' (ω, t) and M (ω, t) the reference signal r(t) is calculated, almost the same outlined shape is obtained. Although those two have the different reference signal scales, the extracting filter calculated with Equation [3.4] or Equation [4.10] is not influenced by the reference signal scales, so that no matter which one of Q' (ω, t) and M (ω, t) is used, the same extracting filter and the same extraction results are obtained.

Various other methods of generating reference signals can be used. Those methods will be described in detail later as modifications.

[2. Detailed Configuration and Specific Processing of Sound Signal Processing Device of the Present Disclosure]

The above [Item 1] has described the outline of an overall configuration and processing of the sound signal processing device of the present disclosure and the details of the following two pieces of processing.

(1) Sound source extraction processing using target sound's time envelope as reference signal (reference)

(2) Target sound's time envelope generation processing using time-frequency masking in target sound direction Next, a description will be given of an embodiment of a detailed configuration and specific processing of the sound signal processing device of the present disclosure.

(2-1. Configuration of Sound Signal Processing Device)

Figure 9:
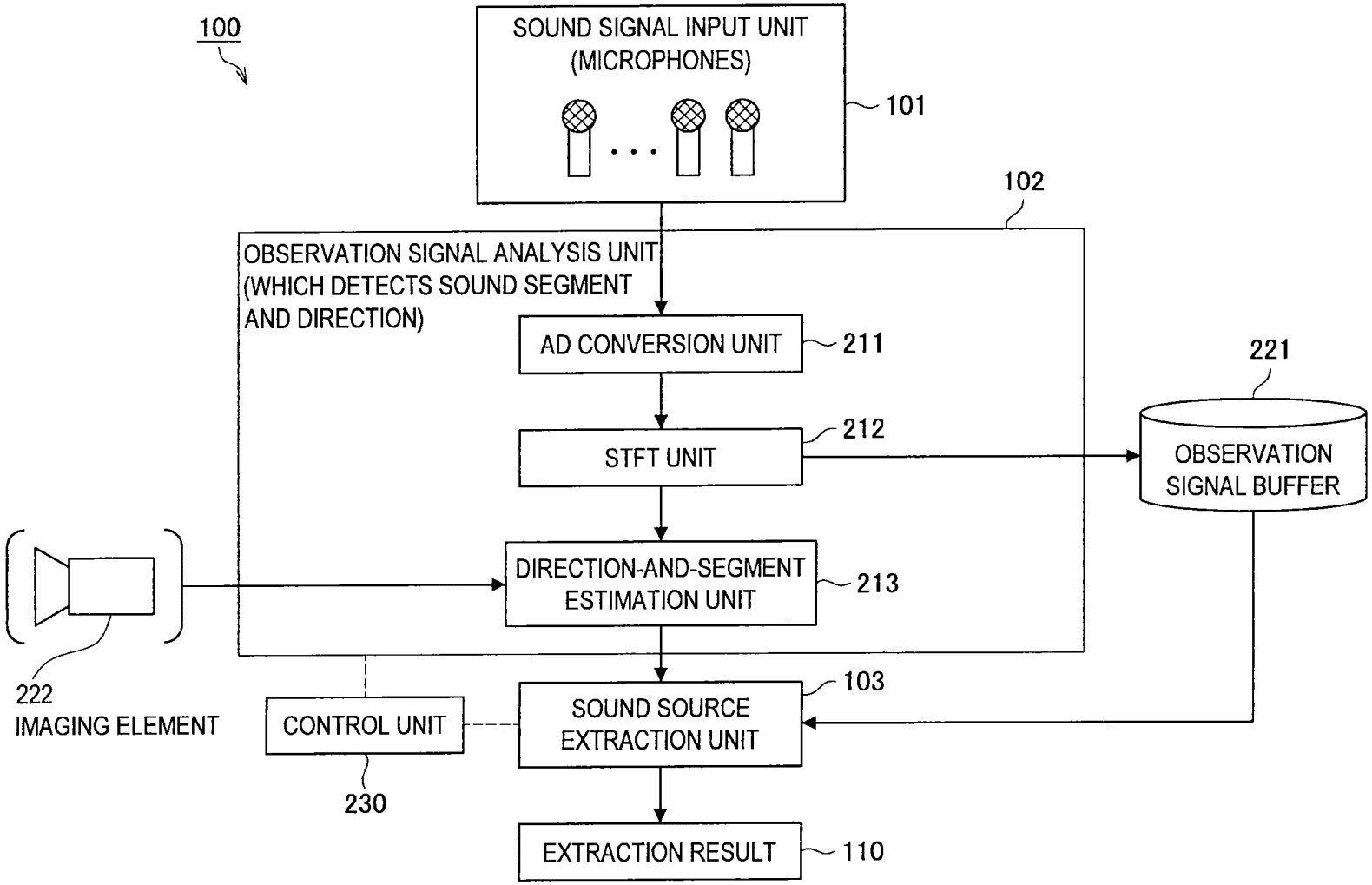
FIG. 9 is a diagram showing one configuration example of the sound signal processing device.

A configuration example of the sound signal processing device is shown in FIG. 9.

FIG. 9 shows the configuration more in detail than that described with reference to FIG. 4.

As described above with reference to FIG. 4, the sound signal processing device 100 has the sound signal input unit 101 composed of the plurality of microphones, the observation signal analysis unit 102 for receiving an input signal (observation signal) from the sound signal input unit 101 and performing analysis processing on the input signal, specifically, for example, detecting a sound segment and a direction of a target sound source to be extracted, and the sound source extraction unit 103 for detecting a sound of the target sound source from the observation signal (signal in which a plurality of sounds are mixed) in inter-sound segment units of a target sound detected by the observation signal analysis unit 102. The result 110 of extracting the target sound generated by the sound source extraction unit 103 is output to, for example, the latter-stage processing unit for performing processing such as speech recognition, for example.

As shown in FIG. 9, the observation signal analysis unit 102 has an AD conversion unit 211 which performs AD conversion on multi-channel sound data collected with a microphone array, which is the sound signal input unit 101. The thus generated digital signal data is referred to as an observation signal (in the time domain).

The observation signal, which is digital data, generated by the AD conversion unit 211 undergoes short-time Fourier transform (STFT) at an STFT unit 212, where it is converted into a signal in the time frequency domain. This signal is referred to as an observation signal in the time frequency domain.

A description will be given in detail of STFT processing which is performed in the STFT unit 212 with reference to FIG. 10.

Figure 10:
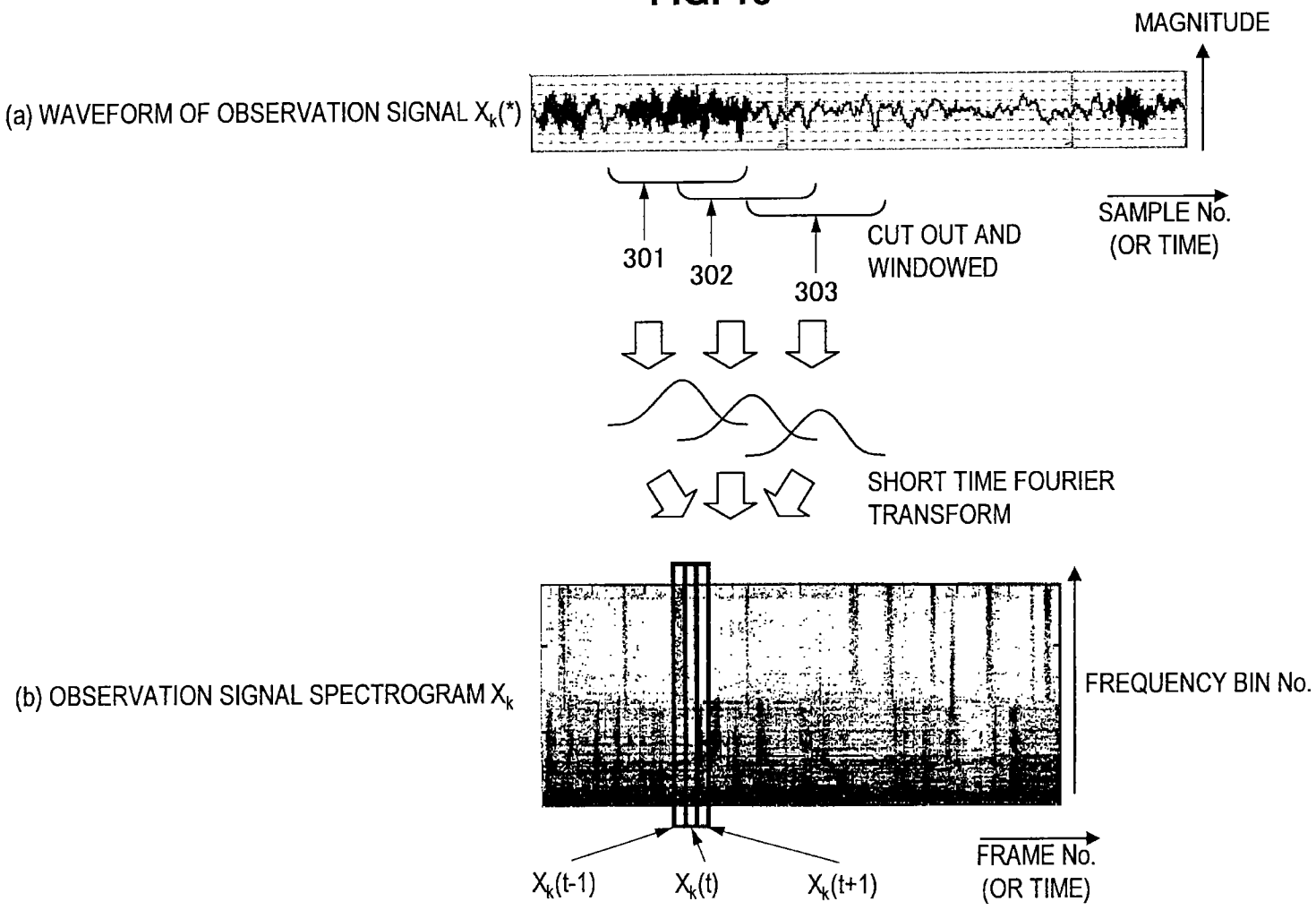
FIG. 10A is an explanatory view of details of short-time Fourier transform (STFT) processing.
FIG. 10B is another explanatory view of the details of the short-time Fourier transform (STFT) processing.

A waveform x_k(*) of (a) observation signal shown in FIG. 10 is observed, for example, with the k-th microphone in the microphone array including n number of microphones of a speech input unit in the device shown in FIG. 9.

Frames 301 to 303, which are constant-length data taken out of the observation signal, are permitted to undergo a banning window or hamming window function. The unit in which data is taken out is referred to as a frame. By performing short-time Fourier transform on one frame of data, a spectrum X_k(t), which is data in the frequency range, is obtained, in which t is a frame number.

The taken-out frames may overlap with each other as the frames 301 to 303 shown in the figure so that spectra X_k(t−1) through X_k(t+1) of the successive frames can be changed smoothly. Further, a series of spectra arranged in the order of the frame numbers is referred to as a spectrogram. Data shown in FIG. 10(*b*) is an example of the spectrogram and provides an observation signal in the time frequency domain.

Spectrum X_k(t) is a vector having M number of elements, in which the ω-th element is denoted as X_k(ω, t).

The observation signal in the time frequency range generated through STFT at the STFT unit 212 is sent to an observation signal buffer 221 and a direction-and-segment estimation unit 213.

The observation signal buffer 221 accumulates the observation signals in a predetermined lapse of time (number of frames). The signals accumulated here are used in the sound source extraction unit 103 to, for example, obtain a result of extracting speeches arriving in a predetermined direction. For this purpose, the observation signals are stored in condition where they are correlated with times (or frame numbers etc.) so that any one of the observation signals can be picked up which corresponds to a predetermined time (or frame number) later.

The direction-and-segment estimation unit 213 detects a starting time of a sound source (at which it starts to be active) and its ending time (at which it ends being active) as well as its arrival direction. As introduced in the "Description of conventional technologies", to estimate the starting time and ending time as well as the direction, a method using a microphone array and a method using an image are available, any one of which can be used in the present disclosure.

In a configuration employing a microphone array, the staring time/ending time and the direction are obtained by obtaining an output of the STFT unit 212, estimating a sound source direction with the MUSIC Method etc. in the direction-and-segment estimation unit 213, and tracking a sound source direction. For the detailed method, see Japanese Patent Application Laid-Open No. 2010-121975, for example. In the case of obtaining the segment and the direction by using a microphone array, an imaging element 222 is unnecessary.

By the method using images, the imaging element 222 is used to capture an image of the face of a user who is uttering a sound, thereby detecting times at which the lips in the image started moving and stopped moving respectively. Then, a value obtained by converting a position of the lips into a direction as viewed from the microphone is used as a sound source direction, while the times at which the lips started and stopped moving are used as a starting time and an ending time respectively. For the detailed method, see Japanese Patent Application Laid-Open No. 10-51889 etc.

Even if a plurality of speakers are uttering sounds simultaneously, as long as the faces of all the speakers are captured by the imaging elements, the starting time and the ending time can be detected for each couple of the lips in the image to obtain a segment and a direction for each uttering.

The sound source extraction unit 103 uses the observation signal and the sound source direction corresponding to an uttering segment to extract a predetermined sound source. The details will be described later.

A result of the sound source detection is sent as the extraction result 110 to, for example, a latter-stage processing unit for operating, for example, a speech recognition device as necessary. Some of the speech recognition devices have a sound segment detection function, which function can be omitted. Further, the speech recognition device often has an STFT function to detect a speech feature, which function can be omitted on the side of the speech recognition side in the case of combining it with the present disclosure.

Those modules are controlled by a control unit 230.

Next, a description will be given in detail of the sound source extraction unit 103 with reference to FIG. 11.

Segment information 401 is an output of the direction-and-segment estimation unit 213 shown in FIG. 9 and composed of a segment (starting time and ending time) in which a sound source is active and its direction.

An observation signal buffer 402 is the same as the observation signal buffer 221 shown in FIG. 9.

A steering vector generation unit 403 generates a steering vector 404 from a sound source direction contained in the segment information 401 by using Equations [6.1] to [6.3].

A time-frequency mask generation unit 405 obtains an observation signal in the relevant segment from the observation signal buffer 402 by using a starting time and an ending time contained in the segment information 401 and generates a time-frequency mask 406 from this signal and the steering vector 404 by using Equations [6.4] to [6.7].

A masking unit 407 generates a masking result by applying the time-frequency mask 406 to the observation signal 405 or a later-described filtering result 414. The masking result is comparable to the masking result 173 described above with reference to FIG. 8.

A reference signal generation unit 409 calculates an average of time envelops from the masking result 408 to provide a reference signal 410. This reference signal corresponds to the reference signal 181 described with reference to FIG. 8.

Alternatively, the reference signal generation unit 409 generates the reference signal from the time-frequency mask 406. This reference signal corresponds to the reference signal 182 described with reference to FIG. 8.

An extracting filter generation unit 411 generates an extracting filter 412 from the reference signal 410, the observation signal in the relevant segment, and the steering vector 404 by using Equations [3.1] to [3.9] and [4.1] to [4.15]. The steering vector is used to select an optimal one from among the eigenvectors (see Equations [5.2] to [5.5]).

A filtering unit 413 generates a filtering result 414 by applying the extracting filter 412 to the observation signal 405 in the relevant segment.

As an extraction result 415 output from the sound source extraction unit 103, the filtering result 414 may be used as it is, or a time-frequency mask may be applied to the filtering result. In the latter case, the filtering result 414 is sent to the masking unit 407, where the time-frequency mask 407 is applied. Its masking result 408 is used as the extraction result 415.

Figure 12:
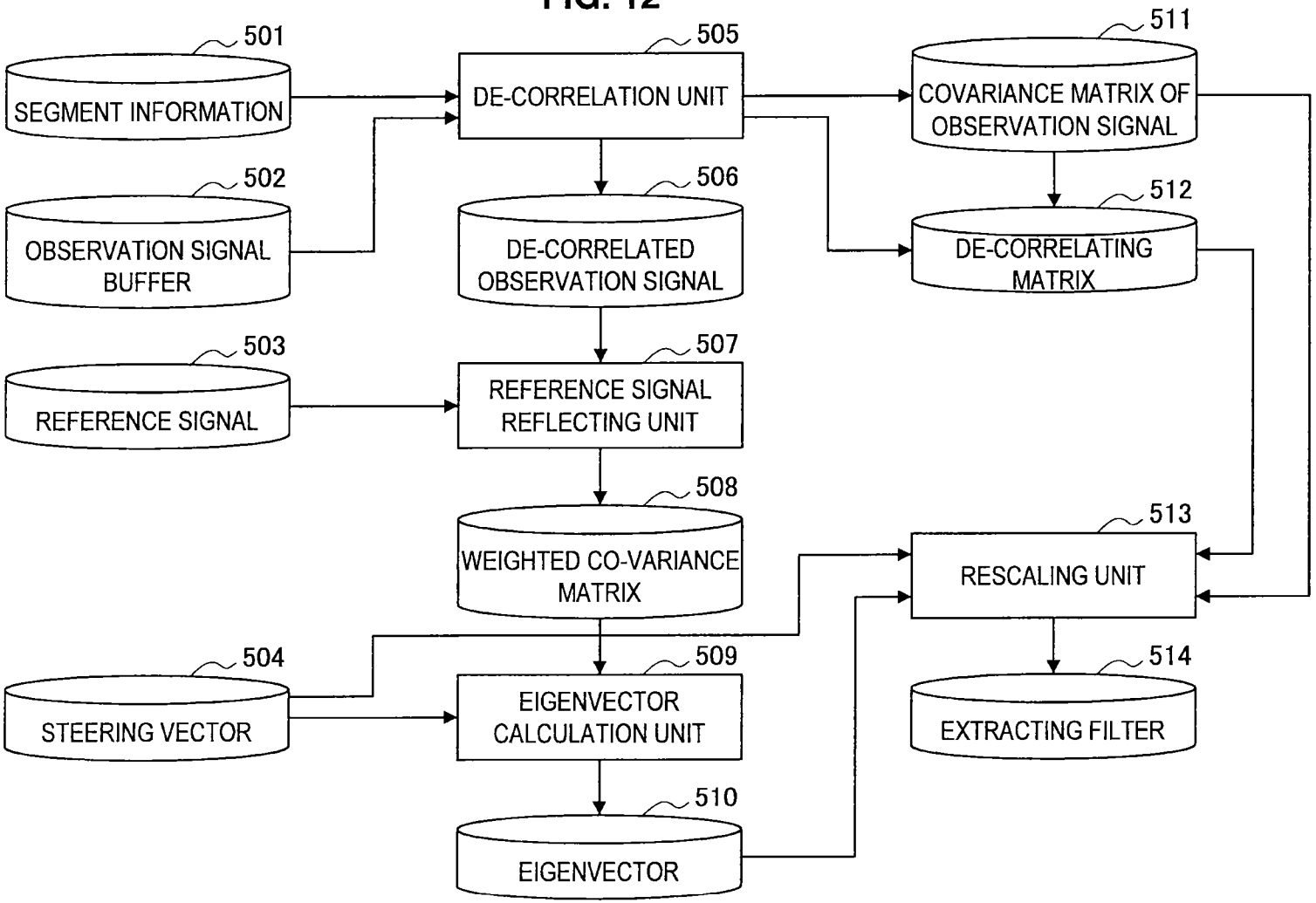
FIG. 12 is an explanatory diagram of details of an extracting filter generation unit.

Next, a description will be given in detail of the extracting filter generation unit 411 with reference to FIG. 12.

Figure 11:
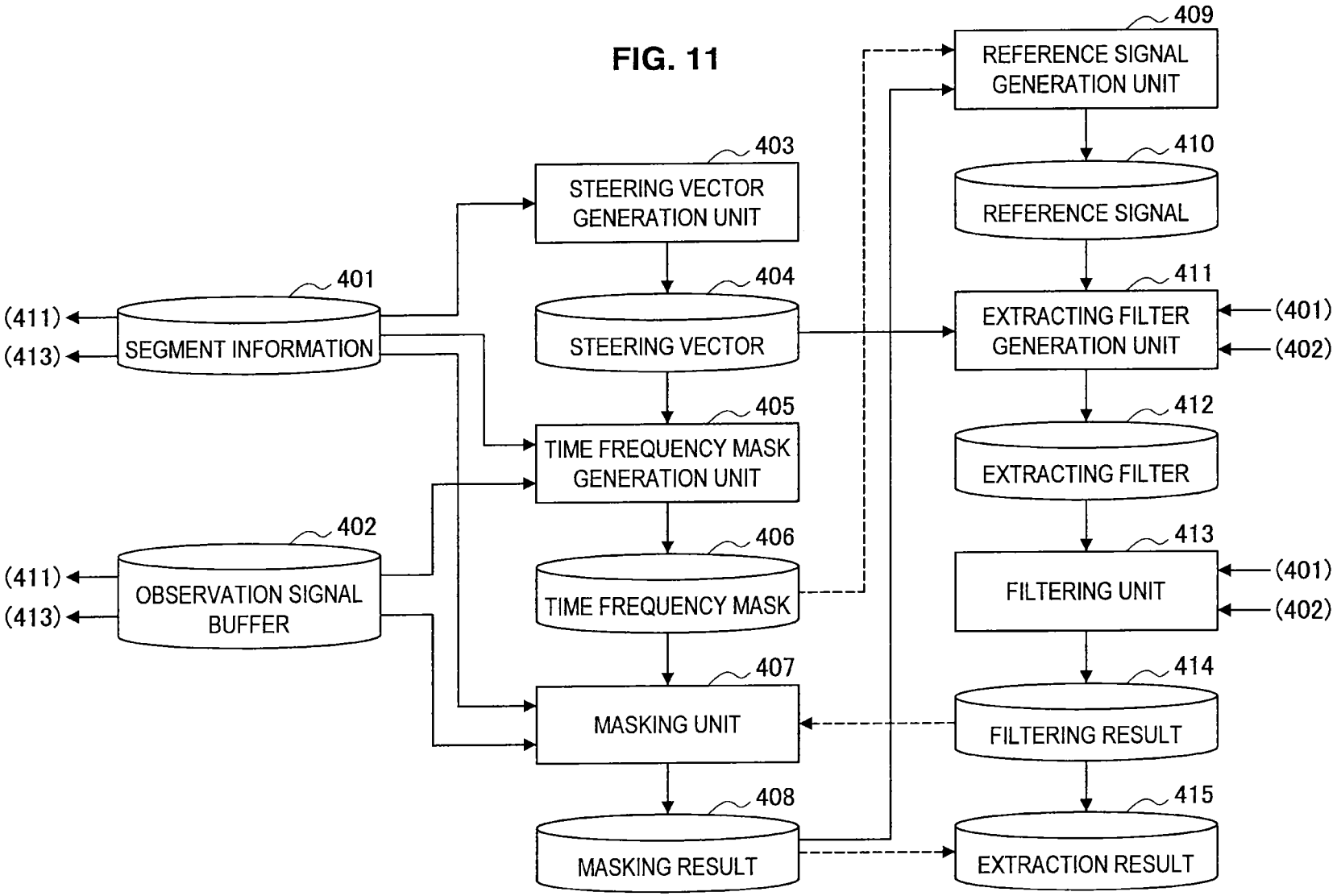
FIG. 11 is an explanatory diagram of details of a sound source extraction unit.

Segment information 501, an observation signal buffer 502, a reference signal 503, and a steering vector 504 are the same as the respective segment information 401, observation signal buffer 402, reference signal 410, and steering vector 404 shown in FIG. 11.

A de-correlation unit 505 obtains an observation signal in the relevant segment from the observation signal buffer 502 based on the starting time and the ending time included in the segment information 501 and generates a covariance matrix of the observation signal 511, a de-correlating matrix 512, and a de-correlated observation signal 506 by using Equations [4.1] to [4.7].

A reference signal reflecting unit 507 generates data corresponding to the right-hand side of Equation [4.11] from the reference signal 503 and the de-correlated observation signal 506. This data is referred to as a weighted co-variance matrix 508.

An eigenvector calculation unit 509 obtains an eigenvalue and an eigenvector by applying eigenvalue decomposition on the weighted co-variance matrix 508 (right-hand side of Equation [4.11]) and selects the eigenvector based on the similarity with the steering vector 504.

The post-selection eigenvector is stored in an eigenvector storage unit 510.

A rescaling unit 513 adjusts the scale of the post-selection eigenvector stored in the eigenvector storage unit 510 so that a desired scale of the extraction result may be obtained. In this case, the covariance matrix of the observation signal 511 and the de-correlating matrix 512 are utilized. Details of the processing will be described later.

A result of the rescaling is stored as an extracting filter in an extracting filter storage unit 514.

In such a manner, the extracting filter generation unit 411 calculates a weighted co-variance matrix from the reference signal and the de-correlated observation signal and performs the eigenvector selection processing to select one eigenvector as the extracting filter from among a plurality of eigenvectors obtained by applying eigenvalue decomposition on the weighted co-variance matrix.

The eigenvector selection processing is performed to select the eigenvector corresponding to the minimum eigenvalue as the extracting filter. Alternatively, processing may be performed to select as the extracting filter an eigenvector which is most similar to the steering vector corresponding to the target sound.

This is the end of the description about the configuration of the device.

(2-1. Description of Processing Performed by Sound Signal Processing Device)

Next, a description will be given of processing which is performed by the sound signal processing device with reference to FIG. 13 and the subsequent.

Figure 13:
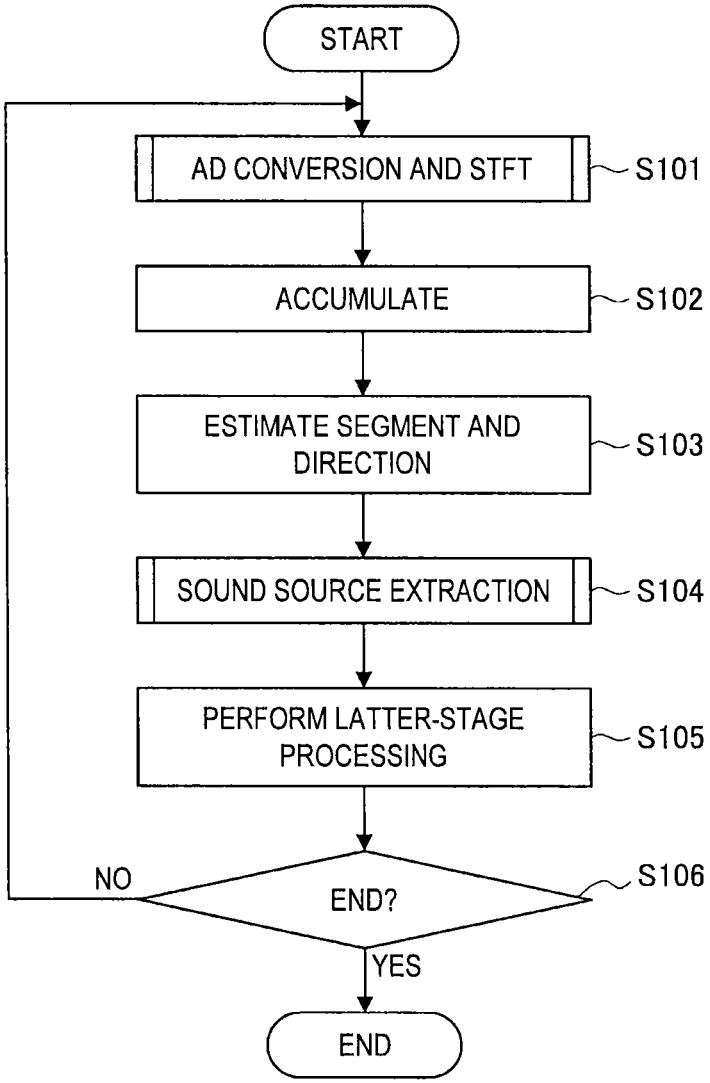
FIG. 13 shows an explanatory flowchart of processing which is performed by the sound signal processing device.

FIG. 13 is a flowchart showing an overall sequence of the processing which is performed by the sound signal processing device.

AD conversion and STFT in step S101 is processing to convert an analog sound signal input to the microphone serving as the sound signal input unit into a digital signal and the n convert it into a signal (spectrum) in the time frequency domain by STFT. The sound signal may be input from a file or a network besides the microphone. For STFT, see the above description made with reference to FIG. 10.

Since there are the plurality of (the number of the microphones) input channels in the present embodiment, AD conversion and STFT is performed the number of channels of times. Hereinafter, an observation signal at channel k, frequency bin ω, and frame t is denoted as X_k(ω, t) (Equation [1.1]). Further, regarding the number of STFT points as c, the number of per-channel frequency bins can be calculated as M=c/2+1.

Accumulation in step S102 is processing to accumulate the observation signal converted into the time frequency range through STFT for a predetermined lapse of time (for example, 10 seconds). In other words, regrading the number of frames corresponding to this lapse of time as T, the observation signals for successive T frames are accumulated in the observation signal buffer 221 shown in FIG. 9.

Direction-and-segment estimation in step S103 detects a starting time (at which a sound source started to be active) and an ending time (at which it stopped being active) of the sound source as well as its arrival direction.

This processing may come in the method using a microphone array and the method using an image as described above with reference to FIG. 9, any one of which can be used in the present disclosure.

Sound source extraction in step S104 generates (extracts) a target sound corresponding to a segment and a direction detected in step S103. The details will be described later.

Latter-stage processing in step S105 is processing using the extraction result and is, for example, speech recognition.

Finally, it spreads into two branches of continuing the processing and discontinuing it, so that the continuing branch returns to step S101 and the discontinuing branch ends the processing.

Next, a description will be given in detail of the sound source extraction processing performed in step S104 with reference to a flowchart shown in FIG. 14.

Segment adjustment in step S201 is processing to calculate a segment appropriate for estimating an extracting filter from the starting time and the ending time detected in direction-and-segment estimation performed in step S103 of the flow shown in FIG. 13. The details will be described later.

In step S202, a steering vector is generated from the sound source direction of the target sound. As described above with reference to FIG. 7, it is generated by the method using Equations [6.1] to [6.3]. The processing in step S201 and that in step S202 may be performed in no particular order and, therefore, may be performed in any order or concurrently.

In step S203, a time-frequency mask is generated using the steering vector generated in step S202. The time-frequency mask is generated using Equations [6.4] to [6.7].

Next, in step S204, an extracting filter is generated using the reference signal. The details will be described later. At this stage, only filter generation is performed, without generating an extraction result.

Step S207 will be described here earlier than power ratio calculation in step S205 and branch conditions in step S206.

In step S207, an extracting filter is applied to the observation signal corresponding to the segment of the target sound. That is, the following equation [9.1] is applied to all of the frames (all of t's) and all of the frequency bins (all of ω's) in the segment.

$$Y(\omega,t)=W(\omega)X(\omega,t) \quad [9.1]$$

$$Y'(\omega,t)=M(\omega,t)^{K}Y(\omega,t) \quad [9.2]$$

Besides the thus obtained extraction result, a time-frequency mask may further be applied as necessary. This corresponds to processing in step S208 shown in FIG. 14. Parentheses denote that this processing can be omitted.

That is, the time-frequency mask M(ω, t) obtained in step S203 is applied to Y(ω, t) obtained with Equation [9.1] (Equation [9.2]). However, K in Equation [9.2] is a real number not less than 0 and a value which is set separately from J in Equation [6.8] or [6.9] or L in Equation [6.13]. By regarding K=0, it means not to apply the mask, so that the larger the K value is, the larger effects the mask has. That is, the effects of removing interference sounds become large, whereas the side effects of the musical noise become also large.

Since purpose of applying the mask in step S208 is to remove the interference sounds that could not completely be removed by filtering in step S207, it is not necessary to enlarge the effects of the mask so much, so that K may be equal to 1 (K=1), for example. As a result, as compared to sound source extraction only by means of time-frequency masking (see the conventional methods), the side effects of the musical noise etc. can be reduced.

Figure 15:
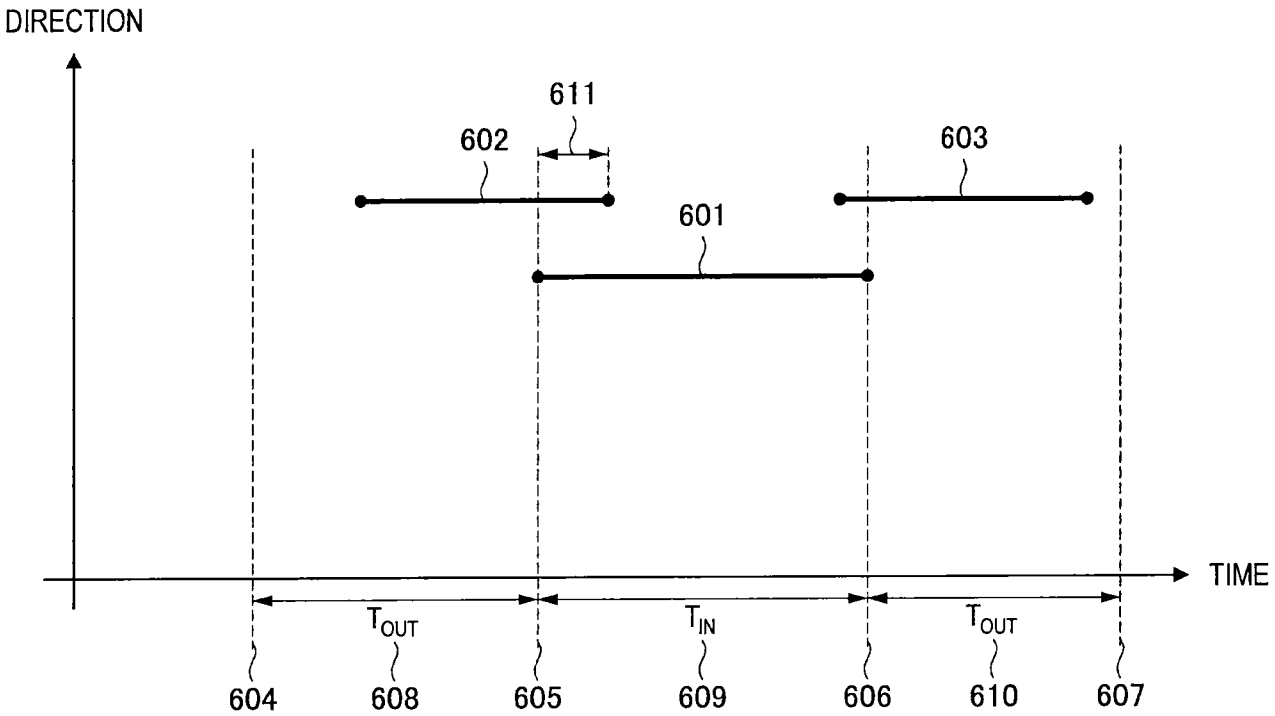
FIG. 15 is an explanatory graph of details of segment adjustment which is performed in step S201 of the flow in FIG. 14 and reasons for such processing.

Next, a description will be given of the details of segment adjustment which is performed in step S201 and a reason why such processing is performed with reference to FIG. 15. FIG. 15 shows a segment image, in which its vertical axis gives a sound source direction and its horizontal axis gives time. The segment (sound segment) of a target sound to be extracted is assumed to be a segment (sound segment) 601. A segment 602 is assumed to be a segment in which an interference sound is active before the target sound starts to be active. It is assumed that around the end of the segment 602 of the interference sound overlaps with the start of the segment 601 of the target sound time-wise and this overlapping region is denoted by an overlap region 611.

The segment adjustment which is performed in step S201 is basically processing to prolong a segment obtained in direction-and-segment estimation in step S103 of the flow shown in FIG. 13 both backward and forward time-wise. However, in the case of real-time processing, after the segment ends, there is no observation signal, so that mainly the segment is prolonged in the forward direction time-wise. The following will describe a reason why such processing is performed.

To remove an interference sound from the overlap region 611 included in the segment 601 of the target sound shown in FIG. 15, it is more effective that the interference sound should be contained as much as possible in a segment used for extracting filter generation (hereinafter referred to as "filter generation segment"). Accordingly, a time 604 is prepared which is obtained by shifting a starting time 605 in the reverse time direction, to employ a lapse of time from the time 604 to an ending time 606 as a filter generation segment. The time 604 does not necessarily adjust to a time at which the interference sound starts to be active and may be shifted from the time 605 by a predetermined lapse of time (for example, one second).

Further, even in a case where the segment of the target sound is short of a predetermined lapse of time, the segment is adjusted. For example, the minimum lapse of time of the filter generation segment is set to one second, so that if the detected segment of the target sound is 0.6 second, a lapse of time of 0.4 second prior to the start of the segment is included in the filter generation segment.

If the observation signal is read from a file, the observation signal after the end of the segment of the target sound can also be acquired, so that the ending time can be prolonged in the time direction. For example, by setting a time 607 obtained by shifting the ending time 606 of the target sound by a predetermined lapse of time in FIG. 15, a lapse of time from the time 604 to the time 607 is employed as the filter generation segment.

Hereinafter, a set of the frame numbers corresponding to the uttering segment 601 is denoted as T_IN, that is, T_IN609 shown in FIG. 15 and a set of the frame numbers included by prolongation of the segment is denoted as T_OUT, that is, T_OUT608, 610 shown in FIG. 15.

Next, a description will be given in detail of the extracting filter generation processing which is performed in step S204 in the flow in FIG. 14 with reference to a flowchart shown in FIG. 16.

Figure 16:
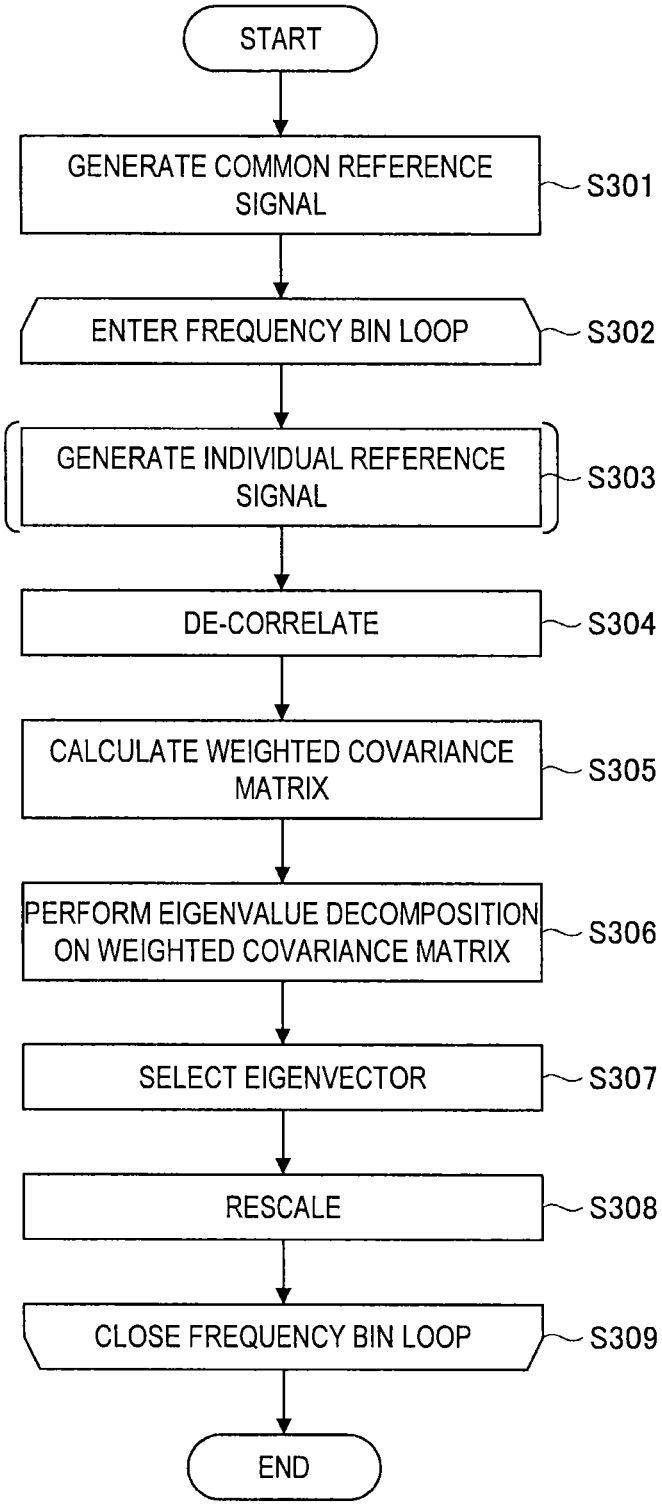
FIG. 16 shows an explanatory flowchart of details of extracting filter generation processing which is performed in step S204 in the flow in FIG. 14.

Of steps S301 and S303 in which a reference signal is generated in the flowchart shown in FIG. 16, the reference signal is generated in step S301 in the case of using the reference signal common to all of the frequency bins and it is generated in step S303 in the case of using the different reference signals for the different frequency bins.

Hereinafter, the case of using the common reference signal will be described first and the case of using the different reference signals for the different frequency bins, in the item of variants later.

In step S301, the reference signal common to all of the frequency bins is generated using the above-described Equations [6.11] and [6.13].

Steps S302 through S309 make up a loop for the frequency bins, so that processing of steps S303 to S308 is performed for each of the frequency bins.

The processing in step S303 will be described later.

In step S304, an observation signal is de-correlated. Specifically, a de-correlated observation signal X'(ω, t) is generated using the above-described Equations [4.1] to [4.7].

Figure 14:
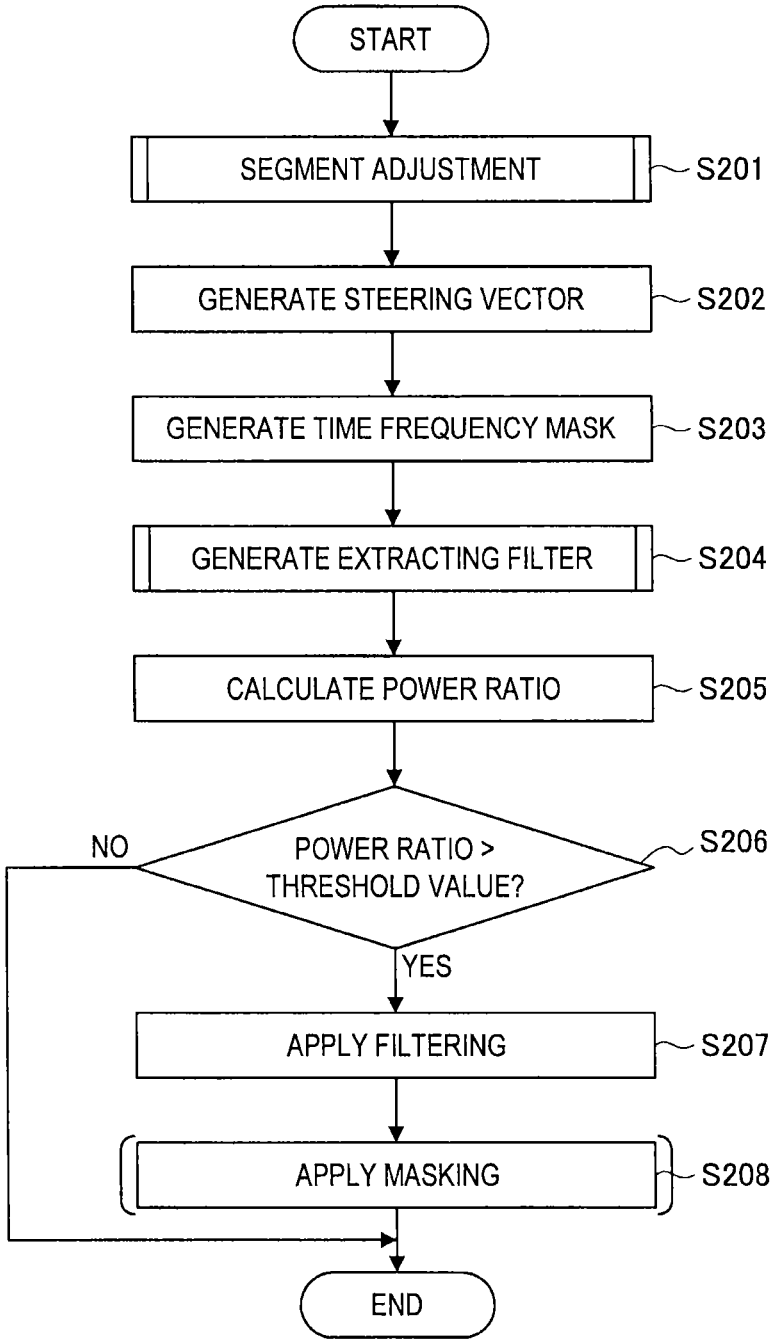
FIG. 14 shows an explanatory flowchart of details of the sound source extraction processing which is performed in step S104 of the flow in FIG. 13.

If the following equations [7.1] to [7.3] are used in place of Equation [4.3] in calculation of a covariance matrix R(ω) of the observation signal, the covariance matrix can be reutilized in power calculation in step S205 in the flow shown in FIG. 14, thereby reducing its computational cost.

$$R_{IN}(\omega) = \langle X(\omega, t)X(\omega, t)^H \rangle_{t \in T_{IN}} \quad [7.1]$$

$$R_{OUT}(\omega) = \langle X(\omega, t)X(\omega, t)^H \rangle_{t \in T_{OUT}} \quad [7.2]$$

$$R(\omega) = \frac{|T_{IN}|R_{IN}(\omega) + |T_{OUT}|R_{OUT}(\omega)}{|T_{IN}| + |T_{OUT}|} \quad [7.3]$$

$$p_{IN} = \sum_{\omega} W(\omega)R_{IN}(\omega)W(\omega)^H \quad [7.4]$$

$$p_{OUT} = \sum_{\omega} W(\omega)R_{OUT}(\omega)W(\omega)^H \quad [7.5]$$

R_{OUT}(ω) and R_{OUT}(ω) in Equations [7.1] and [7.2] are covariance matrixes of observation signals calculated from the segments of T_IN and T_OUT shown in FIG. 15, respectively. Further, |T_IN| and |T_OUT| in Equation [7.3] denote the numbers of frames in the segments T_IN and T_OUT respectively.

In step S305, a weighted co-variance matrix is calculated. Specifically, a matrix in the left-hand side of the above-described Equation [4.11] is calculated from the reference signal r(t) and the de-correlated observation signal X' (ω, t).

In step S306, eigenvalue decomposition is performed on the weighted co-variance matrix. Specifically, the weighted co-variance matrix is decomposed into a format of the right-hand side of Equation [4.11]. In step S307, an appropriate one of the eigenvectors obtained in step S306 is selected as an extracting filter. Specifically, either an eigenvector corresponding to the minimum eigenvalue is employed using the above-described Equation [5.1] or an eigenvector nearest a sound source direction of the target sound is employed using Equations [5.2] to [5.5].

Next, in step S308, scale adjustment is performed on the eigenvector selected in step S307. The processing performed here and a reason for it will be described as follows.

Each eigenvector obtained in step S306 is comparable to W' (ω) in Equation [4.8]. That is, it is a filter to perform extraction on the de-correlated observation signal.

Accordingly, to apply a filter to the observation signal before being de-correlated, some kind of conversion is necessary.

Further, although a constraint of variance=1 is applied to the filtering result Y(ω, t) when obtaining the extracting filter (Equation [3.2]), the variance of the target sound is different from 1. Therefore, it is necessary to estimate the variance of the target sound by using any other method and make the variance of the extraction result agree with it.

Both of the adjustment operations may be given by the following Equation [8.4].

$$g(\omega) = e_i R(\omega)\{W'(\omega)P(\omega)\}^H \quad [8.1]$$

$$e_i = [0, \ldots, 0, 1, 0, \ldots, 0] \quad [8.2]$$

$$g(\omega) = S(\omega, \theta)^H R(\omega)\{W'(\omega)P(\omega)\}^H \quad [8.3]$$

$$W(\omega) \leftarrow g(\omega)W'(\omega)P(\omega) \quad [8.4]$$

$$g(\omega) = \underset{g(\omega)}{\operatorname{argmin}}\langle |X_i(\omega, t) - g(\omega)Y(\omega, t)|^2 \rangle_t \quad [8.5]$$

$$g(\omega) = \underset{g(\omega)}{\operatorname{argmin}}\left\langle |S(\omega, \theta)^H X(\omega, t) - g(\omega)Y(\omega, t)|^2 \right\rangle_t \quad [8.6]$$

P(ω) in this equation is a de-correlating matrix and has an action so that W' (ω) may correspond to the observation signal before being de-correlated.

g(ω) is calculated with Equation [8.1] or [8.3] and has an action that the variance of the extraction result may agree with the variance of the target sound. In Equation [8.1] e_i is a row vector whose i-th element only is 1 and the other elements of which are 0 (Equation [8.2]. Further, suffix i denotes that the observation signal of the i-th microphone is used for scale adjustment.

The following will describe the meaning of Equations [8.1] and [8.3].

It is considered to multiply the extraction result Y(ω, t) before scale adjustment by a scale g(ω) to approximate components derived from the target sound which are contained in the observation signal. By using a signal observed with the i-th microphone as the observation signal, the scale g(ω) can be given by Equation [8.5] as a term that minimizes a square error. g(ω) that satisfies this equation can be obtained with Equation [8.1]. In the equation, X_i(ω, t)=e_iX(ω, t).

Similarly, if it is considered to use a result of the delay-and-sum array in place of the observation signal to approximate components derived from the target sound which are contained in the result, the scale g(ω) can be given by Equation [8.6]. g(ω) that satisfies this equation can be obtained with Equation [8.3].

By performing steps S303 to S308 for all of the frequency bins, an extracting filter is generated.

Next, a description will be given of power ratio calculation in step S205 and branch processing in step S206 in the flow in FIG. 14. Those pieces of processing are performed in order to permit the sound source extraction to skip an extra segment generated by false detection etc., in other words, abandon the false-detected segment.

For example, in the case of detecting a segment based on only the movement of the lips, even if only the lips are moved without uttering of a sound by the user, it may possibly be detected as an uttering segment. Further, in the case of detecting a segment based on a sound source direction, any sound source having directivity (other than background noise) may possibly be detected as an uttering segment. By checking such a false-detected segment before the sound source is extracted, it is possible to reduce the amount of calculation and prevent false reaction due to false detection.

At the same time, an extracting filter is calculated in step S204 and a covariance matrix of the observation signal is calculated both inside and outside the segment, so that by using both of them, it is possible to calculate a variance (power) in a case where the extracting filter is applied to each of the inside and the outside of the segment. By using a ratio between both of the powers, false detection can be decides to some extent. This is because the false-detected segment is not accompanied by uttering of speeches, so that the power ratios inside and outside the segment are considered to be small (almost the same powers inside and outside the segment).

Accordingly, in step S205, power P_IN in the segment is calculated using above Equation [7.4] and the respective powers inside and outside the segment are calculated using Equation [7.5]. "Σ" in those equations denotes a sum all over the frequency bins and R_IN(ω) and R_OUT(ω) are covariance matrixes of the observation signal and can be calculated from the segments corresponding to T_IN and T_OUT in FIG. 15 respectively (Equations [7.1], [7.2]).

Then, in step S206, it is decided as to whether a ratio of the two, that is, P_IN/P_OUT, is in excess of a predetermined threshold value. If the condition is not satisfied, it is decided that detection is false, to skip steps S207 and S208 and abandon the relevant segment.

If the condition is satisfied, it means that a power inside the segment is sufficiently larger than that outside the segment, so that advances are made to step S207 to generate an extraction result.

Here, the description of the processing ends.

[3. Variants]

The following will describe the following three variant examples sequentially.

(1) Example in which the reference signals are used for the different frequency bins (2) Example in which a reference signal is generated by performing ICA at some of frequency bins (3) Example in which sounds are recorded through a plurality of channels to apply the present disclosure at the time of reproduction (4) Other objective functions Those will be described as follows.

(5) Other methods of generating the reference signal (6) Processing using singular value decomposition in estimation of a separation filter (7) Application to real-time sound source extraction Those will be described below.

(3-1. Example in which the Reference Signals are Used for the Different Frequency Bins)

A reference signal calculated with the above-described Equation [6.11] or [6.13] is common to all of the frequency bins. However, the time envelope of a target sound is not typically common to all the frequency bins. Accordingly, there is a possibility that the sound source can be extracted more accurately if an envelope for each frequency bin of the target sound can be estimated.

A method for calculating a reference signal for each frequency bin will be described with reference to FIG. 17 and the following Equations [1.1] to [10.5].

$$r(\omega, t) = \{\langle |Q'(\omega, t)|^L \rangle_{\alpha(\omega) \le \omega \le \beta(\omega)}\}^{1/L} \quad [10.1]$$

$$r(\omega, t) = \{\langle M(\omega, t)^L \rangle_{\alpha(\omega) \le \omega \le \beta(\omega)}\}^{1/L} \quad [10.2]$$

$$(\alpha(\omega), \beta(\omega)) = \begin{cases} (\omega_{min}, \omega_{min} + 2h) & \text{if } \omega_{min} + h < \omega \quad [10.3] \\ (\omega - h, \omega + h) & \text{if } \omega_{min} + h \le \omega \le \omega_{max} - h \quad [10.4] \\ (\omega_{max} - 2h, \omega_{max}) & \text{if } \omega < \omega_{max} - h \quad [10.5] \end{cases}$$

FIG. 17(*a*) shows an example where a reference signal common to all of the frequency bins is generated. It accommodates a case where Equation [6.11] or [6.13] is used, to calculate the common reference signal by using the frequency bins ω_min to ω_max in a masking result (when Equation [6.1] is used) or a time-frequency mask (when Equation [6.13] is used).

Figure 17B:
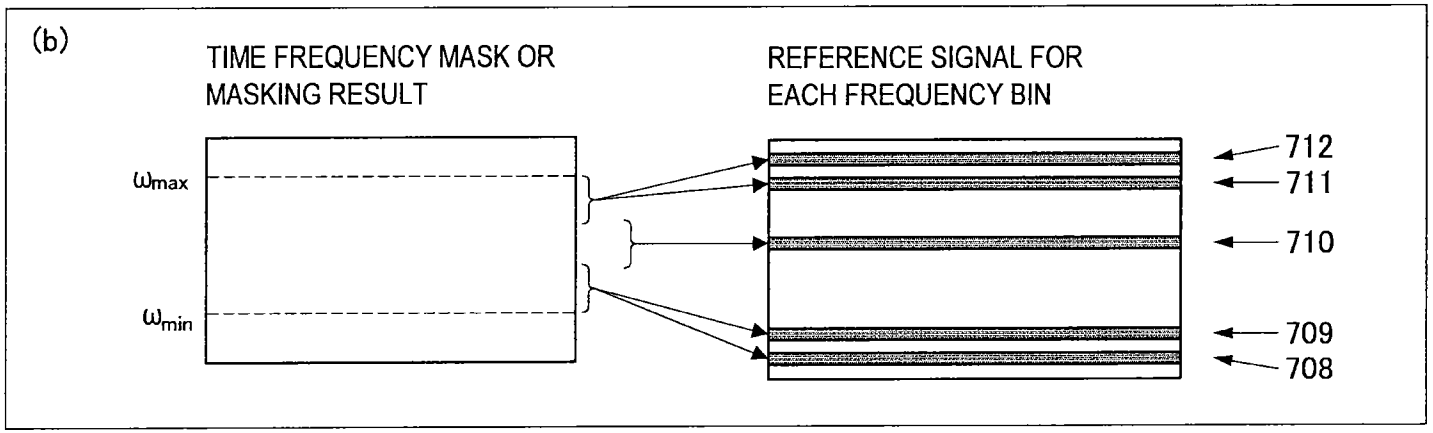
FIG. 17B is another explanatory view of the example of generating the reference signal common to all the frequency bins and the example of generating the reference signal for each frequency bin.

FIG. 17B shows an example where a reference signal is generated for each frequency bin. In this case, Equation [10.1] or [10.2] is applied, to calculate the reference signal from the masking result or the time-frequency mask respectively. Equation [10.1] is different from Equation [6.11] in that the range subject to averaging depends on the frequency bin ω. The same difference exists also between Equation [10.2] and Equation [6.13].

The lower limit α(ω) and the upper limit β(ω) of the frequency bins subject to averaging are given with Equations [10.3] to [10.5] depending on the value of ω. However, "h" denotes a half of the width of the range.

Equation [10.4] denotes that a range of ω−h to ω+h is subject to averaging if ω falls in a predetermined range so that the different reference signals may be obtained for the different frequency bins.

Equations [10.3] and [10.5] denote that a fixed range is subject to averaging if ω falls outside the predetermined range so that the reference signal may be prevented from being influenced by the components of a low frequency bin or a high frequency bin.

Reference signals 708 and 709 in FIG. 17 denote reference signals calculated from a range of Equation [10.3], which are the same as each other. Similarly, a reference signal 710 denotes a reference signal calculated from a range of Equation [10.4] and reference signals 711 and 712 denote reference signals calculated from a range of Equation [10.5].

(3-2. Example in which a Reference Signal is Generated by Performing ICA at Some of Frequency Bins)

Next, a description will be given of an example where a reference signal is generated by performing ICA at some of frequency bins.

Although the above-described Equations [6.1] to [6.14] have used time-frequency masking to generate a reference signal, it may be obtained with ICA. That is, the example combines separation by use of ICA and extraction by use of the present disclosure.

The basic processing is as follows. ICA is applied in limited frequency bins. By averaging a result of the separation, a reference signal is generated.

The generation of the reference signal based on results of separation to which ICA is applied is described also in the earlier patent application by the present applicant (Japanese Patent Application Laid-Open No. 2010-82436), by which interpolation is performed by applying ICA to the remaining frequency bins (or all of the frequency bins) using the reference signal; however, in the variant of the present disclosure, sound source extraction by use of the reference signal is applied. That is, from among the n number of separation results as an output of ICA, one result that corresponds to the target sound is selected by using a sound source direction etc., to generate a reference signal from a result of the separation of this selection. If the reference signal is obtained, an extracting filter and an extraction result are obtained by applying the above-described Equations [4.1] to [4.14] to the remaining frequency bins (or all of the frequency bins).

(3-3. Example in which Sounds are Recorded Through a Plurality of Channels to Apply the Present Disclosure at the Time of Reproduction Next, a description will be given of an example where sounds are recorded through a plurality of channels to apply the present disclosure is applied at the time of reproduction with reference to FIG. 18.

In the above-described configuration in FIG. 9, it has been assumed that a sound entering the sound signal input unit 101 composed of a microphone array are soon used in sound source extraction; however, a step may be interposed of recording a sound (saving it in a file) and reproducing it (reading it from the file). That is, for example, a configuration shown in FIG. 18 may be employed.

Figure 18:
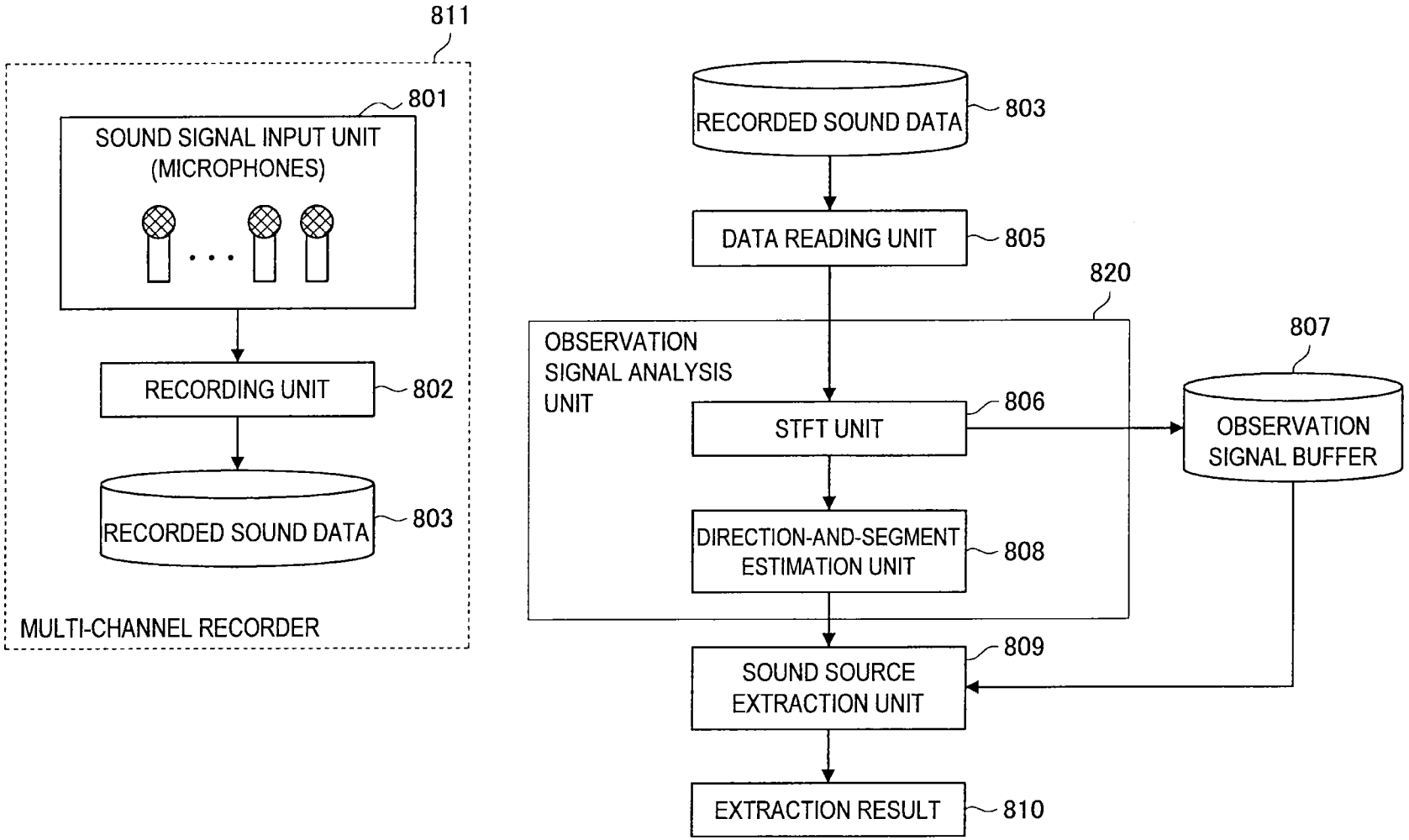
FIG. 18 is an explanatory diagram of an embodiment in which a sound is recorded through plurality of channels and, when it is replayed, the present disclosure is applied.

In FIG. 18, a multi-channel recorder 811 performs AD conversion etc. in a recording unit 802 on a sound input to a sound signal input unit 801 composed of a microphone array, so that the sound is saved in a recording medium as recorded sound data 803 unchanged as a multi-channel signal. "multi-channel" here means that a plurality of channels, in particular, at least three channels are used.

When performing sound extraction processing on a specific sound source from the recorded sound data 803, the recorded sound data 803 is read by a data reading unit 805. As the subsequent processing, almost the same processing as that by the STFT unit 212 and others described with reference to FIG. 9 is performed in an observation signal analysis unit 820 having an STFT unit 806 and a direction-and-segment estimation unit 808, an observation signal buffer 807, and a sound source extraction unit 809, thereby generating an extraction result 810.

As in the case of the configuration shown in FIG. 18, by saving a sound as multi-channel data at the time of recording, it is possible to apply sound source extraction later. That is, in the case of, for example, applying speech recognition later on the recorded sound data, it is possible to improve the accuracy of speech recognition by recording it as multi-channel data than recording it as monophonic data.

Moreover, the multi-channel recorder 811 may be equipped with a camera etc. to record sound data in condition where a user's lips image and multi-channel sound data are synchronized with each other. In the case of reading such data, uttering direction-and-segment detection by use of the lips image may be used in the direction-and-segment estimation unit 808.

(3-4. Example Using Other Objective Functions)

An objective function refers to a function to be minimized or maximized. Although in sound source extraction by the present disclosure, Equation [3.3]

is used as an objective function to minimize it, any other objective functions can be used.

The following Equations [11.1] and [11.2] are examples of the objective function to be used in place of Equations [3.3] and [3.4] respectively; also by obtaining W(ω) that maximizes them, the signal can be extracted. The reason will be described as follows.

$$W(\omega) = \underset{W(\omega)}{\operatorname{argmax}}\langle |Y(\omega, t)^2| r(t)^N \rangle_t \quad [11.1]$$

$$W(\omega)\underset{W(\omega)}{\operatorname{argmax}} W(\omega)\langle X(\omega, t)X(\omega, t)^H r(t)^N \rangle_t W(\omega)^H \quad [11.2]$$

$$\langle |Y(\omega, t)|^2 r(t)^N \rangle_t \leq \sqrt{\langle |Y(\omega, t)|^4 \rangle_t}\sqrt{\langle r(t)^{2N} \rangle_t} \quad [11.3]$$

$$W'(\omega) = \underset{W(\omega)}{\operatorname{argmax}} W'(\omega)\langle X'(\omega, t)X'(\omega, t)^H r(t)^N \rangle_t W'(\omega)^H \quad [11.4]$$

$$\langle X'(\omega, t)X'(\omega, t)^H r(t)^N \rangle = A(\omega)B(\omega)_t^H \quad [11.5]$$

$$l = \underset{k}{\operatorname{argmax}}[b_k[\omega)] \quad [11.6]$$

The inequality expression of Equation [11.3] typically holds true on a part following "arg max" in the above expression, while the equality expression holds true when a relationship of Equation [3.6] holds true. The right-hand side of this equation is maximized when <|Y(ω, t) |^4>_t is maximized. <|Y(ω, t) |^4>_t corresponds to an amount referred to as a signal kurtosis and is maximized when Y does not contain interference sounds (only the target sound appears). Therefore, if the reference signal r(t)^N agrees with a time envelope of the target sound, W(ω) that maximizes the left-hand sides of Equations [11.1] and [11.2] agrees with W(ω) that maximizes their right-hand sides and provides a filter to extract the target sound.

Maximization of Equations [11.1] and [11.2] is almost the same as minimization of Equations [3.3] and [3.4] and is performed using Equations [4.1] to [4.14].

First, a de-correlated observation signal X' (ω, t) is generated using Equations [4.1] to [4.7]. A filter to extract the target sound from this X' (ω, t) is obtained by maximizing Equation [11.4] in place of Equation [4.10]. For this purpose, eigenvalue decomposition is applied to a part of <●>_t in Equation [11.4](Equation [11.5]). In this equation, A(ω) is a matrix composed of eigenvectors (Equation [4.12]) and B(ω) is a diagonal matrix composed of eigenvalues (Equation [4.14]). One of the eigenvectors provides a filter to extract the target sound.

For a maximization problem, this example uses Equation [11.6] in place of Equation [5.1] to select an eigenvector corresponding to the maximum eigenvalue. Alternatively, the eigenvalue may be selected using Equations [5.2] to [5.5]. Equations [5.2] to [5.5] can be used commonly to the minimization problem and the maximization problem because they are used to select an eigenvector corresponding to a direction of the target sound.

(3-5. Other Methods of Generating Reference Signal)

Hereinabove, a description has been given of a plurality of processing examples of the processing example to calculate a reference signal r(t) which corresponds to a time envelope denoting changes of the target's sound volume in the time direction. The reference signal calculation example may be any one of the following.

(1) Processing to calculate a reference signal common to all the frequency bins obtained by averaging the time envelopes of frequency bins (Equation [6.11])

(2) Processing to calculate a reference signal common to all the frequency bins obtained by averaging time-frequency masks M(ω, t) generated on the basis of an observation signal over the frequency bins as in the case of a time-frequency mask 172 in FIG. 6, for example (Equation [6.13])

(3) Processing to calculate the different reference signals for the different frequency bins described in the above variant (3-1), specifically calculate a reference signal for each frequency bin ωbased on results of masking (Equation [10.1])

(4) Processing to calculate the different reference signals for the different frequency bins described in the above variant (3-1), specifically calculate a reference signal for each frequency bin ω based on the time-frequency mask (Equation [10.2])

(5) Processing to generate a reference signal by performing ICA on some frequency bins described in the above variant (3-2), specifically generate a reference signal by performing ICA on limited frequency bins and averaging the resultant separation results For example, those various reference signal calculation processing examples have been described.

The following will describe reference signal generation processing examples other than those methods.

Earlier, in "B. Specific examples of problem solving processing to which conventional technologies are applied" in "Background", the following sound source extraction methods have been outlined which use known sound source direction and segment in extraction.

B1-1. Delay-and-sum array

B1-2. Minimum variance beamformer

B1-3. Maximum SNR beamformer

B1-4. Method based on target sound removal and subtraction

B1-5. Time-frequency masking based on phase difference

Many of those conventional sound source extraction methods can be applied to generation of a time envelope, which is a reference signal.

In other words, for example, the above conventional sound source extraction methods can be utilized only in the reference signal generation processing in the present disclosure, such that by thus applying the existing sound source extraction method only to the generation of a reference signal and performing the subsequent sound source extraction processing according to the processing in the present disclosure by using the generated reference signal, a sound source can be extracted, avoiding the problems of the sound source extraction processing according to the described conventional methods.

For example, sound source extraction processing by use of (B1-1. Delay-and-sum array) described in "Background" will be performed as the following processing.

By giving different time delay to observation signal of each microphone so as to make consistent phases of signals coming in the direction of the target sound and then summing up the observation signals, the target sound is emphasized because its phase is sonsistent and sounds coming in any other directions are attenuated because their phases are different a bit from each other. Specifically, let S(ω, θ) be a steering vector (vector which denotes a difference in phase of the sounds arriving in a certain direction among the microphones) corresponding to the direction θ, this processing obtains extraction results by using Equation [2.1] given above.

From the delay-and-sum array processing results, a reference signal can be generated.

To a reference signal from the delay-and-sum array processing results, the following Equation [12.1] may well be used instead of Equation [6.8].

$$Q(\omega, t) = S(\omega, \theta)^H X(\omega, t) \quad [12.1]$$

$$Q(\omega, t) = \frac{S(\omega, \theta)^H R(\omega)^{-1}}{S(\omega, \theta)^H R(\omega)^{-1} S(\omega, \theta)} X(\omega, t) \quad [12.2]$$

$$H(\omega, t) = X(\omega, t) - S(\omega, \theta)^H X(\omega, t) S(\omega, \theta) \quad [12.3]$$

$$Q_k(\omega, t) = \max(|X_k(\omega, t)| - |H_k(\omega, t)|, 0) \quad [12.4]$$

$$Q(\omega, t) = \sum_{k=1}^{n} Q_k(\omega, t) \quad [12.5]$$

As shown in the later-described experiment results, by generating a reference signal from delay-and-sum array processing results once and using it to thereby extract a sound source according to the method of the present disclosure, extraction results are obtained which are more accurate than in the case of performing sound source extraction by using a delay-and-sum array alone.

Similarly, sound source extraction processing by use of (B1-2. Minimun variance beamformer) described in "Background" will be performed as the following processing.

By forming a filter which has gain of 1 in the direction of the target sound (that is, not emphasizing or reducing the target) and null beams (direction with lower sensitivity) in the directions of interference sounds, this processing extracts only the target sound.

When generating a reference signal by applying the sound source extraction processing by use of a minimun variance beamformer, Equation [12.2] given above is used. In Equation [12.2], R(ω) is an observation signal's co-variance matrix which is calculated in Equation [4.3] given above.

Further, sound source extraction processing by use of (B1-4. Method based on target sound removal and subtraction) described in "Background" will be performed as the following processing.

By generating a signal obtained by removing the target sound from an observation signal (target sound-removed signal) once and subtracting the target sound-removed signal from the observation signal (or signal obtained by emphasizing the target sound by using a delay-and-sum array etc.), this processing extracts the target sound.

According to this method, the processing includes two steps of "removal of a target sound" and "subtraction", which will be described respectively.

To remove the target sound, Equation [12.3] given above is used. The equation works to remove a sound arriving in direction θ.

To perform subtraction, spectral subtraction (SS) is used. Spectral subtraction involves subtracting only the magnitude of a complex number instead of subtracting a signal in the complex-number domain as it is and is expressed by Equation [12.4] given above.

In Equation [12.4], $H_k(\omega, t)$ is the k-th element of a vector $H(\omega, t)$; and max(x, y) denotes to employ argument x or y whichever is larger and works to prevent the magnitude of the complex number from becoming negative.

A spectral subtraction result $Q_k(\omega, t)$ calculated by Equation [12.4] is a signal whose target sound is emphasized but has a problem in that since it is generated by spectral subtraction (SS), if it is used as a sound source extraction result itself (for example, waveform is generated by inverse Fourier transform), the sound may be distorted or musical noise may occur. However, as long as it is used as a reference signal according to the present disclosure, results of spectral subtraction (SS) need not be transformed into a waveform, thereby enabling avoiding the problems.

To generate a reference signal, Equation [12.5] given above is used. Alternatively, simply $Q(\omega, t)=Q_k(\omega, t)$ may be given for a specific value of k, where k corresponds to the index of an element of the vector $H(\omega, t)$.

Another reference signal generation method may be to generate a reference signal from sound source extraction results according to the present disclosure. That is, the following processing will be performed.

First, a sound source extraction result $Y(\omega, t)$ is generated using Equation [3.1] given above.

Next, regarding the sound source extraction result $Y(\omega, t)$ as $Q(\omega, t)$ in Equation [6.10] given above, a reference signal is generated again using Equation [6.11].

Equation [6.10] calculates $Q'(\omega, t)$, which is a result of normalizing the magnitude of the time-frequency masking result $Q(\omega, t)$ in the time direction, where $Q(\omega, t)$ is calculated, for example, in Equation [6.8].

Equation [6.11] is used to calculate an L-th power root-mean value of time envelopes among frequency bins belonging to a set $\Omega$ by using $Q'(\omega, t)$ calculated using Equation [6.10], that is, raise the elements to the L-th power and average them and, finally, calculate an L-th power root-mean value, which is, an L-th root value, that is, calculate a reference signal r(t) by averaging the time envelopes at the respective frequency bins.

Using the reference signal calculated in this manner, a sound source extracting filter is generated again.

This sound source extracting filter generation processing is performed by applying, for example, Equation [3.3].

If the reference signal generated for the second time is higher in accuracy than that generated first (=closer to the time envelope of the target sound), a more accurate extraction result can be obtained.

Further, a loop including the following two steps may be repeated an arbitrary number of times:

(step 1) Generating reference signal from extraction result (step 2) Generating extraction result again If the loop is repeated, computational costs increase; however, the obtained sound source extraction results can be of higher accuracy by that much.

(3-6. Processing to Use Singular Value Decomposition in Estimation of Separation Filter)

The sound source extraction processing having the configuration according to the present disclosure is basically based mainly on processing (Equation [1.2]) to obtain an extraction result $Y(\omega, t)$ by multiplying an observation signal $X(\omega, t)$ by an extracting filter $W(\omega)$. The extracting filter $W(\omega)$ is a column vector which consists of n elements and expressed as Equation [1.3].

As earlier described with reference to Equation [4.1] and the subsequent, an extracting filter applied in the sound source extraction processing has been estimated by de-correlating an observation signal (Equation [4.1]), calculating an weighted co-variance matrix by using it and a reference signal (left-hand side of Equation [4.11]), and applying eigenvalue decomposition to the weighted co-variance matrix (right-hand side of Equation [4.11]).

This processing can be reduced in computational cost by using singular value decomposition (SVD) instead of the eigenvalue decomposition.

The following will describe a method of estimating an extracting filter by using singular value decomposition.

An observation signal is de-correlated using Equation [4.1] described above to then generate a matrix $C(\omega)$ expressed by Equation [13.1].

$$C(\omega) = \left[\frac{X'(\omega, 1)}{r(1)^N}, \ldots, \frac{X'(\omega, T)}{r(T)^N}\right] \quad [13.1]$$

$$C(\omega) = A(\omega)G(\omega)K(\omega)^H \quad [13.2]$$

$$A(\omega)^H A(\omega) = I \quad [13.3]$$

$$K(\omega)^H K(\omega) = I \quad [13.4]$$

$$D(\omega) = \frac{1}{T} G(\omega)G(\omega)^H \quad [13.5]$$

A matrix $C(\omega)$ expressed by Equation [13.1] is referred to as a weighted observation signal matrix.

That is, the weighted observation signal matrix $C(\omega)$ is generated which has, as its weight, a reciprocal of an N-th power (N is a positive real number) of a reference signal by using the reference signal and the de-correlated observation signal.

By performing singular value decomposition on this matrix, $C(\omega)$ is decomposed into three matrix products on the right-hand side of Equation [13.2]. In this Equation [13.2], $A(\omega)$ and $K(\omega)$ are matrixes that satisfy Equations [13.3] and [13.4] respectively and $G(\omega)$ is a diagonal matrix including singular values.

In comparison between Equations [4.11] and [13.2] given above, they have the same matrix $A(\omega)$ and there is a relationship of Equation [13.5] between $D(\omega)$ and $G(\omega)$. That is, the same eigenvalue and eigenvector can be obtained even by using singular value decomposition instead of eigenvalue decomposition. Since the matrix $K(\omega)$ is not used in the subsequent processing, calculation of $K(\omega)$ itself can be omitted in the singular value decomposition.

In the method of using eigenvalue decomposition of a weighted co-variance matrix, there is a computational cost of obtaining co-variance matrix and the waste of not using about a half of the elements of the thus obtained co-variance matrix because it is of Hermitian symmetry. In contrast, in the method of using singular value decomposition of a weighted observation signal matrix, the calculation of the co-variance matrix can be skipped and further the unused elements are not generated.

A description will be given of processing to generate an extracting filter by using singular value decomposition with reference to a flowchart of FIG. 19.

Figure 19:
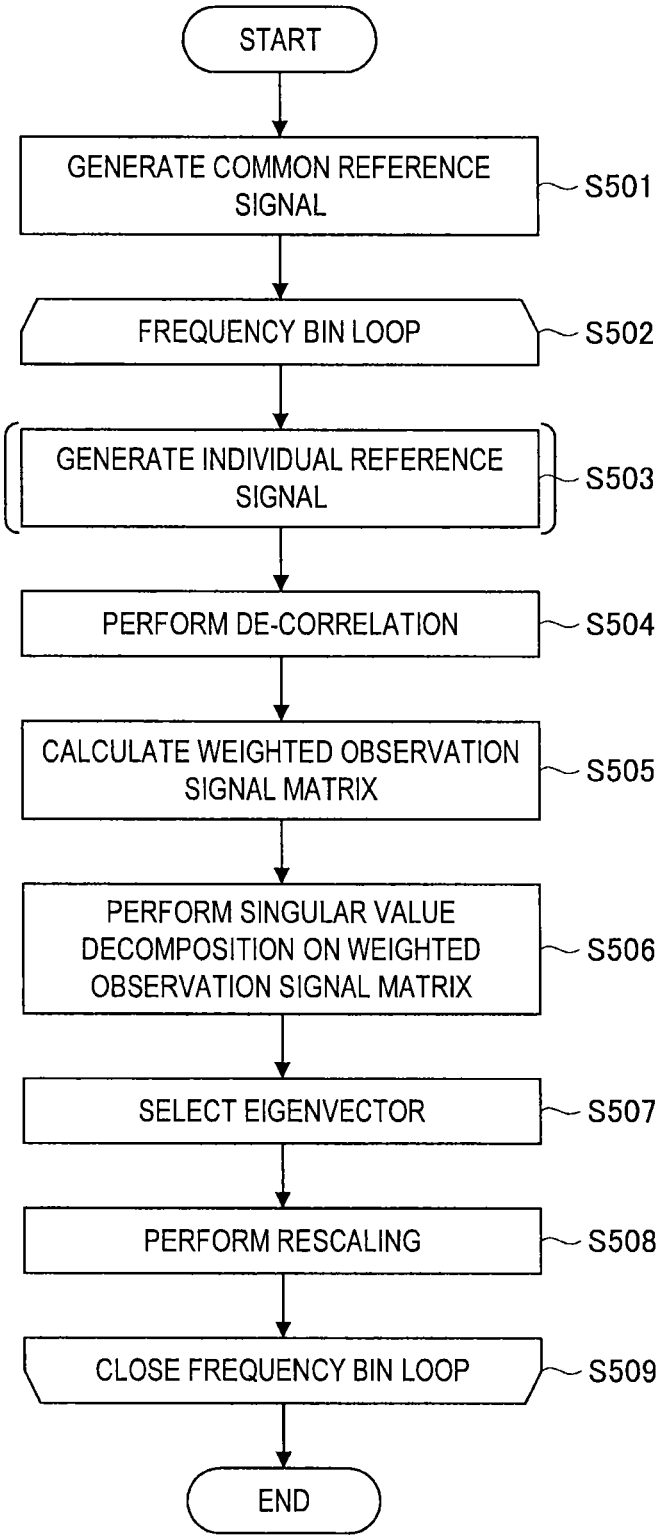
FIG. 19 is an explanatory flowchart of processing to generate an extracting filter by using singular value decomposition.

Steps S501 through S504 in the flowchart shown in FIG. 19 are the same as steps S301 through S304 of the flowchart shown in FIG. 16 respectively.

In step S505, a weighted observation signal matrix $C(\omega)$ is generated. It is the same as the matrix $C(\omega)$ expressed by Equation [13.1] given above.

In the next step of S506, singular value decomposition is performed on the weighted observation signal matrix $C(\omega)$ calculated in step S505. That is, C(ω) is decomposed into three matrix products on the right-hand side of Equation [13.2] given above. Further, a matrix D(ω) is calculated using Equation [13.5].

At this stage, the same eigenvalue and eigenvector as those in the case of using eigenvalue decomposition are obtained, such that in the subsequent steps of S507 through S509, the same processing as that in steps S307 through S309 in the flowchart of FIG. 16 described above will be performed. In such a manner, an extracting filter is generated.

(3-7. Application to Real-time Sound Source Extraction)

The above embodiment has been based on the assumption that the extraction processing should be performed for each utterance. That is, after the utterance ends, the waveform of a target sound is generated by sound source extraction. Such a method has no problems in the case of being used in combination with speech recognition etc. but has a problem of delay in the case of being used in noise cancellation (or speech emphasis) during speech communication.

However, even with a sound source extraction method by use of a reference signal according to the present disclosure, by using a fixed length segment of an observation signal which is used to generate an extracting filter, it is possible to generate and output an extraction result with small delay without waiting for the end of utterance. That is, similar to the case of the beamformer technology, it is possible to extract (emphasize) a sound in a specific direction in real time. The method will be described below.

In the present variant, it is assumed that a sound source direction θ may not be estimated for each utterance but be fixed. Alternatively, a direction specifying device may be operated by the user to set the sound source direction θ. Further alternatively, a user's face image may be detected in an image acquired with an imaging element (222 in FIG. 9), to calculate the sound source direction θ from coordinates of the detected face image. Furthermore, the image acquired with the imaging element (222 in FIG. 9) may be displayed on a display, to permit the user to specify a desired direction in which a sound source is to be extracted in the image by using various pointing devices (mouse, touch panel, etc.).

Figure 20:
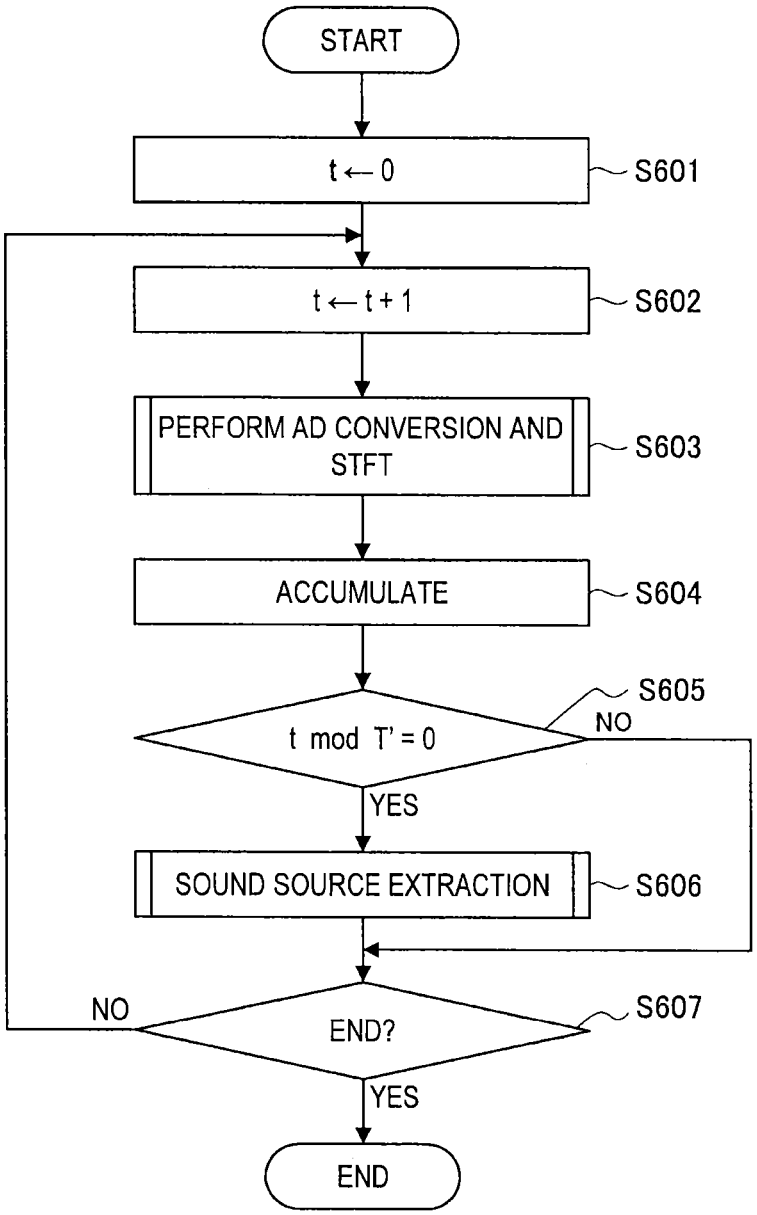
FIG. 20 is an explanatory flowchart of a real-time sound source extraction processing sequence of generating and outputting results of extraction with a low delay without waiting for the end of utterance by setting the segment of an observation signal to a fixed length.

A description will be given of the processing in the present variant, that is, a real-time sound source extraction processing sequence to generate and output extraction results with small delay without waiting for the end of utterance, with reference to the flowchart of FIG. 20.

In step S601, initial setting processing is performed.

"t" is a frame number, in which 0 is substituted as an initial value.

Steps S602 through S607 make up loop processing, denoting that the series of the processing steps will be performed each time one frame of sound data is input.

In step S602, the frame number t is increased by 1 (one).

In step S603, AD conversion and short-time Fourier transform (STFT) are performed on one frame of sound data.

Short-time Fourier transform (STFT) is the same as the processing described above with reference to FIG. 10.

One frame of data is, for example, one of frames 301 to 303 shown in FIG. 10, such that by performing windowing and short-time Fourier transform on it, one frame of spectrum $X_k(t)$ is obtained.

Next, in step S604, the one frame of spectrum $X_k(t)$ is accumulated in an observation signal buffer (for example, an observation signal buffer 221 in FIG. 9).

Next, in step S605, it is checked whether a predetermined number of frames are processed completely.

T' is 1 or larger integer; and t mod T' is a remainder obtained by dividing the integer t denoting a frame number by T'.

Those branch conditions denote that sound source extraction processing in step S606 will be performed once for each predetermined T' number of frames.

Only if the frame number t is a multiple of T', advances are made to step S606 and, otherwise, to step S607.

In the sound source extraction processing in step S606, the accumulated observation signal and sound source direction are used to extract a target sound. Its details will be described later.

If the sound source extraction processing in step S606 ends, a decision is made in step S607 as to whether the loop is to continue; if it is to continue, return is made to step S602.

The value of the frame number T', which is a frequency at which the extracting filter is updated, is set such that it may be longer than a time to perform the sound source extraction processing in step S606. In other words, if a value of the sound source extraction processing time calculated as the number of frames is smaller than the update frequency T', it is possible to perform sound source extraction in real time without increasing delay.

Next, a description will be given in detail of the sound source extraction processing in step S606 with reference to a flowchart shown in FIG. 21.

Figure 21:
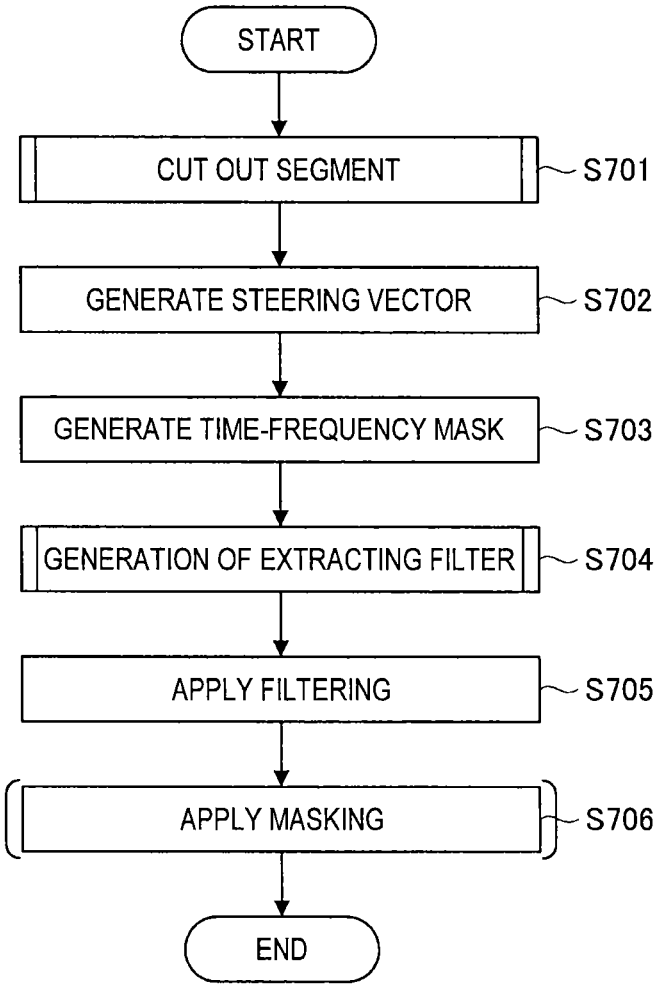
FIG. 21 is an explanatory flowchart of details of sound source extraction processing to be performed in step S606 of the flowchart in FIG. 20.

Basically, the flowchart shown in FIG. 21 is mostly the same in processing as that shown in FIG. 14 described as the detailed sequence of the sound source extraction processing in step S104 of the flowchart shown in FIG. 13 above. However, processing (S205, S206) on a power ratio shown in the flow of FIG. 14 is omitted.

Further, they are different from each other as to step S704 of extracting filter generation processing and step S705 in the flowchart shown in FIG. 21 of which segment of observation signals are to be used in filtering processing.

"Cutting out segment" in step S701 means to cut out a segment to be used in extracting filter generation from an observation signal accumulated in the buffer (for example, 221 in FIG. 9). The segment has a fixed length. A description will be given of the processing to cut out a fixed-length segment from an observation signal, with reference to FIG. 22.

Figure 22:
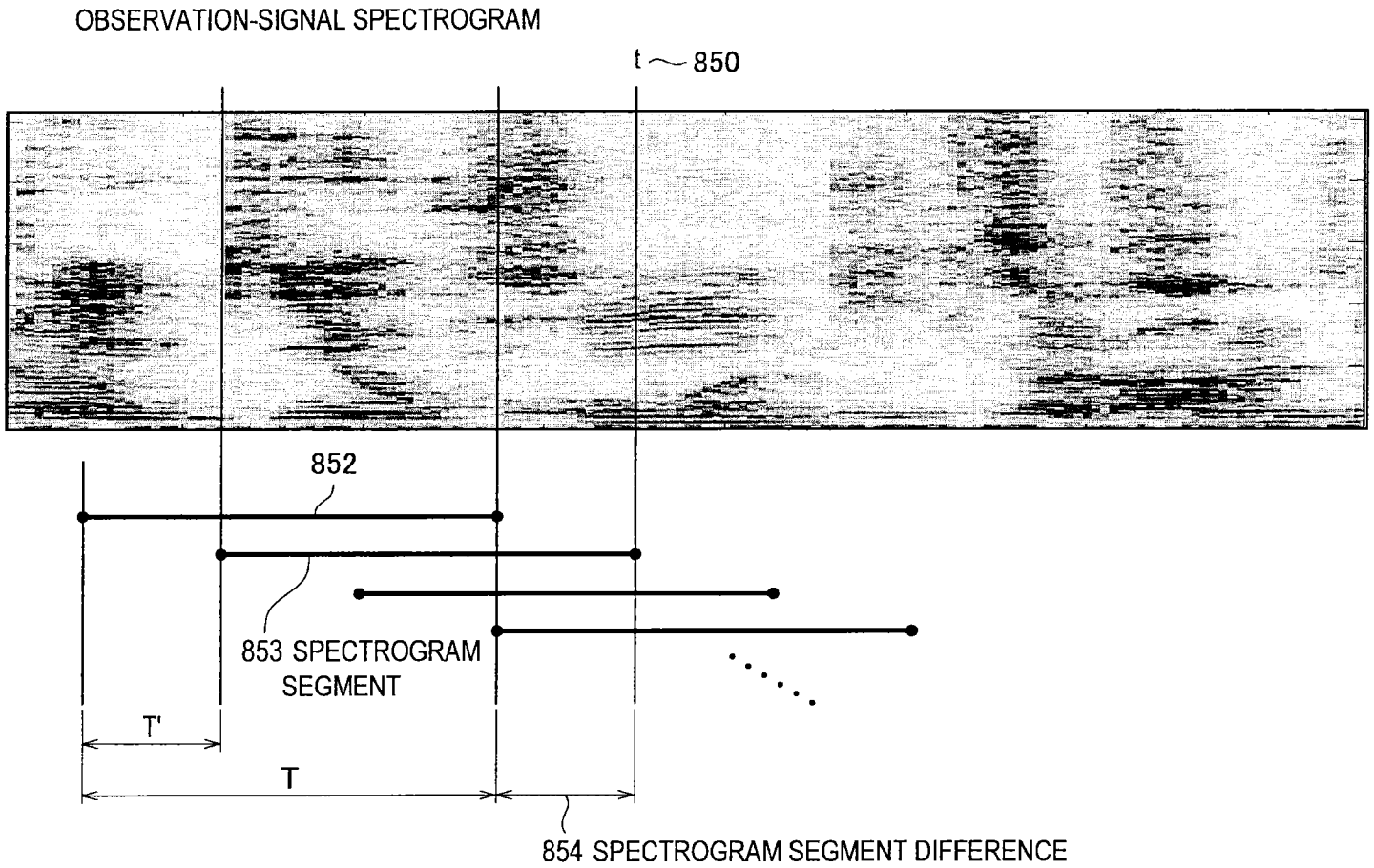
FIG. 22 is an explanatory view of processing to cut out a fixed-length segment from the observation signal.

FIG. 22 shows the spectrogram of an observation signal accumulated in the buffer (for example, 221 in FIG. 9).

Its horizontal axis gives the frame number and its vertical axis gives the frequency bin number.

Since one microphone generates one spectrogram, the buffer actually accumulates n number of (n is the number of the microphones) spectrograms.

For example, it is assumed that at a point in time when the segment cutout processing in step S701 is started, the most recent frame number t of the spectrogram of the observation signal accumulated in the buffer (for example, 221 in FIG. 9) is t850 in FIG. 22.

Strictly describing, at this point in time, there is no spectrogram to the right of frame number t850.

Let T be the number of frames of observation signals which are used in extracting filter generation. T may be set to a value different from that of T' applied in the flowchart of FIG. 20 above, that is, the prescribed number of frames T' as a unit in which the sound source extraction processing is performed once.

Hereinafter, it is assumed that T>T', where T is the number of frames of an observation signal which is used in extracting filter generation. For example, T is set to three seconds (T=3 s) and T' is set to 0.25 second (T'=0.25 s).

The segment of the length T having frame number t 850 shown in FIG. 22 as its end is expressed by a spectrogram segment 853 shown in FIG. 22.

In the segment cutout processing in step S701, an observation signal's spectrogram corresponding to the relevant segment is cut out.

After the segment cutout processing in step S701, steering vector generation processing is performed in step S702.

It is the same as the processing in step S202 in the flowchart of FIG. 14 described above. However, the sound source direction θ is assumed to be fixed in the present embodiment, such that as long as θ is the same as the previous one, this processing can be skipped to continue to use the same steering vector as the previous one.

Time-frequency mask generation processing in the next step of S703 is also basically the same as the processing in step S203 of the flowchart in FIG. 14. However, the segment of an observation signal used in this processing is spectrogram segment 853 shown in FIG. 22.

Extracting filter generation processing in step S704 is also basically the same as the processing in step S204 of the flowchart in FIG. 14; however, the segment of an observation signal used in this processing is spectrogram segment 853 shown in FIG. 22.

That is, the following processing items in the flow shown in FIG. 16 described above are all performed using an observation signal in spectrogram segment 853 shown in FIG. 22:

reference signal generation processing in step S301 or S303;

de-correlation processing in step S304;

calculation of a co-variance matrix in step S305; and re-scaling in step S308

In step S705, the extracting filter generated in step S704 is applied to an observation signal in a predetermined segment to thereby generate a sound source extraction result.

The segment of an observation signal to which the filter is applied need not be the entirety of spectrogram segment 853 shown in FIG. 22 but may be spectrogram segment difference 854, which is a difference from the previous spectrogram segment 852.

This is because in the previous filtering to spectrogram segment 852, the extracting filter is applied to a portion of spectrogram segment 853 shown in FIG. 22 other than spectrogram segment difference 854, such that an extraction result corresponding to this portion is obtained already.

Masking processing in step S706 is also performed on a segment of spectrogram difference 854. The masking processing in step S706 can be omitted similar to the processing in step S208 of the flow in FIG. 14.

It is the end of description on the variant of real-time sound source extraction.

[4. Summary of Effects of Processing According to the Present Disclosure]

The sound signal processing of the present disclosure enables extracting a target sound at high accuracy even in a case where an error is included in an estimated value of a sound source direction of the target sound. That is, by using time-frequency masking based on a phase difference, a time envelope of the target sound can be generated at high accuracy even if the target sound direction includes an error; and by using this time envelope as a reference signal, the target sound is extracted at high accuracy.

Merits over various extraction methods and separation methods are as follows.

(a) In comparison to a minimum variance beamformer and a Griffith-Jim beamformer, the present disclosure is not subject to an error in the target sound's direction. That is, reference signal generation by use of a time-frequency mask involves generation of almost the same reference signal (time envelope) even with an error in the target sound's direction, such that an extracting filter generated from the reference signal is not subject to the error in the direction.

(b) In comparison to independent component analysis in batch processing, the present disclosure can obtain an extracting filter without iterations by using eigenvalue decomposition etc. and needs fewer computational costs (=small delay).

Because of one-channel outputting, there is no mistaking in selection of the output channel.

(c) In comparison to real-time independent component analysis and one-line algorithm independent component analysis, the present disclosure obtains an extracting filter by using an entirety of an utterance segment, such that results extracted at high accuracy can be obtained from the start of the segment through the end thereof.

Moreover, because of one-channel outputting, there is no mistaking in selection of the output channel.

(d) In comparison to time-frequency masking, the present disclosure gives a linear type extracting filter, such that musical noise is not liable to occur.

(e) In comparison to null beamformer and GSS,

The present disclosure enables extraction even if the direction of a target sound is not clear as long as at least the direction of a target sound can be detected. That is, the target sound can be extracted at high accuracy even if the segment of an interference sound cannot be detected or its direction is not clear.

Furthermore, by combining the present disclosure with a sound segment detector which can accommodate a plurality of sound sources and is fitted with a sound source direction estimation function, recognition accuracy is improved in a noise environment and an environment of a plurality of sound sources. That is, even in a case where speech and noise overlap with each other time-wise or a plurality of persons uttered simultaneously, the plurality of sound sources can be extracted as long as they occur in the different directions, thereby improving accuracy of speech synthesis.

Furthermore, to confirm effects of the sound source extraction processing according to the above-described present disclosure, evaluation experiments were conducted. The following will describe a procedure and effects of the evaluation experiments.

Figure 23:
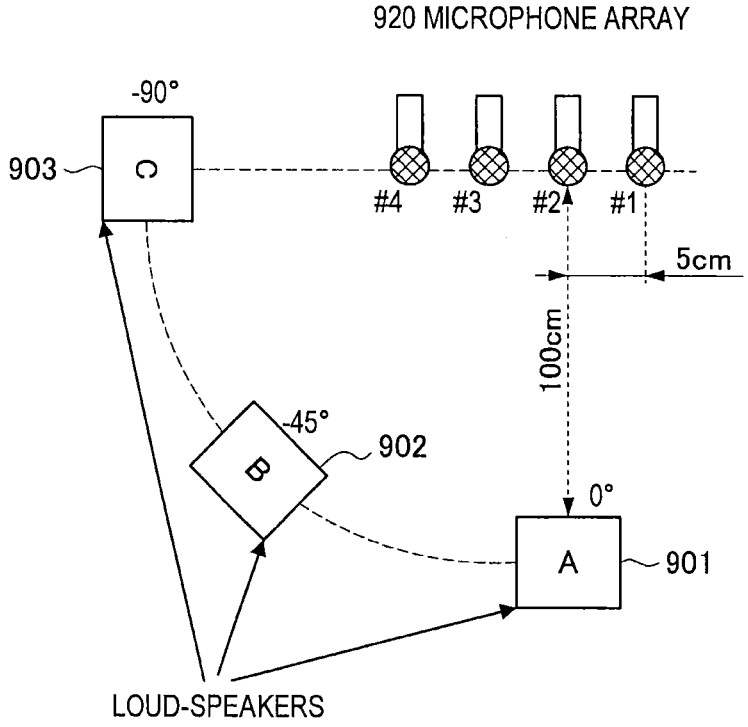
FIG. 23 is explanatory view of an incorporation environment in which an evaluation experiment was performed to check effects of the sound source extraction processing according to the present disclosure.

First, data of an evaluation sound was included. The including environment is shown in FIG. 23. A target sound and an interference sound were replayed from loud-speakers 901 through 903 set to three places, while a sound was included using four microphones 920 spaced at an interval of 5 cm. The target sound was speech and included 25 utterances by one male person and 25 utterances by one female person. The utterances averaged about 1.8 seconds (225 frames). Three interference sounds were used: music, speech (by the different loud-speaker from the target sound), and street noise (sound of streets with flow of people and cars).

the reverberation time of a room in which the evaluation sound data was recordeed was about 0.3 second. Further, recording and short-time Fourier transform (STFT) were set as follows.

Sampling rate: 16 [kHz]
STFT window type: Hanning window
Window length: 32 [ms] (512 points)
Shift width: 8 [ms] (128 points)
Number of frequency bins: 257

The target sound and the interference sound were recorded separately from each other and mixed in a computer later to thereby generate a plurality of types of observation signals to be evaluated. Hereinafter, they are referred to as "mixed observation signals".

The mixed observation signals are roughly classified into the following two groups based on the number of the interference sounds.

(1) In the case of one interference sound: The target sound was replayed from one of the three loud-speakers A901 through C903 and the interference sound was replayed from one of the remaining two and they were mixed.

There are 3 (number of target sound positions)×50 (number of utterances)×2 (number of interference sound positions)×3 (number of types of the interference sound)=900 cases.

(2) In the case of two interference sounds: The target sound was replayed from the loud-speaker A901 out of the three loud-speakers A901 through C903 and one interference sound was replayed from the loud-speaker B902 and the other was replayed from the loud-speaker C903 and they were mixed.

There are 1 (number of target sound positions)×50 (number of utterances)×2 (number of interference sound positions)×3 (number of types of one interference sound)×2 (number of types of the other interference sound)=600 cases.

In the present experiments, the mixed observation signal was segmented for each utterance, such that "utterance" and "segment" have the same meaning.

For comparison, the following four methods were prepared and sound extraction was performed for each of them.

(1) (Method 1 of the present disclosure) A delay-and-sum array was used to generate a reference signal (by using Equation [12.1] and the following Equation [14.1]).

(2) (Method 2 of the present disclosure) A target sound itself was used to generate a reference signal (by using the following Equation [14.2], where h(ω, t) is the target sound in the time-frequency domain).

(3) (Conventional method) Delay-and-sum array: Extraction was performed using Equation [2.1].

(4) (Conventional method) Independent component analysis: Method disclosed in Japanese Patent Application Laid-Open No. 2006-238409 "Speech Signal separation Device, and Noise Cancellation device and Method"

$$r(t) = \left(\sum_{\omega} |Q(\omega, t)|^2\right)^{1/2} \quad [14.1]$$

$$r(t) = \left(\sum_{\omega} |h(\omega, t)|^2\right)^{1/2} \quad [14.2]$$

The above "(2) (Method 2 of the present disclosure)" was used to evaluate to what extent the sound source extraction performance is obtained in a case where an ideal reference signal is obtained.

The above "(4) (Conventional method) Independent component analysis" is time-frequency domain independent component analysis according to a method not subject to permutation problems disclosed in Japanese Patent Application Laid-Open No. 2006-238409.

In the experiments, a matrix W(ω) to separate a target sound was obtained by iterating the following Equations [15.1] to [15.3] by 200 times:

$$Y(\omega, t) = W(\omega)X'(\omega, t)(t = 1, \ldots, T) \quad [15.1]$$

$$\Delta W(\omega) = \{I + \langle \varphi_w(Y(t))Y(\omega, t)^H \rangle_t\}W(\omega) \quad [15.2]$$

$$W(\omega) \leftarrow W(\omega) + \eta \Delta W(\omega) \quad [15.3]$$

$$Y(t) = \begin{bmatrix} Y_1(1, t) \\ \vdots \\ Y_1(m, t) \\ \hline \vdots \\ \hline Y_n(1, t) \\ \vdots \\ Y_n(m, t) \end{bmatrix} = \begin{bmatrix} Y_1(t) \\ \vdots \\ Y_n(t) \end{bmatrix} \quad [15.4]$$

$$\varphi_\omega(Y(t)) = \begin{bmatrix} \varphi_\omega(Y_1(t)) \\ \vdots \\ \varphi_\omega(Y_n(t)) \end{bmatrix} \quad [15.5]$$

$$\varphi_\omega(Y_k(t)) = -\sqrt{m}\,\frac{Y_k(\omega, t)}{\sqrt{\sum_{\omega=1}^{m} |Y_k(\omega, t)|^2}} \quad [15.6]$$

In Equation [15.2] Y(t) is a vector defined by Equation [15.4] and $\phi_\omega(\bullet)$ is a function defined by Equations [15.5] and [15.6]. Further, η is referred to as a learning rate and its value 0.3 was used in the experiments. Since independent component analysis involves generation of n number of signals as the results of separation, such that the separation results closest to the direction of the target sound were employed as the extraction results of the target sound.

The extraction results by the respective methods were multiplied by a resealing factor g(ω) calculated using Equation [8.4] described above so as to adjust magnitude and phase. In Equation [8.4], i=1 was set. It means that the sound source extraction results were projected onto microphone #1 in FIG. 23. After resealing, the extraction results by the respective methods were converted into waveforms by using inverse Fourier transform.

To evaluate the degree of extraction, a power ratio between the target sound (signal) and the interference sound (interference) was used for each of the extraction results. Specifically, a signal-to-interference ratio (SIR) was calculated. It is a logarithmic value of the power ratio between the target sound (signal) and the interference sound (interference) in the extraction results and given in dB units. The SIR value was calculated for each segment (=utterance) and its average was calculated. The averaging was performed for each of the interference sound types.

A description will be given of the degree of improvements in average SIR for each of the methods with reference to a table shown in FIG. 24.

In the case of interference sound, one of speech, music, and street noise was used as the interference sound.

In the case of two interference sounds, a combination of two of speech, music, and street noise was used.

The table shown in FIG. 24 shows a signal-to-interference ratio (SIR), which is a logarithmic value (dB) of the power ratio between the target sound (signal) and the interference sound (interference) in cases where the sound source extraction processing was performed according to the methods (1) through (4) by using those various interference sounds.

In the table shown in FIG. 24, "Observation signal SIR" at the top gives an average SIR of the mixed observation signals. Values in (1) through (4) below it give the degree of improvements in SIR, that is, a difference between the average SIR of the extraction results and the SIR of the mixed observation signals.

For example, value "4.10" shown in "Speech" in (1) "Method 1 of the present disclosure" shows that the SIR was improved from 3.65 [dB] to 3.65+4.10=7.75 [dB].

In the table shown in FIG. 24, the row of "(3) Delay-and-sum array", which is a conventional method, shows that the SIR improvement degree is about 4 [dB] at the maximum and, therefore, is of only such an extent as to emphasize the target sound somewhat.

"(1) Method 1 of the present disclosure", which generated a reference signal by using such a delay-and-sum array and extracted a target sound by using it, shows that the SIR improvement degree is much higher than that of the delay-and-sum array.

Comparison between "(1) Method 1 of the present disclosure" and "(4) Independent component analysis", which is a conventional method, shows that "(1) Method 1 of the present disclosure" gives at least almost the same SIR improvement degree as that by "(4) Independent component analysis" except for the case of one asking sound (music).

In "(4) Independent component analysis", the SIR improvement degree is lower in the case of two interference sounds other than in the case of one interference sound, which may be considered because an extremely low value (minimum value is 0.75 s) is included in the valuation data to lower the SIR improvement degree.

To perform sufficient separation in independent component analysis, it is necessary to secure an observation signal over a certain length of segment, which length increases as the number of the sound sources increases. It is considered to have caused an extreme decrease in SIR improvement degree in the case of "Two interference sounds" (=three sound sources). The method by the present disclosure does not suffer from such an extreme decrease even in the case of "two interference sounds". It is a merit of the processing by the present disclosure in comparison to independent component analysis.

"(2) Method 2 of the present disclosure" gives an SIR improvement degree in a case where an ideal reference signal was obtained and is considered to denote an upper limit of the extraction performance of the method by the present disclosure. The case of one interference sound and all of the cases of two interference sounds show much higher SIR improvement degrees than the other methods. That is, they show that by the sound source extraction method according to the processing of the present disclosure expressed by Equation [3.3], the higher the reference signal's accuracy is (the more it is similar to the target sound's time envelope), the higher-accuracy extraction can be performed.

Next, to estimate differences in computational cost, the average CPU time was measured which was used in processing to extract one utterance (about 1.8 s) according to the respective methods. The results are shown in FIG. 25.

FIG. 25 shows the average CPU times used in the processing to extract one utterance (about 1.8 s) according to the following three methods:

a method by the present disclosure;

a method using a delay-and-sum array, which is a conventional method; and a method using independent component analysis, which is a conventional method.

In all of the methods, the "matlab" language was used in implementation and executed in an "AMD Opteron 2.6 GHz" computer. Further, short-time Fourier transform, resealing, and inverse Fourier transform which were common to all of the methods were excluded from measurement time. Further, the proposed method used eigenvalue decomposition. That is, the method referred to in the variant based on singular value decomposition was not used.

As may be understood in FIG. 25, the method of the present disclosure required time more than a conventional method of delay-and-sum array but performed extraction in a fiftieth or less of the time required by independent component analysis. This is because independent component analysis requires iterative process and a computational cost proportional to the number of times of repeating, whereas the method of the present disclosure can be solved in a closed form and does not require repeated processing.

Discussion of the extraction accuracy and the processing time in combination found that the method of the present disclosure (method 1) requires a fiftieth or less of computational costs by independent component analysis but has at least the same resolution performance as it.

[5. Summary of the Configuration of the Present Disclosure]

Hereinabove, the embodiments of the present disclosure have been described in detail with reference to a specific embodiment. However, it is clear that those skilled in the art can modify or replace the embodiments without departing from the gist of the present disclosure. That is, the present disclosure has been described in an exemplification form and should not be understood restrictively. To understand the gist of the present disclosure, allowance should be made for the claims.

Additionally, the present technology may also be configured as below.

(1)

A sound signal processing device including:

an observation signal analysis unit for receiving a plurality of channels of sound signals acquired by a sound signal input unit composed of a plurality of microphones mounted to different positions and estimating a sound direction and a sound segment of a target sound to be extracted; and a sound source extraction unit for receiving the sound direction and the sound segment of the target sound analyzed by the observation signal analysis unit and extracting a sound signal of the target sound, wherein the observation signal analysis unit has:

a short-time Fourier transform unit for applying short-time Fourier transform on the incoming multi-channel sound signals to thereby generate an observation signal in the time-frequency domain; and a direction-and-segment estimation unit for receiving the observation signal generated by the short-time Fourier transform unit to thereby detect the sound direction and the sound segment of the target sound; and the sound source extraction unit generates a reference signal which corresponds to a time envelope denoting changes of the target's sound volume in the time direction based on the sound direction and the sound segment of the target sound incoming from the direction-and-segment estimation unit and extracts the sound signal of the target sound by utilizing this reference signal.

(2)

The sound signal processing device according to (1), wherein the sound source extraction unit generates a steering vector containing phase difference information between the plurality of microphones for obtaining the target sound based on information of a sound source direction of the target sound and has:

a time-frequency mask generation unit for generating a time-frequency mask which represents similarities between the steering vector and the information of the phase difference calculated from the observation signal including an interference sound, which is a signal other than a signal of the target sound;

a reference signal generation unit for generating the reference signal based on the time-frequency mask.

(3)

The sound signal processing device according to (2), wherein the reference signal generation unit generates a masking result of applying the time-frequency mask to the observation signal and averaging time envelopes of frequency bins obtained from this masking result, thereby calculating the reference signal common to all of the frequency bins.

(4)

The sound signal processing device according to (2), wherein the reference signal generation unit directly averages the time-frequency masks between the frequency bins, thereby calculating the reference signal common to all of the frequency bins.

(5)

The sound signal processing device according to (2), wherein the reference signal generation unit generates the reference signal in each frequency bin from the masking result of applying the time-frequency mask to the observation signal or the time-frequency mask.

(6)

The sound signal processing device according to any one of (2) to (5), wherein the reference signal generation unit gives different time delays to the different observation signals at each microphone in the sound signal input unit to align the phases of the signals arriving in the direction of the target sound and generates the masking result of applying the time-frequency mask to a result of a delay-and-sum array of summing up the observation signals, and obtains the reference signal from this masking result.

(7)

The sound signal processing device according to any one of (1) to (6), wherein the sound source extraction unit has a reference signal generation unit that:

generates the steering vector including the phase difference information between the plurality of microphones obtaining the target sound, based on the sound source direction information of the target sound; and generates the reference signal from the processing result of the delay-and-sum array obtained as a computational processing result of applying the steering vector to the observation signal.

(8)

The sound signal processing device according to any one of (1) to (7), wherein the sound source extraction unit utilizes the target sound obtained as the processing result of the sound source extraction processing as the reference signal.

(9)

The sound signal processing device according to any one of (1) to (8), wherein the sound source extraction unit performs loop processing to generate an extraction result by performing the sound source extraction processing, generate the reference signal from this extraction result, and perform the sound source extraction processing again by utilizing this reference signal an arbitrary number of times.

(10)

The sound signal processing device according to any one of (1) to (9), wherein the sound source extraction unit has an extracting filter generation unit that generates an extracting filter to extract the target sound from the observation signal based on the reference signal.

(11)

The sound signal processing device according to (10), wherein the extracting filter generation unit performs eigenvector selection processing to calculate a weighted co-variance matrix from the reference signal and the de-correlated observation signal and select an eigenvector which provides the extracting filter from among a plurality of the eigenvectors obtained by applying eigenvector decomposition to the weighted co-variance matrix.

(12)

The sound signal processing device according to (11), wherein the extracting filter generation unit uses a reciprocal of the N-th power (N: positive real number) of the reference signal as a weight of the weighted co-variance matrix; and performs, as the eigenvector selection processing, processing to select the eigenvector corresponding to the minimum eigenvalue and provide it as the extracting filter.

(13)

The sound signal processing device according to (11), wherein the extracting filter generation unit uses the N-th power (N: positive real number) of the reference signal as a weight of the weighted co-variance matrix; and performs, as the eigenvector selection processing, processing to select the eigenvector corresponding to the maximum eigenvalue and provide it as the extracting filter.

(14)

The sound signal processing device according to (11), wherein the extracting filter generation unit performs processing to select the eigenvector that minimizes a weighted variance of an extraction result Y which is a variance of a signal obtained by multiplying the extraction result by, as a weight, a reciprocal of the N-th power (N: positive real number) of the reference signal and provide it as the extracting filter.

(15)

The sound signal processing device according to (11), wherein the extracting filter generation unit performs processing to select the eigenvector that maximizes a weighted variance of an extraction result Y which is a variance of a signal obtained by multiplying the extraction result by, as a weight, the N-th power (N: positive real number) of the reference signal and provide it as the extracting filter.

(16)

The sound signal processing device according to (11), wherein the extracting filter generation unit performs, as the eigenvector selection processing, processing to select the eigenvector that corresponds to the steering vector most extremely and provide it as the extracting filter.

(17)

The sound signal processing device according to (10), wherein the extracting filter generation unit performs eigenvector selection processing to calculate a weighted observation signal matrix having a reciprocal of the N-th power (N: positive integer) of the reference signal as its weight from the reference signal and the de-correlated observation signal and select an eigenvector as the extracting filter from among the plurality of eigenvectors obtained by applying singular value decomposition to the weighted observation signal matrix.

(18)

A sound signal processing device including a sound source extraction unit that receives sound signals of a plurality of channels acquired by a sound signal input unit including a plurality of microphones mounted to different positions and extracts the sound signal of a target sound to be extracted, wherein the sound source extraction unit generates a reference signal which corresponds to a time envelope denoting changes of the target's sound volume in the time direction based on a preset sound direction of the target sound and a sound segment having a predetermined length and utilizes this reference signal to thereby extract the sound signal of the target sound in each of the predetermined sound segment.

Further, a processing method that is executed in the above-described apparatus and the system, and a program causing the processing to be executed are also included in the configuration of the present disclosure.

Further, the series of processing pieces described in the specification can be performed by hardware, software, or a composite configuration of them. In the case of performing the processing by the software, a program in which a sequence of the processing can be recorded is installed in a memory of a computer incorporated in dedicated hardware and executed or installed in a general-purpose computer capable of performing various types of processing and executed. For example, the program can be recorded in a recording medium beforehand. Besides being installed in the computer from the recording medium, the program can be received through a local area network (LAN) or a network such as the internet and installed in a recording medium such as a built-in hard disk.

The variety of processing pieces described in the specification may be performed in chronological order as described in it as well as concurrently or individually depending on the processing capacity of the relevant apparatus or as necessary. Further, the "system" in the present specification refers to a logical set configuration of a plurality of devices and is not limited to the various configuration of devices mounted in the same cabinet.

As described hereinabove, by the configuration of one embodiment of the present disclosure, a device and method is realized for extracting a target sound from a sound signal in which a plurality of sounds are mixed.

Specifically, the observation signal analysis unit receives multi-channel sound signals acquired by the sound signal input unit composed of a plurality of microphones mounted to the different positions and estimates a sound direction and a sound segment of a target sound to be extracted and then the sound source extraction unit receives the sound direction and the sound segment of the target sound analyzed by the observation signal analysis unit to extract the sound signal of the target sound.

For example, by applying short-time Fourier transform on the incoming multi-channel sound signals to generate an observation signal in the time-frequency domain, and based on the observation signal, a sound direction and a sound segment of a target sound are detected. Further, based on the sound direction and the sound segment of the target sound, a reference signal corresponding to a time envelope denoting changes of the target's sound volume in the time direction is generated and utilized to extract the sound signal of the target sound.

The present disclosure contains subject matter related to that disclosed in Japanese Priority Patent Application JP 2011-092028 filed in the Japan Patent Office on Apr. 18, 2011, the entire content of which is hereby incorporated by reference.

What is claimed is:

1. A sound signal processing device comprising:

one or more processors configured to:

receive a plurality of sound signals from a plurality of microphones mounted at different positions, to estimate a sound direction and a sound segment of a target sound to be extracted;

apply a short-time Fourier transform on the plurality of sound signals to generate an observation signal in a time-frequency domain, wherein the sound direction and the sound segment of the target sound is estimated based on the observation signal;

generate a reference signal which corresponds to a time envelope denoting changes of sound volume of the target sound in a time direction based on the sound direction and the sound segment of the target sound, wherein the time envelope is generated based on a phase difference between the plurality of microphones; and extract a sound signal of the target sound by utilizing the reference signal.

2. The sound signal processing device according to claim 1, wherein the one or more processors are further configured to:

generate a steering vector containing phase difference information between the plurality of microphones for obtaining the target sound based on information of a sound source direction of the target sound;

generate a time-frequency mask which represents similarities between the steering vector and the phase difference calculated from the observation signal including an interference sound, which is a signal other than a signal of the target sound; and generate the reference signal based on the time-frequency mask.

3. The sound signal processing device according to claim 2, wherein the one or more processors are further configured to generate a masking result of applying the time-frequency mask to the observation signal and averaging time envelopes of frequency bins obtained from the masking result, thereby calculating the reference signal common to all the frequency bins.

4. The sound signal processing device according to claim 3, wherein the one or more processors are further configured to directly average time-frequency masks between the frequency bins, thereby calculating the reference signal common to all the frequency bins.

5. The sound signal processing device according to claim 3, wherein the one or more processors are further configured to generate the reference signal in each of the frequency bins from the masking result of applying the time-frequency mask to the observation signal or the time-frequency mask.

6. The sound signal processing device according to claim 3, wherein the one or more processors are further configured to assign different time delays to different observation signals at each of the plurality of microphones to align phases of the plurality of sound signals arriving in the sound direction of the target sound and generate the masking result of applying the time-frequency mask to a result of a delay-and-sum array of summing up the different observation signals, and obtain the reference signal from the masking result.

7. The sound signal processing device according to claim 6, wherein the one or more processors are further configured to:

generate the steering vector including the phase difference information between the plurality of microphones obtaining the target sound, based on the sound source direction information of the target sound; and generate the reference signal from the result of the delay-and-sum array obtained as a computational processing result of applying the steering vector to the observation signal.

8. The sound signal processing device according to claim 2, wherein the one or more processors are further configured to generate an extracting filter to extract the target sound from the observation signal based on the reference signal.

9. The sound signal processing device according to claim 8, wherein the one or more processors are further configured to perform:

an eigenvector selection processing to calculate a weighted co-variance matrix from the reference signal and a de-correlated observation signal and select an eigenvector which provides the extracting filter from a plurality of eigenvectors obtained by applying an eigenvector decomposition to the weighted co-variance matrix.

10. The sound signal processing device according to claim 9, wherein the one or more processors are further configured to use a reciprocal of the N-th power (N: positive real number) of the reference signal as a weight of the weighted co-variance matrix; and perform, as the eigenvector selection processing, processing to select the eigenvector corresponding to a minimum eigenvalue and provide the eigenvector as the extracting filter.

11. The sound signal processing device according to claim 9, wherein the one or more processors are further configured to:

use the N-th power (N: positive real number) of the reference signal as a weight of the weighted co-variance matrix; and perform, as the eigenvector selection processing, processing to select the eigenvector corresponding to a maximum eigenvalue and provide the eigenvector as the extracting filter.

12. The sound signal processing device according to claim 9, wherein the one or more processors are further configured to perform processing to select the eigenvector that minimizes a weighted variance of an extraction result Y which is a variance of a signal obtained by multiplying the extraction result by, as a weight, a reciprocal of the N-th power (N: positive real number) of the reference signal and provide the eigenvector as the extracting filter.

13. The sound signal processing device according to claim 9, wherein the one or more processors are configured to perform processing to select the eigenvector that maximizes a weighted variance of an extraction result Y which is a variance of a signal obtained by multiplying the extraction result by, as a weight, the N-th power (N: positive real number) of the reference signal and provide the eigenvector as the extracting filter.

14. The sound signal processing device according to claim 9, wherein the one or more processors are configured to perform, as the eigenvector selection processing, a processing to select the eigenvector that corresponds to the steering vector and provide the eigenvector as the extracting filter.

15. The sound signal processing device according to claim 9, wherein the one or more processors are configured to perform the eigenvector selection processing to calculate a weighted observation signal matrix having a reciprocal of the N-th power (N: positive integer) of the reference signal as a weight from the reference signal and the de-correlated observation signal and select the eigenvector as the extracting filter from the plurality of eigenvectors obtained by applying singular value decomposition to the weighted observation signal matrix.

16. The sound signal processing device according to claim 1, wherein the one or more processors are further configured to utilize the target sound obtained as a processing result of a sound source extraction processing as the reference signal.

17. The sound signal processing device according to claim 1, wherein the one or more processors are further configured to:

perform loop processing to generate an extraction result by performing a sound source extraction processing, generate the reference signal from the extraction result, and perform the sound source extraction processing again by utilizing the reference signal an arbitrary number of times.

18. The sound signal processing device according to claim 1, wherein the one or more processors are further configured to:

generate a time-frequency mask representing similarities between a steering vector, containing phase difference information between the plurality of microphones based on information of a sound source direction of the target sound, and the phase difference calculated from the observation signal; and apply the time-frequency mask to the observation signal by multiplying different frequencies present in the observation signal, with different predetermined coefficients, wherein the predetermined coefficients change with respect to time.

19. A sound signal processing device comprising:

one or more processors configured to:

receive a plurality of sound signals from a plurality of microphones mounted at different positions, to extract a sound signal of a target sound to be extracted, generate a reference signal which corresponds to a time envelope denoting changes of sound volume of the target sound in a time direction based on a preset sound direction of the target sound and a sound segment having a predetermined length, and utilize the reference signal to extract the sound signal of the target sound in the sound segment, wherein the time envelope is generated based on a phase difference between the plurality of microphones.

20. A sound signal processing method performed in a sound signal processing device, the method comprising:

receiving a plurality of sound signals from a plurality of microphones mounted at different positions, to estimate a sound direction and a sound segment of a target sound to be extracted;

applying a short-time Fourier transform on the plurality of sound signals to generate an observation signal in a time-frequency domain, wherein the sound direction and the sound segment of the target sound is estimated based on the observation signal;

generating a reference signal which corresponds to a time envelope denoting changes of sound volume of the target sound in a time direction based on the sound direction and the sound segment of the target sound, wherein the time envelope is generated based on a phase difference between the plurality of microphones; and extracting a sound signal of the target sound by utilizing the reference signal.

21. A non-transitory computer-readable medium having computer-executable instructions stored thereon, the instructions, when executed by one or more processors, causing the one or more processors to:

receive a plurality of sound signals from a plurality of microphones mounted at different positions, to estimate a sound direction and a sound segment of a target sound to be extracted;

apply a short-time Fourier transform on the plurality of sound signals to generate an observation signal in a time-frequency domain, wherein the sound direction and the sound segment of the target sound is estimated based on the observation signal;

generate a reference signal which corresponds to a time envelope denoting changes of sound volume of the target sound in a time direction based on the sound direction and the sound segment of the target sound, wherein the time envelope is generated based on a phase difference between the plurality of microphones; and extract a sound signal of the target sound by utilizing the reference signal.

* * * * *